US008600737B2

(12) United States Patent
Yang et al.

(10) Patent No.: US 8,600,737 B2
(45) Date of Patent: Dec. 3, 2013

(54) SYSTEMS, METHODS, APPARATUS, AND COMPUTER PROGRAM PRODUCTS FOR WIDEBAND SPEECH CODING

(75) Inventors: Dai Yang, San Diego, CA (US); Daniel J. Sinder, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 435 days.

(21) Appl. No.: 13/149,874

(22) Filed: May 31, 2011

(65) Prior Publication Data

US 2011/0295598 A1 Dec. 1, 2011

Related U.S. Application Data

(60) Provisional application No. 61/350,425, filed on Jun. 1, 2010.

(51) Int. Cl.
*G10L 19/14* (2006.01)

(52) U.S. Cl.
USPC ..... 704/205; 704/500; 704/501

(58) Field of Classification Search
USPC ..... 704/205, 200, 220–223, 500–504
See application file for complete search history.

(56) References Cited

U.S. PATENT DOCUMENTS

| | | | | |
|---|---|---|---|---|
| 5,455,888 | A | 10/1995 | Iyengar et al. | |
| 5,715,365 | A | 2/1998 | Griffin et al. | |
| 6,889,182 | B2 | 5/2005 | Gustafsson | |
| 7,216,074 | B2 | 5/2007 | Malah et al. | |
| 7,376,554 | B2 | 5/2008 | Ojala et al. | |
| 2002/0007280 | A1 | 1/2002 | McCree | |
| 2005/0246164 | A1* | 11/2005 | Ojala et al. | 704/205 |
| 2006/0271356 | A1 | 11/2006 | Vos | |
| 2006/0277038 | A1 | 12/2006 | Vos et al. | |
| 2006/0277039 | A1 | 12/2006 | Vos et al. | |
| 2006/0277042 | A1 | 12/2006 | Vos et al. | |
| 2006/0282263 | A1 | 12/2006 | Vos et al. | |
| 2007/0088541 | A1 | 4/2007 | Vos et al. | |
| 2007/0088558 | A1 | 4/2007 | Vos et al. | |
| 2008/0027717 | A1 | 1/2008 | Rajendran et al. | |
| 2008/0126086 | A1 | 5/2008 | Vos et al. | |
| 2009/0138272 | A1 | 5/2009 | Kim et al. | |
| 2009/0319277 | A1* | 12/2009 | Black | 704/500 |
| 2010/0121646 | A1 | 5/2010 | Ragot et al. | |
| 2010/0174538 | A1 | 7/2010 | Vos | |

FOREIGN PATENT DOCUMENTS

EP 1498873 A1 1/2005

OTHER PUBLICATIONS

G.729 basetl Embedded Variable bit-rate coder: An 8—32 kbit/s scalable wideband coder bitstlaearn interoperable with 6.729; 6.729.1 (05,'06) ITU-T Standard, International Telecommuni(:ation Union, Geneva ; CH, No. 6.729.1, May 29, 2006, pp. 1-100, XP017436612, [retrieved on 2008-04-161 the whol e document.

(Continued)

*Primary Examiner* — Huyen X. Vo
(74) *Attorney, Agent, or Firm* — Heejong Yoo

(57) ABSTRACT

Methods of audio coding are described in which an excitation signal for a first frequency band of the audio signal is used to calculate an excitation signal for a second frequency band of the audio signal that is separated from the first frequency band.

49 Claims, 24 Drawing Sheets

(56) References Cited

OTHER PUBLICATIONS

Geiser et al., "Bandwidth Extension for Hierarchical Speech and Audio Coding in ITU-T Rec. G.729.1" IEEE Transactions on Audio, Speech and Language Processing, IEEE Service Center, New York, NY, USA, vol. 15, No. 8, Nov. 1, 2007, pp. 2496-2509, XP011192970, ISSN: 1558-7916, DOI: 10.1109/TASL. 2007.907330.

International Search Report and Written Opinion—PCT/US2011/038814—ISA/EPO—Jul. 27, 2011.

Jax P. et al: "Bandwidth Extension of Speech Signals: A Catalyst f o r the Introduction of Wideband Speech Coding" , IEEE Commu-n:ications Magazine, IEEE Service Center, Pis(:ataway, US, vol . 44, No. 5, May 1, 2006, pp. 106-1:11, XP001546248, ISSN: 0163-ri804, DO1 : DO1 : 10.1109,'MCOM. 2006.1637954 p. 106, l(tft-hand column, l i n e 1-p. 110, right-hand column, l i n e 22; figures 1,3,5,6.

Mikko Tammi et al: "Scalable superwideband extension f o r wideband codi ng" , Acoustics, Speech and Signal Processing, 2009. ICASSP 2009. I E E E International Conference on, I E E E, Piscataway, NJ, USA, 19 Apr. 1, 2009 (Apr. 19, 2009), pp. 161-164, XP031459191, ISBN: 978-1-4244-2353-8 p. 161, left-hand column, l i n e 1-p. 162, left-hand column, l i n e 25; figure 1.

Tobias Frieirich et al: "Spectral Band Rep1 i cation Tool f o r Very Low Del ay Audio Coding Applications" Application; of Signal Processing to Audio and Acousti':s, 2007 IEEE Wo rkshop on, I E E E , P 1 , 1 Oct. 2 107 (Oct. 1, 2007), pp. 199-202, XP031167109, ISBN : 978-1,-4244-1618-9 p. 199, 1 ine 1, 1 ast paragraph-p. 200, right-hand column, lastline.

S. Chennoukh et al. Speech enhancement via frequency bandwidth extension using line spectral frequencies. IEEE Int'l Conf. on Acoustics, Speech, and Signal Processing, ICASSP 2001, vol. 1, pp. 665-668.

* cited by examiner

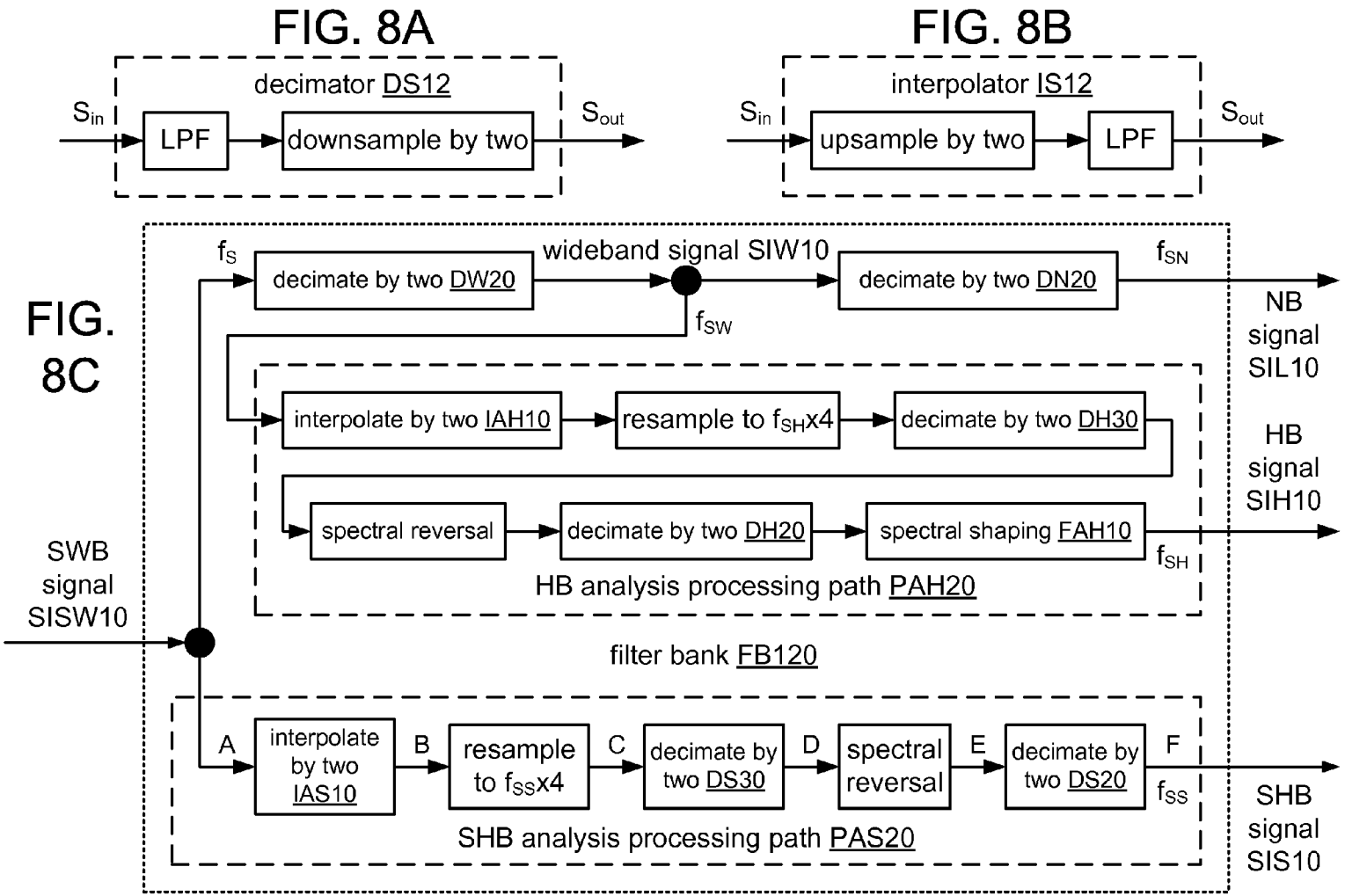
FIG. 8A
decimator DS12
$S_{in}$
LPF
downsample by two
$S_{out}$
FIG. 8B
interpolator IS12
$S_{in}$
upsample by two
LPF
$S_{out}$
FIG. 8C
$f_S$
decimate by two DW20
wideband signal SIW10
$f_{SW}$
decimate by two DN20
$f_{SN}$
NB signal SIL10
interpolate by two IAH10
resample to $f_{SH}$x4
decimate by two DH30
decimate by two DH20
spectral reversal
spectral shaping FAH10
$f_{SH}$
HB signal SIH10
HB analysis processing path PAH20
filter bank FB120
SWB signal SISW10
A
interpolate by two IAS10
B
resample to $f_{SS}$x4
C
decimate by two DS30
D
spectral reversal
E
decimate by two DS20
F
$f_{SS}$
SHB analysis processing path PAS20
SHB signal SIS10

SYSTEMS, METHODS, APPARATUS, AND COMPUTER PROGRAM PRODUCTS FOR WIDEBAND SPEECH CODING

CLAIM OF PRIORITY UNDER 35 U.S.C. §119

The present application for patent claims priority to Provisional Application No. 61/350,425 entitled "SYSTEMS, METHODS, APPARATUS, AND COMPUTER PROGRAM PRODUCTS FOR WIDEBAND SPEECH CODING," filed Jun. 1, 2010, and assigned to the assignee hereof.

BACKGROUND

1. Field

This disclosure relates to speech processing.

2. Background

Like the public switched telephone network (PSTN), traditional wireless voice service is based on narrowband audio between 300 Hz and 3400 Hz. This quality is being challenged by growing interest in wideband (WB) high definition (HD) voice systems designed to reproduce voice frequencies between 50 Hz and 7 or 8 kHz. Increasing the bandwidth in this manner to more than double can result in a significant improvement in perceived quality and intelligibility. Wideband is gaining traction in desk phones within enterprises as well as in personal computer (PC)-based Voice-over-IP (VoIP) clients (e.g., Skype) that provide communication to other clients of the same type.

With wideband conversational voice starting to gain traction, codec developers are looking at the next evolutionary step in audio bandwidth for conversational voice. There is now a trend toward new super-wideband (SWB) voice codecs, which reproduce frequencies from 50 Hz to 14 kHz.

Extending the bandwidth for voice to 14 kHz would bring a new conversational audio experience to cellular calls. By covering nearly the entire audible spectrum, the added bandwidth could contribute an improved sense of presence. Voiced speech typically rolls off at about minus six decibels per octave such that little energy remains beyond fourteen kHz.

SUMMARY

A method, according to a general configuration, of processing an audio signal having frequency content in a low-frequency subband and in a high-frequency subband that is separate from the low-frequency subband includes filtering the audio signal to obtain a narrowband signal and a superhighband signal. This method includes calculating an encoded narrowband excitation signal based on information from the narrowband signal and calculating a superhighband excitation signal based on information from the encoded narrowband excitation signal. This method includes calculating a plurality of filter parameters, based on information from the superhighband signal, that characterize a spectral envelope of the high-frequency subband, and calculating a plurality of gain factors by evaluating a time-varying relation between a signal that is based on the superhighband signal and a signal that is based on the superhighband excitation signal. In this method, the narrowband signal is based on the frequency content in the low-frequency subband, and the superhighband signal is based on the frequency content in the high-frequency subband. In this method, a width of the low-frequency subband is at least three kilohertz, and the low-frequency subband and the high-frequency subband are separated by a distance that is at least equal to half of the width of the low-frequency subband.

An apparatus, according to another general configuration, for processing an audio signal having frequency content in a low-frequency subband and in a high-frequency subband that is separate from the low-frequency subband includes means for filtering the audio signal to obtain a narrowband signal and a superhighband signal; means for calculating an encoded narrowband excitation signal based on information from the narrowband signal; and means for calculating a superhighband excitation signal based on information from the encoded narrowband excitation signal. This apparatus also includes means for calculating a plurality of filter parameters, based on information from the superhighband signal, that characterize a spectral envelope of the high-frequency subband, and means for calculating a plurality of gain factors by evaluating a time-varying relation between a signal that is based on the superhighband signal and a signal that is based on the superhighband excitation signal. In this apparatus, the narrowband signal is based on the frequency content in the low-frequency subband, and the superhighband signal is based on the frequency content in the high-frequency subband. In this apparatus, a width of the low-frequency subband is at least three kilohertz, and the low-frequency subband and the high-frequency subband are separated by a distance that is at least equal to half of the width of the low-frequency subband.

An apparatus, according to another general configuration, for processing an audio signal having frequency content in a low-frequency subband and in a high-frequency subband that is separate from the low-frequency subband includes a filter bank configured to filter the audio signal to obtain a narrowband signal and a superhighband signal, and a narrowband encoder configured to calculate an encoded narrowband excitation signal based on information from the narrowband signal. This apparatus also includes a superhighband encoder configured (A) to calculate a superhighband excitation signal based on information from the encoded narrowband excitation signal, (B) to calculate a plurality of filter parameters, based on information from the superhighband signal, that characterize a spectral envelope of the high-frequency subband, and (C) to calculate a plurality of gain factors by evaluating a time-varying relation between a signal that is based on the superhighband signal and a signal that is based on the superhighband excitation signal. In this apparatus, the narrowband signal is based on the frequency content in the low-frequency subband, and the superhighband signal is based on the frequency content in the high-frequency subband. In this apparatus, a width of the low-frequency subband is at least three kilohertz, and the low-frequency subband and the high-frequency subband are separated by a distance that is at least equal to half of the width of the low-frequency subband.

BRIEF DESCRIPTION OF THE DRAWINGS

FIG. 8A shows a block diagram of an implementation DS12 of decimator DS10.

FIG. 8B shows a block diagram of an implementation IS12 of interpolator IS10.

FIG. 8C shows a block diagram of an implementation FB120 of filter bank FB112.

DETAILED DESCRIPTION

Figure 1:
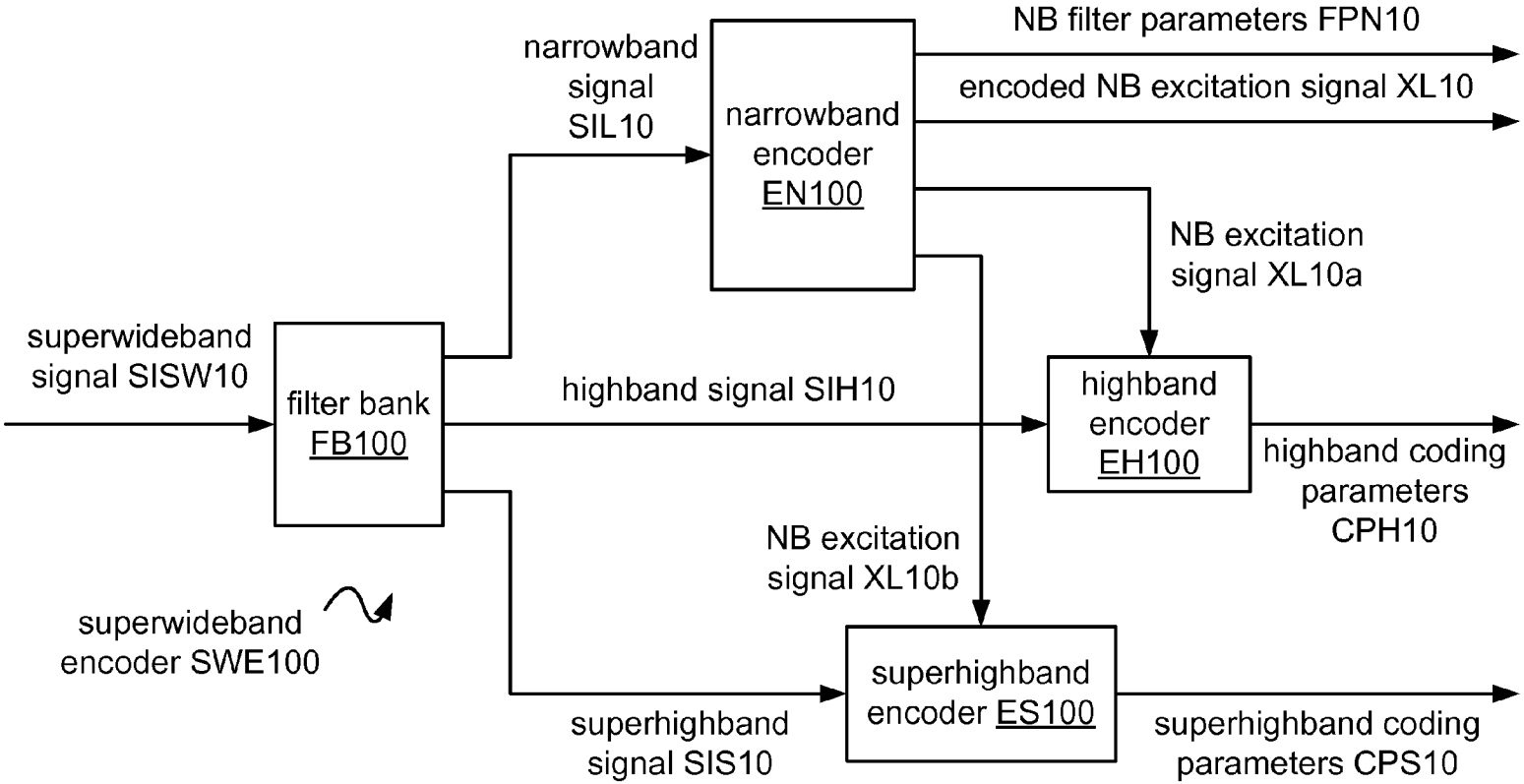
FIG. 1 shows a block diagram of a superwideband encoder SWE100 according to a general configuration.

Conventional narrowband (NB) speech codecs typically reproduce signals having a frequency range of from 300 to 3400 Hz. Wideband speech codecs extend this coverage to 50-7000 Hz. A SWB speech codec as described herein may be used to reproduce a much wider frequency range, such as from 50 Hz to 14 kHz. The extended bandwidth can offer the listener a more natural sounding experience with a greater sense of presence.

The proposed spectrally efficient SWB speech codec provides a new speech encoding and decoding technique so that the processed speech contains a much wider bandwidth than what traditional speech codecs can offer. Compared with other existing speech codecs, which are generally either narrowband (0-3.5 kHz) or wideband (0-7 kHz), the SWB speech codec gives mobile end-users a much more realistic and clearer experience.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B" or "A is the same as B"). Similarly, the term "in response to" is used to indicate any of its ordinary meanings, including "in response to at least."

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample (or "bin") of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to produce decoded representations of the frames. Such an encoder and decoder are typically deployed at opposite terminals of a communications link. In order to support a full-duplex communication, instances of both of the encoder and the decoder are typically deployed at each end of such a link.

Unless otherwise indicated by the particular context, the term "narrowband" refers to a signal having a bandwidth less than six kHz (e.g., from 0, 50, or 300 Hz to 2000, 2500, 3000, 3400, 3500, or 4000 Hz); the term "wideband" refers to a signal having a bandwidth in the range of from six kHz to ten kHz (e.g., from 0, 50, or 300 Hz to 7000 or 8000 Hz); and the term "superwideband" refers to a signal having a bandwidth greater than ten kHz (e.g., from 0, 50, or 300 Hz to 12, 14, or 16 kHz). In general, the terms "lowband," "highband," and "superhighband" are used in a relative sense, such that the frequency range of a lowband signal extends below the frequency range of a corresponding highband signal and the frequency range of the highband signal extends above the frequency range of the lowband signal, and such that the frequency range of the highband signal extends below the frequency range of a corresponding superhighband signal and the frequency range of the superhighband signal extends above the frequency range of the highband signal.

A few conversational codecs supporting superwide bandwidths have been standardized in ITU-T (International Telecommunications Union, Geneva, CH—Telecommunications Standardization Sector), such as G.719 and G.722.1C. Speex (available online at www-dot-speex-dot-org) is another SWB codec that has been made available as part of the GNU project (www-dot-gnu-dot-org). Such codecs, however, may be unsuitable for use in a constrained application such as a cellular communications network. Using such a codec to deliver a reasonable communication quality to end-users in such a network would typically require an unacceptably high bitrate, while a transform-based speech codec such as G.722.1C may provide unsatisfactory speech quality at lower bit rates.

Methods for encoding and decoding of general audio signals include transform-based methods such as the AAC (Advanced Audio Coding) family of codecs (e.g., European Telecommunications Standards Institute TS102005, International Organization for Standardization (ISO)/International Electrotechnical Commission (IEC) 14496-3:2009), which is intended for use with streaming audio content. Such codecs have several features (e.g., longer delay and higher bit rate) that may be problematic when the codec is directly applied to speech signals for conversational voice on a capacity-sensitive wireless network. The 3rd Generation Partnership Project (3GPP) standard Enhanced Adaptive Multi-Rate-Wideband (AMR-WB+) is another codec intended for use with streaming audio content that is generally capable of encoding high-quality SWB voice at low rates (e.g., as low as 10.4 kbit/s) but may be unsuitable for conversational use due to high algorithmic delay.

Existing wideband speech codecs include model-based sub-band methods, such as the Third Generation Partnership Project 2 (3GPP2, Arlington, Va.) standard Enhanced Variable Rate Codec—Wideband (EVRC-WB) codec (available online at www-dot-3gpp2-dot-org) and the G.729.1 codec. Such a codec may implement a two-band model that uses information from the low-frequency sub-band to reconstruct signal content in the high-frequency sub-band. The EVRC-WB codec, for example, uses a spectral extension of the excitation for the lowband part (50-4000 Hz) of the signal to simulate the highband excitation.

In EVRC-WB, the highband part (4-7 kHz) of the speech signal is reconstructed using a spectrally efficient bandwidth extension model. The LP analysis is still performed on the HB signal to obtain the spectral envelope information. However, the voiced HB excitation signal is no longer the real residual of the HB LPC analysis. Instead, the excitation signal of the NB part is processed through a nonlinear model to generate the HB excitation for voiced speech.

Such an approach may be used to generate a highband excitation having a wider bandwidth. After modulating the wider excitation with the appropriate envelope and energy level, the SWB speech signal can be reconstructed. Extending such an approach to include a wider frequency range for SWB speech coding is not a trivial problem, however, and it is not clear whether this kind of model-based method can efficiently handle coding of a SWB speech signal with desirable quality and reasonable delay. Although such an approach to SWB speech coding may be suitable for conversational applications on some networks, the proposed method may offer a quality advantage.

The proposed SWB codec handles the additional bandwidth gracefully and efficiently by introducing a multi-band approach to synthesize SWB speech signals. For the proposed SWB speech codec described herein, a multi-band technique has been devised to efficiently extend the bandwidth coverage so that the codec can reproduce double or even more bandwidth. The proposed method, which uses a multi-band model-based method to synthesize SWB speech signals, represents the super-highband (SHB) part with high spectral efficiency in order to recover the widest frequency component of SWB speech signals. Because of its model-based nature, this method avoids the higher delays associated with transform-based methods. With the additional SHB signal, the output speech is more natural and offers a greater sense of presence, and therefore provides the end-users a much better conversation experience. The multi-band technique also provides for embedded scalability from WB to SWB, which may not be available in a two-band approach.

In a typical example, the proposed codec is implemented using a three-band split-band approach in which the input speech signals are divided into three bands: lowband (LB), highband (HB) and super-highband (SHB). Since the energy in human speech rolls off as frequency increases, and human hearing is less sensitive as frequency increases above narrowband speech, more aggressive modeling can be used for higher frequency bands with perceptually satisfying results.

In the proposed codec, instead of using the actual SHB excitation signal, the SHB excitation signal is modeled using a nonlinear extension of the LB excitation, similar to the highband excitation extension of EVRC-WB. Since the nonlinear extension is less computationally complex than calculating and encoding the actual excitation, less power and less delay are involved in this part of the process both at the encoder and at the decoder.

The proposed method reconstructs the SHB component using the SHB excitation signal, the SHB spectral envelope, and the SHB temporal gain parameters. Spectral envelope information for the SHB can be obtained by calculating linear prediction coding (LPC) coefficients based on the original SHB signal. The SHB temporal gain parameters may be estimated by comparing the energy of the original SHB signal and energy of the estimated SHB signal. Proper selection of the LPC order and the number of temporal gains per frame may be important to the quality attained using this method, and it may be desirable to achieve an appropriate balance between the reproduced speech quality and the number of bits needed to represent the SHB envelope and temporal gain parameters.

Figure 10:
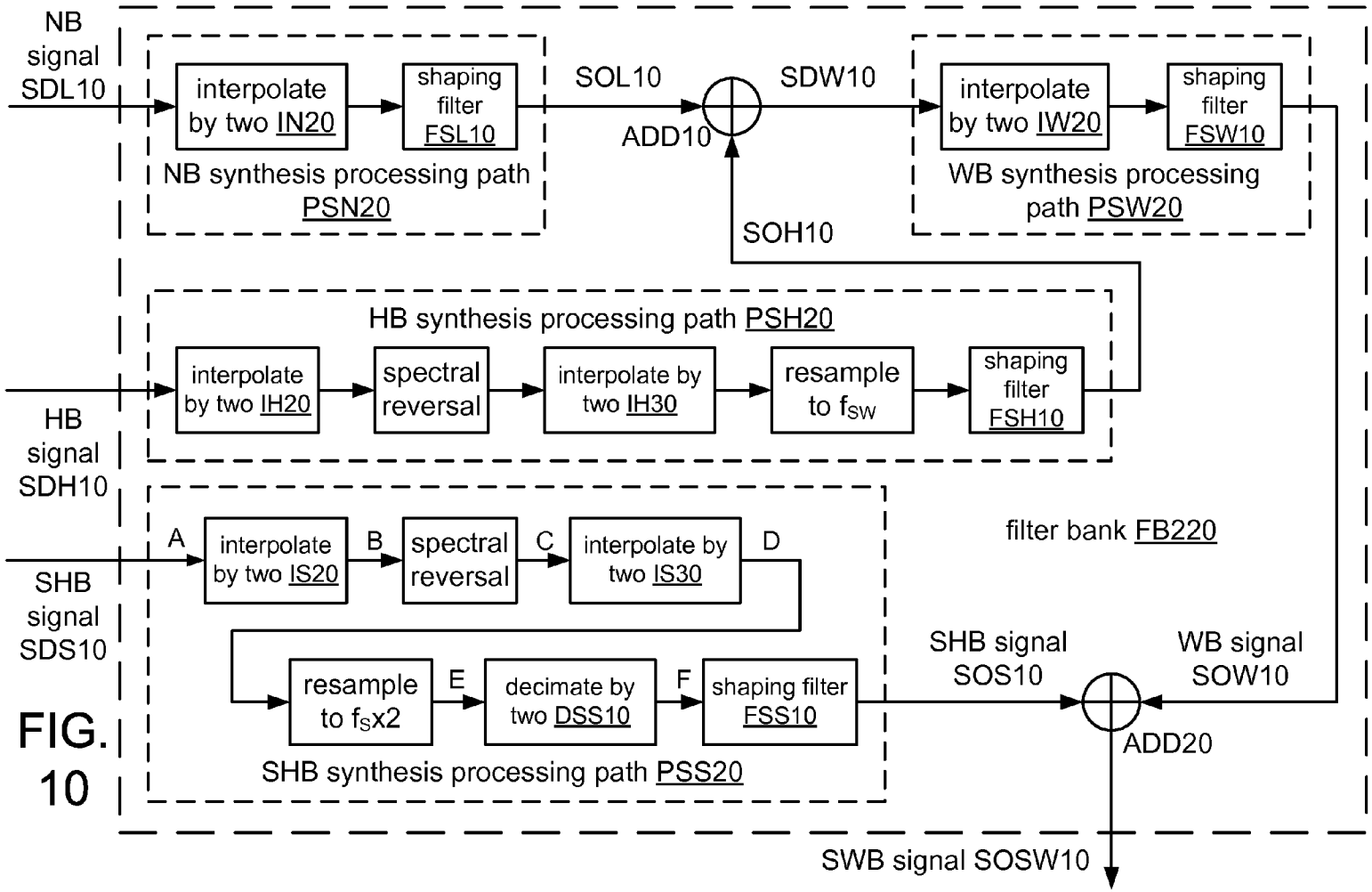
FIG. 10 shows a block diagram of an implementation FB220 of filter bank FB212.

The proposed SWB codec may be implemented to include an extension that is configured to code the SHB part (7-14 kHz) of a speech signal using an approach similar to coding of the HB part of the speech signal in EVRC-WB. In one such example as shown in FIG. 10, a nonlinear function is used to blindly extend the LPC residual of the LB (50-4000 Hz) all the way to the 7-14 kHz SHB to produce a SHB excitation signal XS10. The spectral envelope of the SHB is represented by LPC filter parameters CPS10*a* (obtained, for example, by an eighth-order LPC analysis), and the temporal envelope of the SHB signal is carried by ten sub-frame gains and one frame gain that represent a difference between the gain envelopes (e.g., the energies) of the original and synthesized SHB signals.

Figure 3:
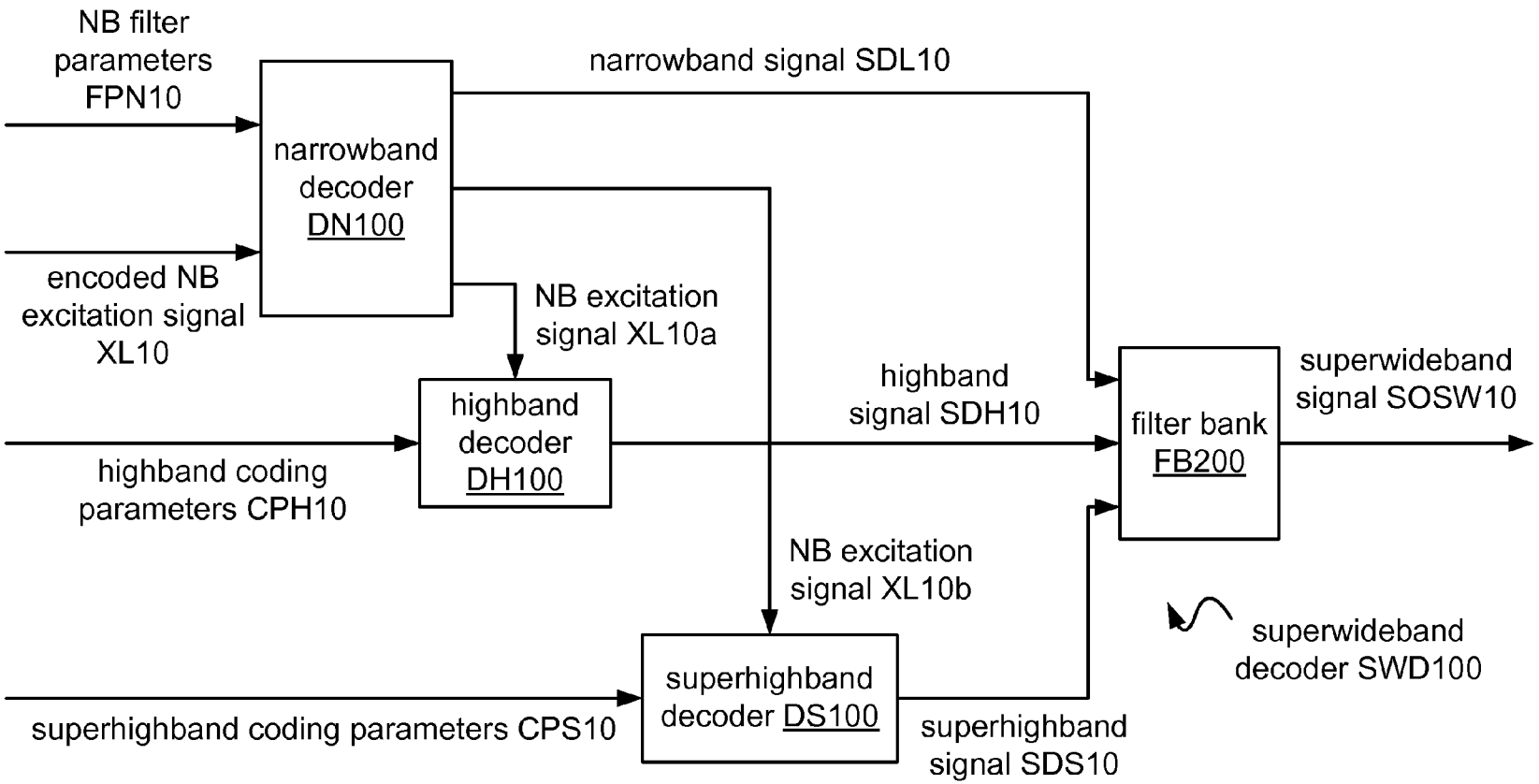
FIG. 3 is a block diagram of a superwideband decoder SWD100 according to a general configuration.
Figure 21:
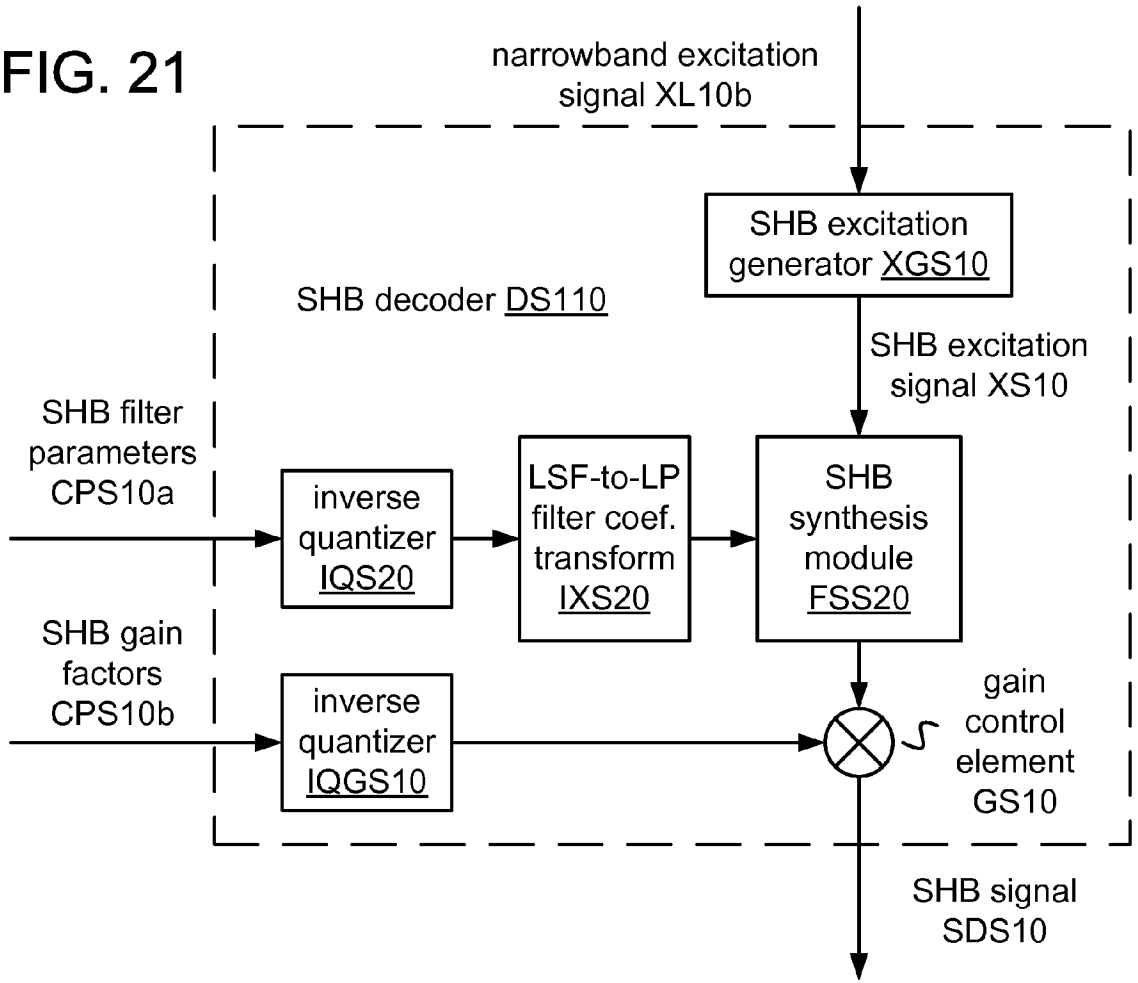
FIG. 21 shows a block diagram of an implementation DS110 of superhighband decoder DS100.

FIG. 1 shows a high-level block diagram of a SWB encoder SWE100 that includes such a SHB encoder (which may also be configured to perform quantization of the spectral and temporal envelope parameters). Corresponding SWB and SHB decoders (which may also be configured to perform dequantization of the spectral and temporal envelope parameters) are illustrated in FIGS. 3 and 21, respectively.

The proposed method may be implemented to encode the lowband (LB) (e.g., 50-4000 Hz) of the SWB signal using the same technology used in the EVRC-B narrowband speech codec standardized by 3GPP2 (and available online at www-dot-3gpp2-dot-org) as service option 68 (SO 68). For active voiced speech, EVRC-B uses a code-excited linear prediction (CELP) based compression technique to encode the lowband. The basic idea behind this technique is a source-filter model of speech production that describes speech as the result of a linear filtering of a quasi-periodic excitation (the source). The filter shapes the spectral envelope of the original input speech. The spectral envelope of the input signal can be approximated using LPC coefficients that describe each sample as a linear combination of previous samples. The excitation is modeled using adaptive and fixed codebook entries that are selected to best match the residual of the LPC analysis. Although very high quality is possible, quality may suffer for bit rates below about 8 kbps. For active unvoiced speech, EVRC-B uses a noise-excited linear prediction (NELP) based compression technique to encode the lowband.

In theory, the SHB model can be applied with arbitrary LB and HB coding techniques. The LB signal can be processed by any traditional vocoder which does the analysis and synthesis of the excitation signal and the shape of the spectral envelope of the signal. The HB part can be encoded and decoded by any codec that can reproduce the HB frequency component. It is expressly noted that it is not necessary for the HB to use a model-based approach (e.g., CELP). For example, the HB may be encoded using a transform-based technique. However, using a model-based approach to encode the HB generally entails a lower bit rate requirement and produces less coding delay.

Figure 23C:
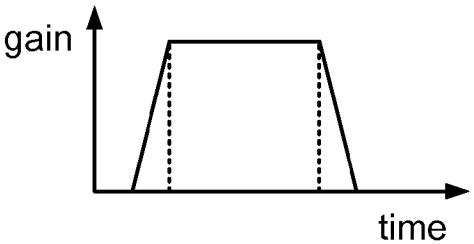
FIG. 23C shows an example of a windowing function for subframe gain computation.
Figure 23A:
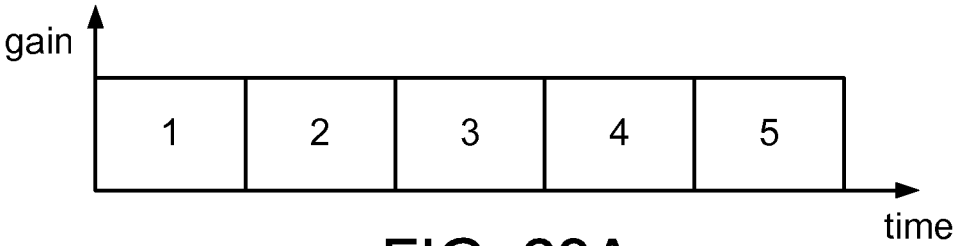
FIG. 23A shows an example of a division of a frame into five subframes.

The proposed method may also be implemented to encode the highband (HB) part of the signal (4-7 kHz) of the SWB codec using the same modeling approach as the highband of the EVRC-WB codec standardized by 3GPP2 (and available online at www-dot-3gpp2-dot-org) as service option 70 (SO 70). In this case, the HB is a blind extension of the LB linear prediction residual via a nonlinear function plus a low-rate encoding of the spectral envelope, five sub-frame gains (e.g., as shown in FIG. 23A), and one frame gain.

It may be desirable to implement the proposed codec such that a majority of bits are allocated to a high-quality encoding of the lowest frequency band. For example, EVRC-WB allocates 155 bits to encode the LB, and sixteen bits to encode the HB, for a total allocation of 171 bits per twenty-millisecond frame. The proposed SWB codec allocates an additional nineteen bits to encode the SHB, for a total allocation of 190 bits per twenty-millisecond frame. Consequently, the proposed SWB codec doubles the bandwidth of WB with an increase in bit rate of less than twelve percent. An alternate implementation of the proposed SWB codec allocates an additional twenty-four bits to encode the SHB (for a total allocation of 195 bits per twenty-millisecond frame). Another alternate implementation of the proposed SWB codec allocates an additional thirty-eight bits to encode the SHB (for a total allocation of 209 bits per twenty-millisecond frame).

One version of the proposed encoder transmits three sets of highband parameters to the decoder for reconstruction of the SHB signal: LSF parameters, subframe gains, and frame gain. The LSF parameters and subframe gains for each frame are multi-dimensional, while the frame gain is a scalar. For quantization of the multi-dimensional parameters, it may be desirable to minimize the number of bits required by using vector quantization (VQ). Since the vector dimensions of the highband LSF parameters and subframe gains are usually high, a split-VQ can be used. To achieve a certain quantization quality, the VQ codebook may be large. For a case in which a single-vector VQ is chosen, a multi-stage VQ can be adopted in order to reduce the memory requirement and bring down the codebook searching complexity.

FIG. 1 shows a block diagram of a superwideband encoder SWE100 according to a general configuration. Filter bank FB100 is configured to filter a superwideband signal SISW10 to produce a narrowband signal SIL10, a highband signal SIH10, and a superhighband signal SIS30. Narrowband encoder EN100 is configured to encode narrowband signal SIL10 to produce narrowband (NB) filter parameters FPN10 and an encoded NB excitation signal XL10. As described in further detail herein, narrowband encoder EN100 is typically configured to produce narrowband filter parameters FPN10 and encoded narrowband excitation signal XL10 as codebook indices or in another quantized form. Highband encoder EH100 is configured to encode highband signal SIH10 according to information XL10*a* from encoded narrowband excitation signal XL10 to produce highband coding parameters CPH10. As described in further detail herein, highband encoder EH100 is typically configured to produce highband coding parameters CPH10 as codebook indices or in another quantized form. Superhighband encoder ES100 is configured to encode superhighband signal SIS10 according to information XL10*b* from encoded narrowband excitation signal XL10 to produce superhighband coding parameters CPS10. As described in further detail herein, superhighband encoder ES100 is typically configured to produce superhighband coding parameters CPS10 as codebook indices or in another quantized form.

One particular example of superwideband encoder SWE100 is configured to encode superwideband signal SISW10 at a rate of about 9.75 kbps (kilobits per second), with about 7.75 kbps being used for narrowband filter parameters FPN10 and encoded narrowband excitation signal XL10, about 0.8 kbps being used for highband coding parameters CPH10, and about 0.95 kbps being used for superhighband coding parameters CPS10. Another particular example of superwideband encoder SWE100 is configured to encode superwideband signal SISW10 at a rate of about 9.75 kbps, with about 7.75 kbps being used for narrowband filter parameters FPN10 and encoded narrowband excitation signal XL10, about 0.8 kbps being used for highband coding parameters CPH10, and about 1.2 kbps being used for superhighband coding parameters CPS10. Another particular example of superwideband encoder SWE100 is configured to encode superwideband signal SISW10 at a rate of about 10.45 kbps, with about 7.75 kbps being used for narrowband filter parameters FPN10 and encoded narrowband excitation signal XL10, about 0.8 kbps being used for highband coding parameters CPH10, and about 1.9 kbps being used for superhighband coding parameters CPS10.

Figure 2:
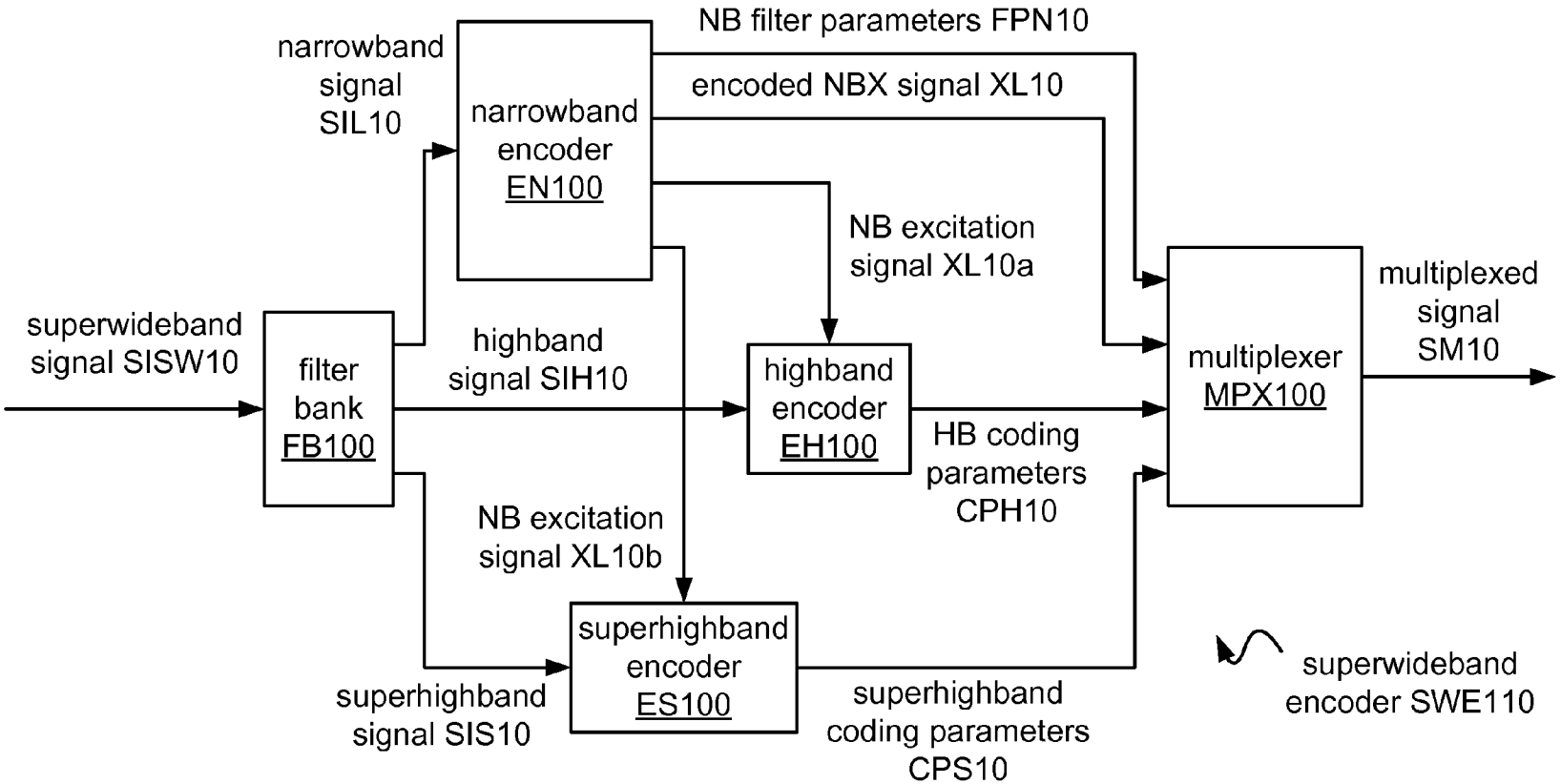
FIG. 2 shows a block diagram of an implementation SWE110 of superwideband encoder SWE100.

It may be desired to combine the encoded narrowband, highband, and superhighband signals into a single bitstream. For example, it may be desired to multiplex the encoded signals together for transmission (e.g., over a wired, optical, or wireless transmission channel), or for storage, as an encoded superwideband signal. FIG. 2 shows a block diagram of an implementation SWE110 of superwideband encoder SWE100 that includes a multiplexer MPX100 (e.g., a bit packer) that is configured to combine narrowband filter parameters FPN10, encoded narrowband excitation signal XL10, highband coding parameters CPH10, and superhighband coding parameters CPS10 into a multiplexed signal SM10.

An apparatus including encoder SWE110 may also include circuitry configured to transmit multiplexed signal SM10 into a transmission channel such as a wired, optical, or wireless channel. Such an apparatus may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, TCP/IP, cdma2000).

It may be desirable for multiplexer MPX100 to be configured to embed the encoded narrowband signal (including narrowband filter parameters FPN10 and encoded narrowband excitation signal XL10) as a separable substream of multiplexed signal SM10, such that the encoded narrowband signal may be recovered and decoded independently of another portion of multiplexed signal SM10 such as a highband signal, a superhighband signal, and/or lowband signal. For example, multiplexed signal SM10 may be arranged such that the encoded narrowband signal may be recovered by stripping away the highband coding parameters CPH10 and superhighband coding parameters CPS10. One potential advantage of such a feature is to avoid the need for transcoding the encoded superwideband signal before passing it to a system that supports decoding of the narrowband signal but does not support decoding of the highband or superhighband portions.

Alternatively or additionally, it may be desirable for multiplexer MPX100 to be configured to embed the encoded wideband signal (including narrowband filter parameters FPN10, encoded narrowband excitation signal XL10, and highband coding parameters CPH10) as a separable substream of multiplexed signal SM10, such that the encoded narrowband signal may be recovered and decoded independently of another portion of multiplexed signal SM10 such as a superhighband and/or lowband signal. For example, multiplexed signal SM10 may be arranged such that the encoded wideband signal may be recovered by stripping away superhighband coding parameters CPS10. One potential advantage of such a feature is to avoid the need for transcoding the encoded superwideband signal before passing it to a system that supports decoding of the wideband signal but does not support decoding of the superhighband portion.

FIG. 3 is a block diagram of a superwideband decoder SWD100 according to a general configuration. Narrowband decoder DN100 is configured to decode narrowband filter parameters FPN10 and encoded narrowband excitation signal XL10 to produce a decoded narrowband signal SDL10. Highband decoder DH100 is configured to produce a decoded highband signal SDH10 based on highband coding parameters CPH10 and information XL10*a* from encoded excitation signal XL10. Superhighband decoder DS100 is configured to produce a decoded superhighband signal SDS10 based on superhighband coding parameters CPS10 and information XL10*b* from encoded excitation signal XL10. Filter bank FB200 is configured to combine decoded narrowband signal SDL10, decoded highband signal SDH10, and decoded superhighband signal SDS10 to produce a superwideband output signal SOSW10.

Figure 4:
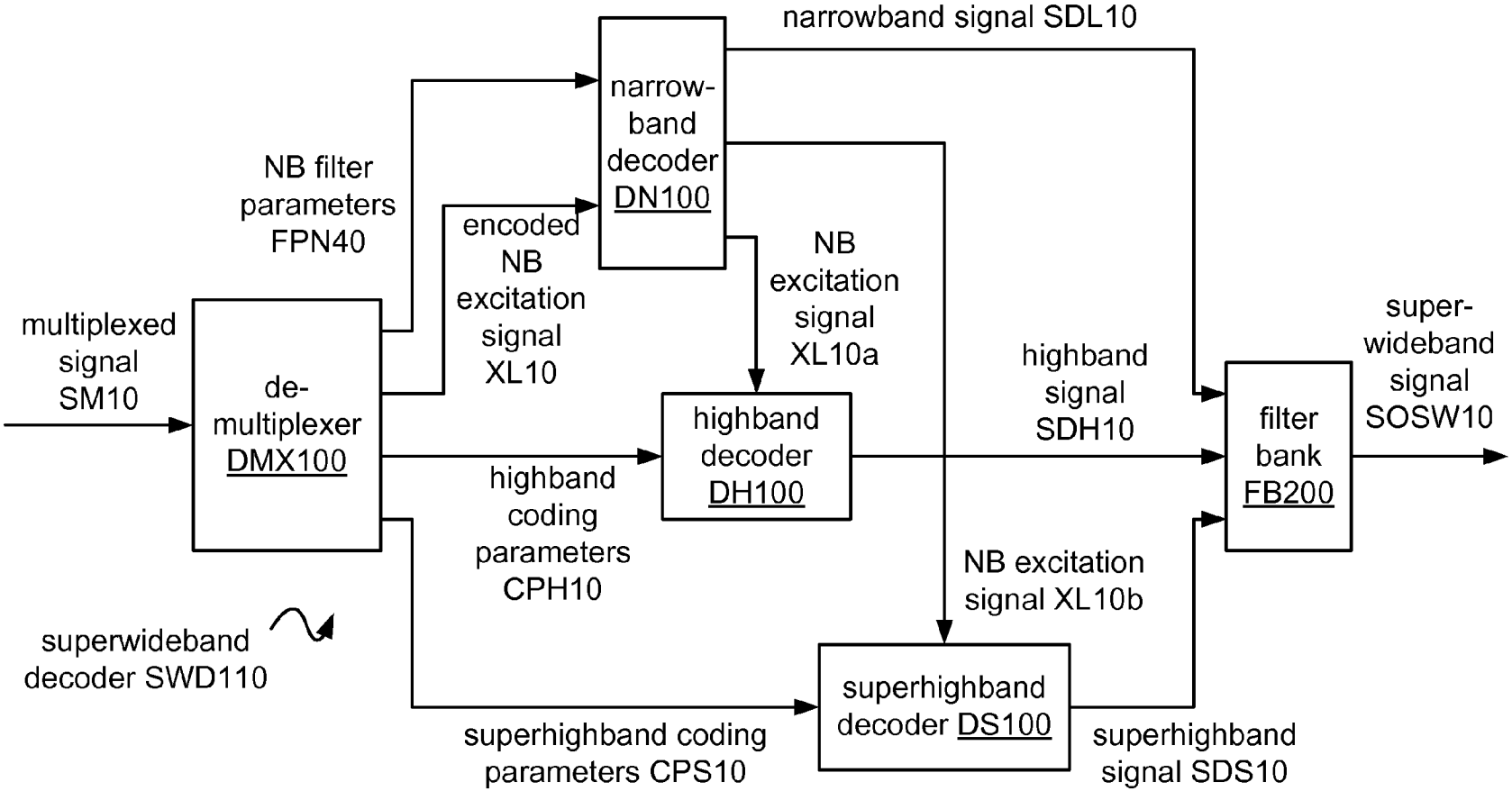
FIG. 4 is a block diagram of an implementation SWD110 of superwideband decoder SWD100.

FIG. 4 is a block diagram of an implementation SWD110 of superwideband decoder SWD100 that includes a demultiplexer DMX100 (e.g., a bit unpacker) configured to produce encoded signals FPN40, XL10, CPH10, and CPS10 from multiplexed signal SM10. An apparatus including decoder SWE110 may include circuitry configured to receive multiplexed signal SM10 from a transmission channel such as a wired, optical, or wireless channel. Such an apparatus may also be configured to perform one or more channel decoding operations on the signal, such as error correction decoding (e.g., rate-compatible convolutional decoding) and/or error detection decoding (e.g., cyclic redundancy decoding), and/or one or more layers of network protocol decoding (e.g., Ethernet, TCP/IP, cdma2000).

Filter bank FB100 is configured to filter an input signal according to a split-band scheme to produce a plurality of band-limited subband signals that each contain frequency content of a corresponding subband of the input signal. Depending on the design criteria for the particular application, the output subband signals may have equal or unequal bandwidths and may be overlapping or nonoverlapping. A configuration of filter bank FB100 that produces more than three subband signals is also possible. For example, such a filter bank may be configured to produce one or more lowband signals that include components in a frequency range below that of narrowband signal SIL10 (such as a range of from 0, 20, or 50 Hz to 200, 300, or 500 Hz). It is also possible for such a filter bank to be configured to produce one or more ultrahighband signals that include components in a frequency range above that of superhighband signal SIH10 (such as a range of 14-20, 16-20, or 16-32 kHz). In such case, superwideband encoder SWE100 may be implemented to encode this signal or signals separately, and multiplexer MPX100 may be configured to include the additional encoded signal or signals in multiplexed signal SM10 (e.g., as a separable portion).

Figure 5A:
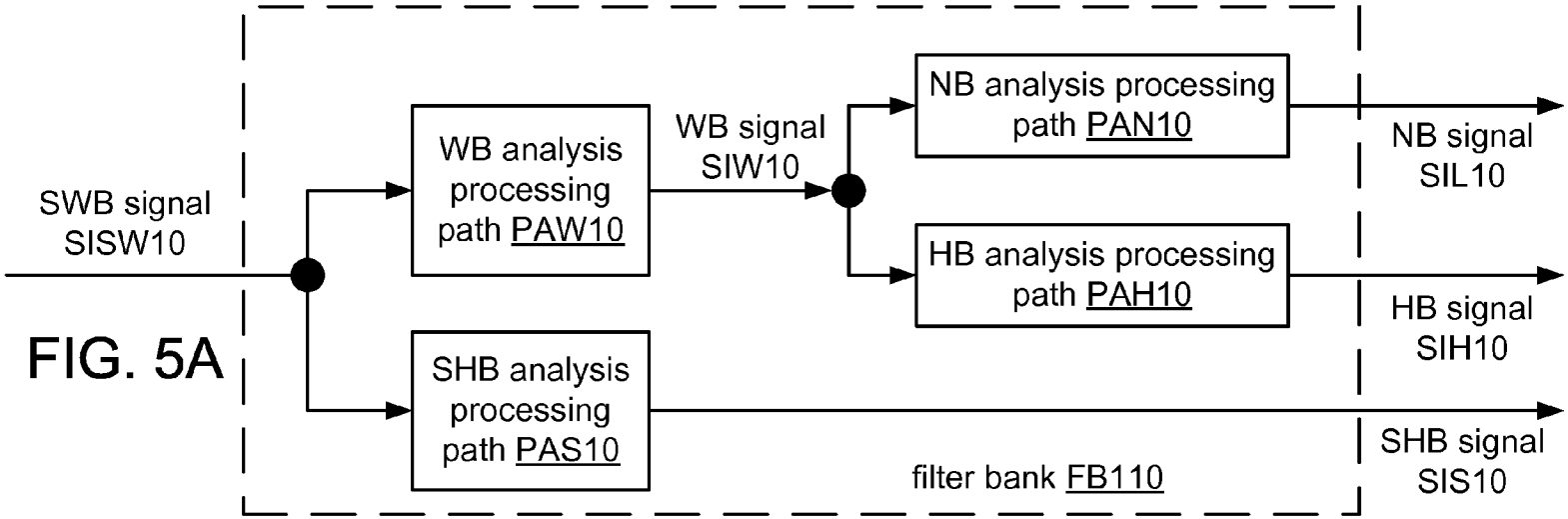
FIG. 5A shows a block diagram of an implementation FB110 of filter bank FB100.

Filter bank FB100 is arranged to receive a superwideband signal SISW10 having a low-frequency subband, a mid-frequency subband, and a high-frequency subband. FIG. 5A shows a block diagram of an implementation FB110 of filter bank FB100 that is configured to produce three subband signals (narrowband signal SIL10, highband signal SIH10, and superhighband signal SIS10) that have reduced sampling rates. Filter bank FB110 includes a wideband analysis processing path PAW10 that is configured to receive superwideband signal SISW10 and to produce a wideband signal SIW10, and a superhighband analysis processing path PAS10 that is configured to receive superwideband signal SISW10 and to produce superhighband signal SIS30. Filter bank FB110 also includes a narrowband analysis processing path PAN10 that is configured to receive wideband signal SIW10 and to produce narrowband signal SIL10, and a highband analysis processing path PAH10 that is configured to receive wideband speech signal SIW10 and to produce highband signal SIH10. Narrowband signal SIL10 contains the frequency content of the low-frequency subband, highband signal SIH10 contains the frequency content of the mid-frequency subband, wideband signal SIW10 contains the frequency content of the low-frequency subband and the frequency content of the mid-frequency subband, and superhighband signal SIS10 contains the frequency content of the high-frequency subband.

Figures 6A, 6B:
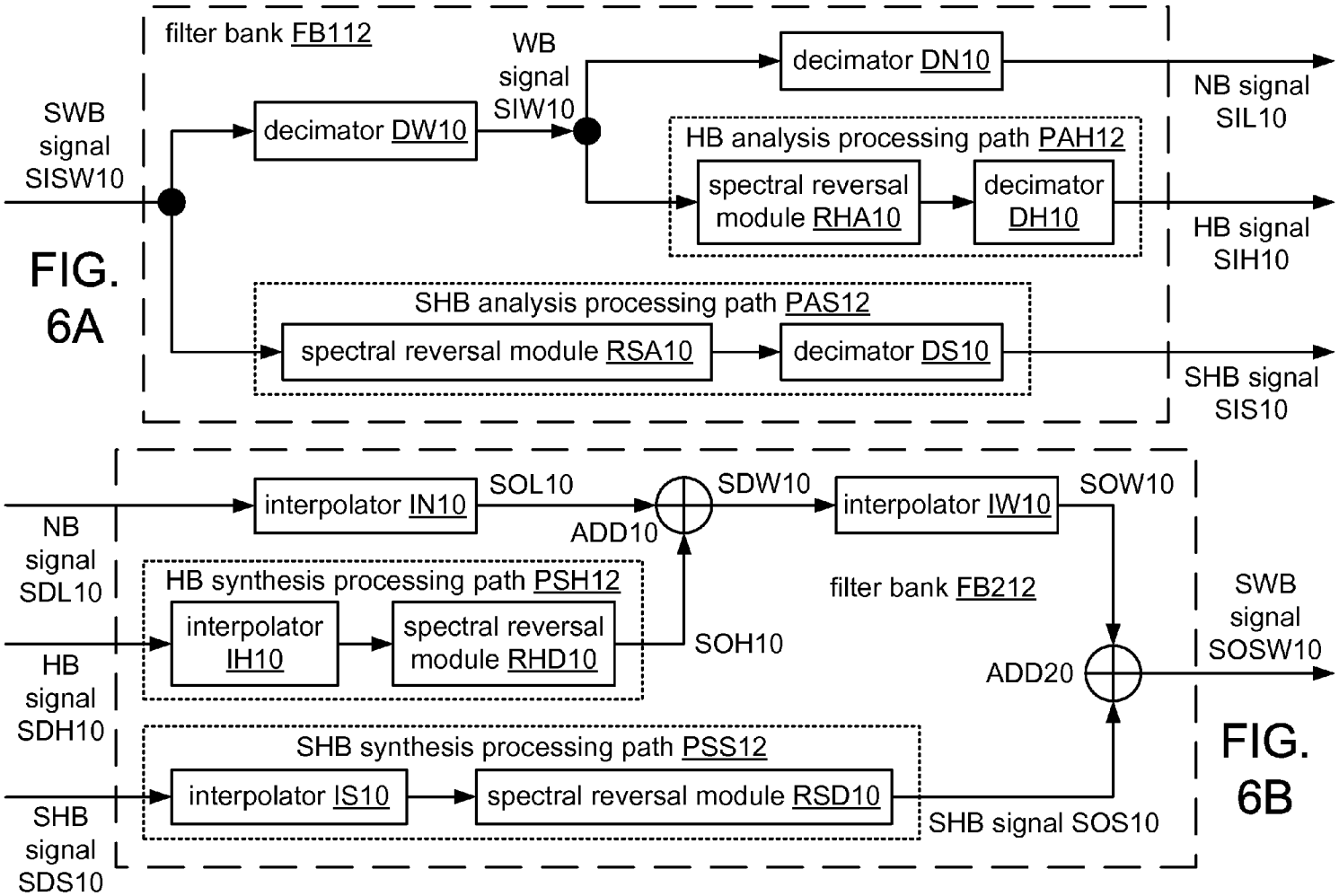
FIG. 6A shows a block diagram of an implementation FB112 of filter bank FB110.
FIG. 6B shows a block diagram of an implementation FB212 of filter bank FB210.

Because the subband signals have more narrow bandwidths than superwideband signal SISW10, their sampling rates can be reduced to some extent (e.g., to reduce computational complexity without loss of information). FIG. 6A shows a block diagram of an implementation FB112 of filter bank FB110 in which wideband analysis processing path PAW10 is implemented by a decimator DW10 and narrowband analysis processing path PAN10 is implemented by a decimator DN10. Filter bank FB112 also includes an implementation PAH12 of highband analysis processing path PAH10 that has a spectral reversal module RHA10 and a decimator DH10, and an implementation PAS12 of superhighband analysis processing path PAS10 that has a spectral reversal module RSA10 and a decimator DS10.

Each of the decimators DW10, DN10, DH10, and DS10 may be implemented as a lowpass filter (e.g., to prevent aliasing) followed by a downsampler. For example, FIG. 8A shows a block diagram of such an implementation DS12 of decimator DS10 that is configured to decimate an input signal by a factor of two. In such cases, the lowpass filter may be implemented as a finite-impulse-response (FIR) or infinite-impulse-response (IIR) filter having a cutoff frequency of $f_s/(2k_d)$, where $f_s$ is the sampling rate of the input signal and $k_d$ is the decimation factor, and the downsampling may be performed by removing samples of the signal and/or replacing samples with average values.

Alternatively, one or more (possibly all) of the decimators DW10, DN10, DH10, and DS10 may be implemented as a filter that integrates the lowpass filtering and downsampling operations. One such example of a decimator is configured to perform a decimation by two using a three-section polyphase implementation such that the samples of an input signal to be decimated $S_{in}$ [n] for even n≥0 are filtered through an allpass filter whose transfer function is given by $$H_{down2,0} = \left(\frac{a_{down2,0,0} + z^{-1}}{1 + a_{down2,0,0}z^{-1}}\right)\left(\frac{a_{down2,0,1} + z^{-1}}{1 + a_{down2,0,1}z^{-1}}\right)\left(\frac{a_{down2,0,2} + z^{-1}}{1 + a_{down2,0,2}z^{-1}}\right),$$

and the samples of the input signal $S_{in}$[n] for odd n≥0 are filtered through an allpass filter whose transfer function is given by $$H_{down2,1} = \left(\frac{a_{down2,1,0} + z^{-1}}{1 + a_{down2,1,0}z^{-1}}\right)\left(\frac{a_{down2,1,1} + z^{-1}}{1 + a_{down2,1,1}z^{-1}}\right)\left(\frac{a_{down2,1,2} + z^{-1}}{1 + a_{down2,1,2}z^{-1}}\right).$$

The outputs of these two polyphase components are added (e.g., averaged) to yield the decimated output signal $S_{out}$ [n].

In a particular example, the values ($a_{down2,0,0}$, adown2,0,1, adown2,0,2, adown2,1,0, adown2,1,1, adown2,1,2 are equal to (0.06056541924291, 0.42943401549235, 0.80873048306552, 0.22063024829630, 0.63593943961708, 0.94151583095682). Such an implementation may allow reuse of functional blocks of logic and/or code. For example, it is expressly noted that any of the decimate-by-two operations described herein may be performed in this manner (and possibly by the same module at different times). In a particular example, decimators DH10 and DS10 are implemented using this three-section polyphase implementation.

Alternatively or additionally, one or more (possibly all) of the decimators DW10, DN10, DH10, and DS10 is configured to perform a decimation by two using a polyphase implementation such that the input signal to be decimated is separated into odd time-indexed and even time-indexed subsequences which are each filtered by a respective thirteenth-order FIR filter. In other words, the samples of an input signal to be decimated $S_{in}$[n] for even sample index n≥0 are filtered through a first 13th-order FIR filter $H_{dec1}(Z)$, and the samples of the input signal $S_{in}$ [n] for odd n≥0 are filtered through a second 13th-order FIR filter $H_{dec2}(z)$. The outputs of these two polyphase components are added (e.g., averaged) to yield the decimated output signal $S_{out}$[n]. In a particular example, the coefficients of filters $H_{dec1}(z)$ and $H_{dec2}(z)$ are as shown in the following table:

| tap | $H_{dec1}$ (z) | $H_{dec2}$ (z) |
|---|---|---|
| 0 | 4.64243812e−3 | 6.25339997e−3 |
| 1 | −8.20745101e−3 | −1.05729745e−2 |
| 2 | 1.34441876e−2 | 1.69574704e−2 |
| 3 | −2.13208829e−2 | −2.68710133e−2 |
| 4 | 3.41918706e−2 | 4.43922465e−2 |
| 5 | −5.98583629e−2 | −8.68124575e−2 |
| 6 | 1.48104776e−1 | 4.49506086e−1 |
| 7 | 4.49506086e−1 | 1.48104776e−1 |
| 8 | −8.68124575e−2 | −5.98583629e−2 |
| 9 | 4.43922465e−2 | 3.41918706e−2 |
| 10 | −2.68710133e−2 | −2.13208829e−2 |
| 11 | 1.69574704e−2 | 1.34441876e−2 |
| 12 | −1.05729745e−2 | −8.20745101e−3 |
| 13 | 6.25339997e−3 | 4.64243812e−3 |

Such an implementation may allow reuse of functional blocks of logic and/or code. For example, it is expressly noted that any of the decimate-by-two operations described herein may be performed in this manner (and possibly by the same module at different times). In a particular example, decimators DW10 and DN10 are implemented using this FIR polyphase implementation.

In highband analysis processing path PAH12, spectral reversal module RHA10 reverses the spectrum of wideband signal SIW10 (e.g., by multiplying the signal with the function $e^{jn\pi}$ or the sequence $(-1)^n$, whose values alternate between +1 and −1), and decimator DH10 reduces the sampling rate of the spectrally reversed signal according to a desired decimation factor to produce highband signal SIH10. In superhighband processing path PAS12, spectral reversal module RSA10 reverses the spectrum of superwideband signal SISW10 (e.g., by multiplying the signal with the function $e^{jn\pi}$ or the sequence $(-1)^n$), and decimator DS10 reduces the sampling rate of the spectrally reversed signal according to a desired decimation factor to produce superhighband signal SIS10. A configuration of filter bank FB112 that produces more than three passband signals for encoding is also contemplated.

Figure 5B:
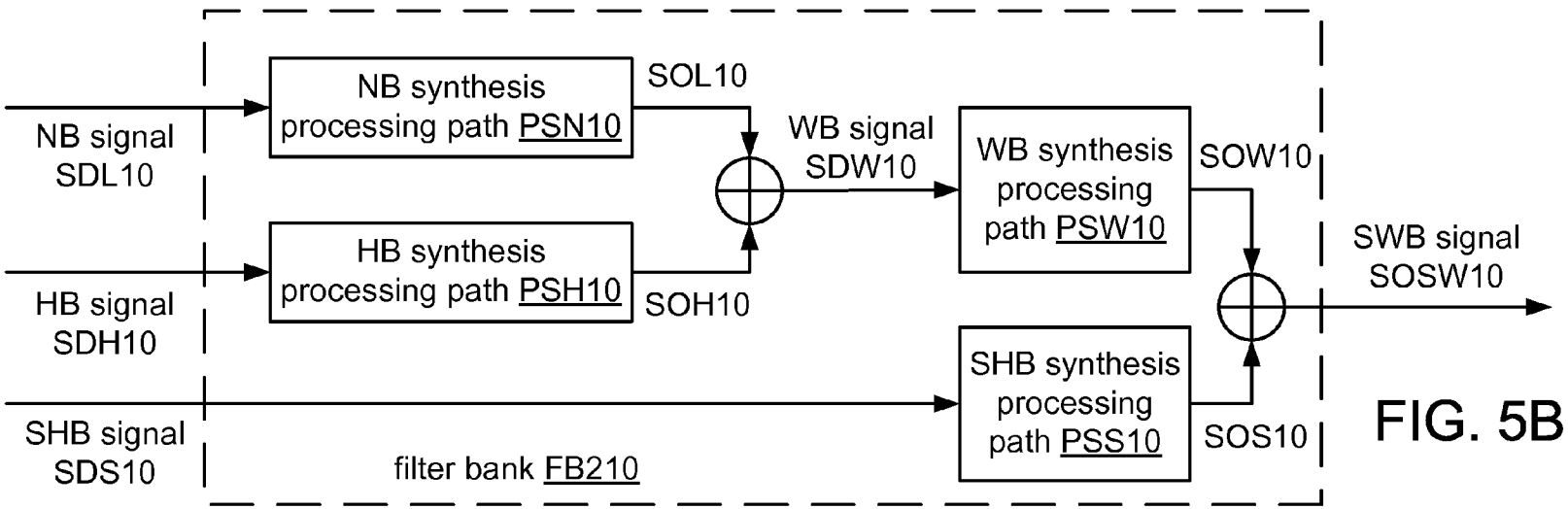
FIG. 5B shows a block diagram of an implementation FB210 of filter bank FB200.

Filter bank FB200 is arranged to filter a passband signal having low-frequency content, a passband signal having mid-frequency content, and a passband signal having high-frequency content according to a split-band scheme to produce an output signal, where each of the band-limited subband signals contains frequency content of a corresponding subband of the output signal. Depending on the design criteria for the particular application, the output subband signals may have equal or unequal bandwidths and may be overlapping or nonoverlapping. FIG. 5B shows a block diagram of an implementation FB210 of filter bank FB200 that is configured to receive three passband signals (decoded narrowband signal SDL10, decoded highband signal SDH10, and decoded superhighband signal SDS10) that have reduced sampling rates and to combine the frequency contents of the passband signals to produce a superwideband output signal SOSW10.

Filter bank FB210 includes a narrowband synthesis processing path PSN10 that is configured to receive narrowband signal SDL10 (e.g., a decoded version of narrowband signal SIL10) and to produce a narrowband output signal SOL10, and a highband synthesis processing path PSH10 that is configured to receive highband signal SDH10 (e.g., a decoded version of highband signal SIH10) and to produce a highband output signal SOH10. Filter bank FB210 also includes an adder ADD10 that is configured to produce a decoded wideband signal SDW10 (e.g., a decoded version of wideband signal SIW10) as a sum of the passband signals SOL10 and SOH10. Adder ADD10 may also be implemented to produce decoded wideband signal SDW10 as a weighted sum of the two passband signals SOL10 and SOH10 according to one or more weights received and/or calculated by superhighband decoder SWD100. In one such example, adder ADD10 is configured to produce decoded wideband signal SDW10 according to the expression SDW10[n]=SOL10[n]+0.9*SOH10[n].

Filter bank FB210 also includes a wideband synthesis processing path PSW10 that is configured to receive decoded wideband signal SDW10 and to produce a wideband output signal SOW10, and a superhighband synthesis processing path PSS10 that is configured to receive a superhighband signal SDS10 (e.g., a decoded version of superhighband signal SIS10) and to produce a superhighband output signal SOS10. Filter bank FB210 also includes an adder ADD20 that is configured to produce superwideband output signal SOSW10 (e.g., a decoded version of superwideband signal SISW10) as a sum of signals SOW10 and SOS10. Adder ADD20 may also be implemented to produce superwideband output signal SOSW10 as a weighted sum of the two passband signals SOW10 and SOS10 according to one or more weights received and/or calculated by superhighband decoder SWD100. In one such example, filter bank FB210 is configured to produce superwideband output signal SOSW10 according to the expression SOSW10[n]=SOW10[n]+0.9*SOS10[n]. Narrowband signals SDL10 and SOL10 contain the frequency content of a low-frequency subband of signal SOSW10, highband signals SDH10 and SOH10 contain the frequency content of a mid-frequency subband of signal SOSW10, wideband signals SDW10 and SOW10 contain the frequency content of the low-frequency subband and the frequency content of the mid-frequency subband of signal SOSW10, and superhighband signals SDS10 and SOS10 contain the frequency content of a high-frequency subband of signal SOSW10.

A configuration of filter bank FB210 that combines more than three subband signals is also possible. For example, such a filter bank may be configured to produce an output signal having frequency content from one or more lowband signals that include components in a frequency range below that of narrowband signal SDL10 (such as a range of from 0, 20, or 50 Hz to 200, 300, or 500 Hz). It is also possible for such a filter bank to be configured to produce an output signal having frequency content from one or more ultrahighband signals that include components in a frequency range above that of superhighband signal SDH10 (such as a range of 14-20, 16-20, or 16-32 kHz). In such case, superwideband decoder SWD100 may be implemented to decode this signal or signals separately, and demultiplexer DMX100 may be configured to extract the additional encoded signal or signals from multiplexed signal SM10 (e.g., as a separable portion).

Because the subband signals have more narrow bandwidths than superwideband output signal SOSW10, their sampling rates may be lower than that of signal SOSW10. FIG. 6B shows a block diagram of an implementation FB212 of filter bank FB210 in which narrowband synthesis processing path PSN10 is implemented by an interpolator IN10 and wideband synthesis processing path PSW10 is implemented by an interpolator IW10. Filter bank FB212 also includes an implementation PSH12 of highband synthesis processing path PSH10 that has an interpolator IH10 and a spectral reversal module RHD10, and an implementation PSS12 of superhighband synthesis processing path PSS10 that has an interpolator IS10 and a spectral reversal module RSD10.

Each of the interpolators IW10, IN10, IH10, and IS10 may be implemented as an upsampler followed by a lowpass filter (e.g., to prevent aliasing). For example, FIG. 8B shows a block diagram of such an implementation IS12 of interpolator IS10 that is configured to interpolate an input signal by a factor of two. In such cases, the lowpass filter may be implemented as a finite-impulse-response (FIR) or infinite-impulse-response (IIR) filter having a cutoff frequency of $f_s/(2k_d)$, where $f_s$ is the sampling rate of the input signal and $k_d$ is the interpolation factor, and the upsampling may be performed by zero-stuffing and/or by duplicating samples.

Alternatively, one or more (possibly all) of interpolators IW10, IN10, IH10, and IS10 may be implemented as a filter that integrates the upsampling and lowpass filtering operations. One such example of an interpolator is configured to perform an interpolation by two using a three-section polyphase implementation such that the samples of the interpolated signal $S_{out}[n]$ for even $n \geq 0$ are obtained by filtering an input signal $S_{in}[n/2]$ through an allpass filter whose transfer function is given by $$H_{up2,0} = \left(\frac{a_{up2,0,0} + z^{-1}}{1 + a_{up2,0,0}z^{-1}}\right)\left(\frac{a_{up2,0,1} + z^{-1}}{1 + a_{up2,0,1}z^{-1}}\right)\left(\frac{a_{up2,0,2} + z^{-1}}{1 + a_{up2,0,2}z^{-1}}\right),$$

and the samples of the interpolated signal $S_{out}[n]$ for odd $n \geq 0$ are obtained by filtering the input signal $S_{in}[(n-1)/2]$ through an allpass filter whose transfer function is given by $$H_{up2,1} = \left(\frac{a_{up2,1,0} + z^{-1}}{1 + a_{up2,1,0}z^{-1}}\right)\left(\frac{a_{up2,1,1} + z^{-1}}{1 + a_{up2,1,1}z^{-1}}\right)\left(\frac{a_{up2,1,2} + z^{-1}}{1 + a_{up2,1,2}z^{-1}}\right).$$

In a particular example, the values ($a_{up2,0,0}$, $a_{up2,0,1}$, $a_{up2,0,2}$) are equal to (0.22063024829630, 0.63593943961708, 0.94151583095682) and the values ($a_{up2,1,0}$, aup2,1,1 aup2,1,2 are equal to (0.06056541924291, 0.42943401549235, 0.80873048306552). Such an implementation may allow reuse of functional blocks of logic and/or code. For example, it is expressly noted that any of the interpolate-by-two operations described herein may be performed in this manner (and possibly by the same module at different times). In a particular example, interpolators IH10 and IS10 are implemented using this three-section polyphase implementation.

Alternatively or additionally, one or more (possibly all) of the interpolators IW10, IN10, IH10, and IS10 is configured to perform a interpolation by two using a polyphase implementation such that the input signal to be interpolated is filtered by two different fifteenth-order FIR filters to produce odd time-indexed and even time-indexed subsequences of the interpolated signal. In other words, the samples of the interpolated signal $S_{out}[n]$ for even sample index n≥0 are produced by filtering an input signal to be interpolated $S_{in}$ [n/2] through a first 15th-order FIR filter $H_{int2}$ (z), and the samples of the interpolated signal $S_{out}$ [n] for odd n≥0 are produced by filtering input signal samples $S_{in}[(n-1)/2]$ through a second 15th-order FIR filter $H_{int2}$ (Z). In a particular example, the coefficients of filters $H_{int1}$ (z) and $H_{int2}$ (z) are as shown in the following table:

| tap | $H_{int1}$ (z) | $H_{int2}$ (z) |
|---|---|---|
| 0 | −4.54575223e−3 | −5.72353363e−3 |
| 1 | 1.12287220e−2 | 1.35456148e−2 |
| 2 | −2.00599576e−2 | −2.29975097e−2 |
| 3 | 3.25351453e−2 | 3.51649970e−2 |
| 4 | −5.15341410e−2 | −5.18131018e−2 |
| 5 | 8.53696291e−2 | 7.77310154e−2 |
| 6 | −1.68733537e−1 | −1.28550250e−1 |
| 7 | 8.92598257e−1 | 3.04016299e−1 |
| 8 | 3.04016299e−1 | 8.92598257e−1 |
| 9 | −1.28550250e−1 | −1.68733537e−1 |
| 10 | 7.77310154e−2 | 8.53696291e−2 |
| 11 | −5.18131018e−2 | −5.15341410e−2 |
| 12 | 3.51649970e−2 | 3.25351453e−2 |
| 13 | −2.29975097e−2 | −2.00599576e−2 |
| 14 | 1.35456148e−2 | 1.12287220e−2 |
| 15 | −5.72353363e−3 | −4.54575223e−3 |

Such an implementation may allow reuse of functional blocks of logic and/or code. For example, it is expressly noted that any of the decimate-by-two operations described herein may be performed in this manner (and possibly by the same module at different times). In a particular example, interpolators IN10 and IW10 are implemented using this FIR polyphase implementation.

In highband synthesis processing path PSH12, interpolator IH10 increases the sampling rate of decoded highband signal SDH10 according to a desired interpolation factor, and spectral reversal module RHD10 reverses the spectrum of the upsampled signal (e.g., by multiplying the signal with the function $e^{jn\pi}$ or the sequence $(-1)^n$) to produce highband output signal SOH10. The two passband signals SOL10 and SOH10 are then summed to form decoded wideband signal SDW10. Filter bank FB212 may also be implemented to produce decoded wideband signal SDW10 as a weighted sum of the two passband signals SOL10 and SOH10 according to one or more weights received and/or calculated by superhighband decoder SWD100. In one such example, filter bank FB212 is configured to produce decoded wideband signal SDW10 according to the expression SDW10[n]=SOL10[n]+0.9*SOH10[n].

In superhighband synthesis processing path PSS12, interpolator IS10 increases the sampling rate of decoded superhighband signal SDS10 according to a desired interpolation factor, and spectral reversal module RSD10 reverses the spectrum of the upsampled signal (e.g., by multiplying the signal with the function $e^{jn\pi}$ or the sequence $(-1)^n$) to produce superhighband output signal SOS10. The two passband signals SOW10 and SOS10 are then summed to form superwideband output signal SOSW10. Filter bank FB212 may also be implemented to produce superwideband output signal SOSW10 as a weighted sum of the two passband signals SOW10 and SOS10 according to one or more weights received and/or calculated by superhighband decoder SWD100. In one such example, filter bank FB212 is configured to produce superwideband output signal SOSW10 according to the expression SOSW10[n]=SOW10[n]+0.9*SOS10[n]. A configuration of filter bank FB212 that combines more than three decoded passband signals is also contemplated.

Figures 7A, 7B, 7C:
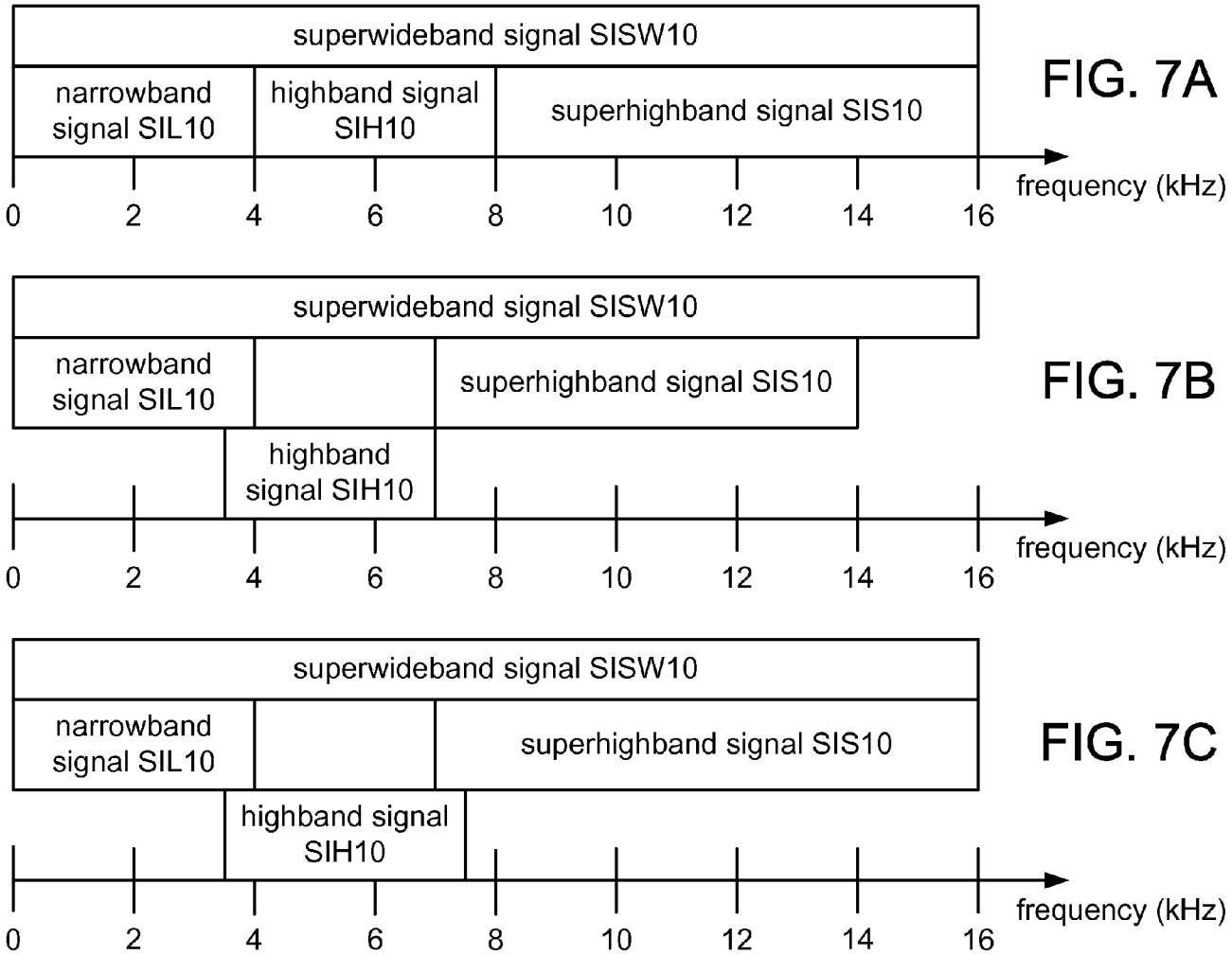
FIGS. 7A, 7B, and 7C show relative bandwidths of narrowband signal SIL10, highband signal SIH10, and superhighband signal SIS10 in three different implementational examples.

In a typical example, narrowband signal SIL10 contains the frequency content of a low-frequency subband that includes the limited PSTN range of 300-3400 Hz (e.g., the band from 0 to 4 kHz), although in other examples the low-frequency subband may be more narrow (e.g., 0, 50, or 300 Hz to 2000, 2500, or 3000 Hz). FIGS. 7A, 7B, and 7C show relative bandwidths of narrowband signal SIL10, highband signal SIH10, and superhighband signal SIS10 in three different implementational examples. In all of these particular examples, superwideband signal SISW10 has a sampling rate of 32 kHz (representing frequency components within the range of 0 to 16 kHz), and narrowband signal SIL10 has a sampling rate of 8 kHz (representing frequency components within the range of 0 to 4 kHz), and each of FIGS. 7A-7C shows an example of the portion of the frequency content of superwideband signal SISW10 that is contained in each of the signals produced by the filter bank.

The term "frequency content" is used herein to refer to the energy that is present at a specified frequency of a signal, or to the distribution of energy across a specified frequency band of the signal. Narrowband signal SIL10 contains the frequency content of the low-frequency subband, highband signal SIH10 contains the frequency content of the mid-frequency subband, wideband signal SIW10 contains the frequency content of the low-frequency subband and the frequency content of the mid-frequency subband, and superhighband signal SIS10 contains the frequency content of the high-frequency subband. The width of a subband is defined as the distance between the minus twenty decibel points in the frequency response of the filter bank path that selects the frequency content of that subband. Similarly, the overlap of two subbands may be defined as the distance from the point at which the frequency response of the filter bank path that selects the frequency content of the higher-frequency subband drops to minus twenty decibels up to the point at which the frequency response of the filter bank path that selects the frequency content of the lower-frequency subband drops to minus twenty decibels.

In the example of FIG. 7A, there is no significant overlap among the three subbands. A highband signal SIH10 as shown in this example may be obtained using an implementation of highband analysis processing path PAH10 that has a passband of 4-8 kHz. In such a case, it may be desirable for processing path PAH10 to reduce the sampling rate to 8 kHz by decimating the signal by a factor of two. Such an operation, which may be expected to significantly reduce the computational complexity of further processing operations on the signal, moves the frequency content of the 4-8-kHz mid-frequency subband down to the range of 0 to 4 kHz without loss of information.

Similarly, a superhighband signal SIS10 as shown in this example may be obtained using an implementation of superhighband analysis processing path PAS10 that has a passband of 8-16 kHz. In such a case, it may be desirable for processing path PAS10 to reduce the sampling rate to 16 kHz by decimating the signal by a factor of two. Such an operation, which may be expected to significantly reduce the computational complexity of further processing operations on the signal, moves the frequency content of the 8-16-kHz high-frequency subband down to the range of 0 to 8 kHz without loss of information.

In the alternative example of FIG. 7B, the low-frequency and mid-frequency subbands have an appreciable overlap, such that the region of 3.5 to 4 kHz is described by both of narrowband signal SIL10 and highband signal SIH10. A highband signal SIH10 as in this example may be obtained using an implementation of highband analysis processing path PAH10 that has a passband of 3.5-7 kHz. In such a case, it may be desirable for processing path PAH10 to reduce the sampling rate to 7 kHz by decimating the signal by a factor of 16/7. Such an operation, which may be expected to significantly reduce the computational complexity of further processing operations on the signal, moves the frequency content of the 3.5-7-kHz mid-frequency subband down to the range of 0 to 3.5 kHz without loss of information. Other particular examples of highband analysis processing path PAH10 have passbands of 3.5-7.5 kHz and 3.5-8 kHz.

FIG. 7B also shows an example in which the high-frequency subband extends from 7 to 14 kHz. A superhighband signal SIS10 as in this example may be obtained using an implementation of superhighband analysis processing path PAS10 that has a passband of 7-14 kHz. In such a case, it may be desirable for processing path PAS10 to reduce the sampling rate from 32 to 7 kHz by decimating the signal by a factor of 32/7. Such an operation, which may be expected to significantly reduce the computational complexity of further processing operations on the signal, moves the frequency content of the 7-14-kHz high-frequency subband down to the range of 0 to 7 kHz without loss of information.

FIG. 8C shows a block diagram of an implementation FB120 of filter bank FB112 that may be used for an application as shown in FIG. 7B. Filter bank FB120 is configured to receive a superwideband signal SISW10 that has a sampling rate of $f_S$ (e.g., 32 kHz). Filter bank FB120 includes an implementation DW20 of decimator DW10 that is configured to decimate signal SISW10 by a factor of two to obtain a wideband signal SIW10 that has a sampling rate of $f_{SW}$ (e.g., 16 kHz), and an implementation DN20 of decimator DN10 that is configured to decimate signal SIW10 by a factor of two to obtain a narrowband signal SIL10 that has a sampling rate of $f_{SN}$ (e.g., 8 kHz). Filter bank FB120 also includes an implementation PAH20 of highband analysis processing path PAH12 that is configured to decimate wideband signal SIW10 by a non-integer factor $f_{SH}/f_{SW}$, where $f_{SH}$ is the sampling rate of highband signal SIH10 (e.g., 7 kHz). Path PAH20 includes an interpolation block IAH10 configured to interpolate signal SIW10 by a factor of two to a sampling rate of $f_{SW}\times 2$ (e.g., to 32 kHz), a resampling block configured to resample the interpolated signal to a sampling rate of $f_{SH}\times 4$ (e.g., by a factor of 7/8, to 28 kHz), and a decimation block DH30 configured to decimate the resampled signal by a factor of two to a sampling rate of $f_{SH}\times 2$ (e.g., to 14 kHz). Decimation block DH30 may be implemented according to any of the examples of such an operation as described herein (e.g., the three-section polyphase example described herein). Path PAH20 also includes a spectral reversal block and a decimate-by-two implementation DH20 of decimator DH10, which may be implemented as described above with reference to module RHA10 and decimator DH10, respectively, of path PAH12.

In this particular example, path PAH20 also includes an optional spectral shaping block FAH10, which may be implemented as a lowpass filter configured to shape the signal to obtain a desired overall filter response. In a particular example, spectral shaping block FAH10 is implemented as a first-order IIR filter having the transfer function $$H_{shaping}(z) = 0.95\frac{1+z^{-1}}{1-0.9z^{-1}}.$$

The interpolation block IAH10 of path PAH20 may be implemented according to any of the examples of such an operation as described herein (e.g., the three-section polyphase example described herein). One such example of an interpolator is configured to perform an interpolation by two using a two-section polyphase implementation such that the samples of the interpolated signal $S_{out}[n]$ for even $n\geq 0$ are obtained by filtering an input signal subsequence $S_{in}[n/2]$ through an allpass filter whose transfer function is given by $$H_{up2,0} = \left(\frac{a_{up2,0,0}+z^{-1}}{1+a_{up2,0,0}z^{-1}}\right)\left(\frac{a_{up2,0,1}+z^{-1}}{1+a_{up2,0,1}z^{-1}}\right),$$

and the samples of the interpolated signal $S_{out}[n]$ for odd $n\geq 0$ are obtained by filtering the input signal subsequence $S_{in}[(n-1)/2]$ through an allpass filter whose transfer function is given by $$H_{up2,1} = \left(\frac{a_{up2,1,0}+z^{-1}}{1+a_{up2,1,0}z^{-1}}\right)\left(\frac{a_{up2,1,1}+z^{-1}}{1+a_{up2,1,1}z^{-1}}\right).$$

In a particular example, the values ($a_{up2,0,0}$, $a_{up2,0,1}$, $a_{up2,1,0}$, $a_{up2,1,1}$) are equal to (0.06262441299567, 0.49326511845632, 0.23754715248027, 0.80890715711734).

The resample-by-7/8 block of path PAH20 may be implemented to use a polyphase interpolation to resample an input signal $s_{in}$ having a sampling rate of 32 kHz to produce an output signal $s_{out}$ having a sampling rate of 28 kHz. Such an interpolation may be implemented, for example, according to an expression such as $$s_{out}(7n+j) = \sum_{k=0}^{9} h_{32to28}(j,k)s_{in}(8n+j) \text{ for}$$

$$n = 0, 1, 2, \ldots, (320/8)-1 \text{ and } j = 0, 1, 2, \ldots, 6,$$

where $h_{32to28}$ is a 7×10 matrix. Values for the left half of matrix $h_{32to28}$ are shown in the following table:

| | | | | |
|---|---|---|---|---|
| 3.41912907e−4 | −2.69503234e−3 | 1.19769577e−2 | −4.56908882e−2 | 9.77711819e−1 |
| 1.23211218e−3 | −8.62410562e−3 | 3.47366625e−2 | −1.17506954e−1 | 9.01024049e−1 |
| 1.81777835e−3 | −1.23518612e−2 | 4.80598154e−2 | −1.52764025e−1 | 7.75797477e−1 |
| 2.02437256e−3 | −1.34769676e−2 | 5.10793217e−2 | −1.54547032e−1 | 6.14941672e−1 |
| 1.84337614e−3 | −1.20398838e−2 | 4.45406397e−2 | −1.29059613e−1 | 4.34194878e−1 |
| 1.32890510e−3 | −8.47829304e−3 | 3.05201954e−2 | −8.47225835e−2 | 2.50516846e−1 |
| 5.86167535e−4 | −3.53544829e−3 | 1.20198888e−2 | −3.11043229e−2 | 8.03984401e−2 |

This half-matrix is flipped horizontally and vertically to obtain the values for the right half of matrix $h_{32to28}$ (i.e., the element at row r and column c has the same value as the element at row (8-r) and column (11-c)).

Filter bank FB120 also includes an implementation PAS20 of superhighband analysis processing path PAS12 that is configured to decimate superwideband signal SISW10 by a non-integer factor $f_S/f_{SS}$, where $f_{SS}$ is the sampling rate of superhighband signal SIS10 (e.g., 14 kHz). Path PAS20 includes an interpolation block IAS10 configured to interpolate signal SISW10 by a factor of two to a sampling rate of $f_S \times 2$ (e.g., to 64 kHz), a resampling block configured to resample the interpolated signal to a sampling rate of $f_{SS} \times 4$ (e.g., by a factor of 7/8, to 56 kHz), and a decimation block DS30 configured to decimate the resampled signal by a factor of two to a sampling rate of $f_{SS} \times 2$ (e.g., to 28 kHz). Interpolation block IAS10 may be implemented according to any of the examples of such an operation as described herein (e.g., the two-section polyphase example described herein). Decimation block DS30 may be implemented according to any of the examples of such an operation as described herein (e.g., the three-section polyphase example described herein). Path PAS20 also includes a spectral reversal block and a decimate-by-two implementation DS20 of decimator DS10, which may be implemented as described above with reference to module RSA10 and decimator DS10, respectively, of path PAS12.

Figure 9:
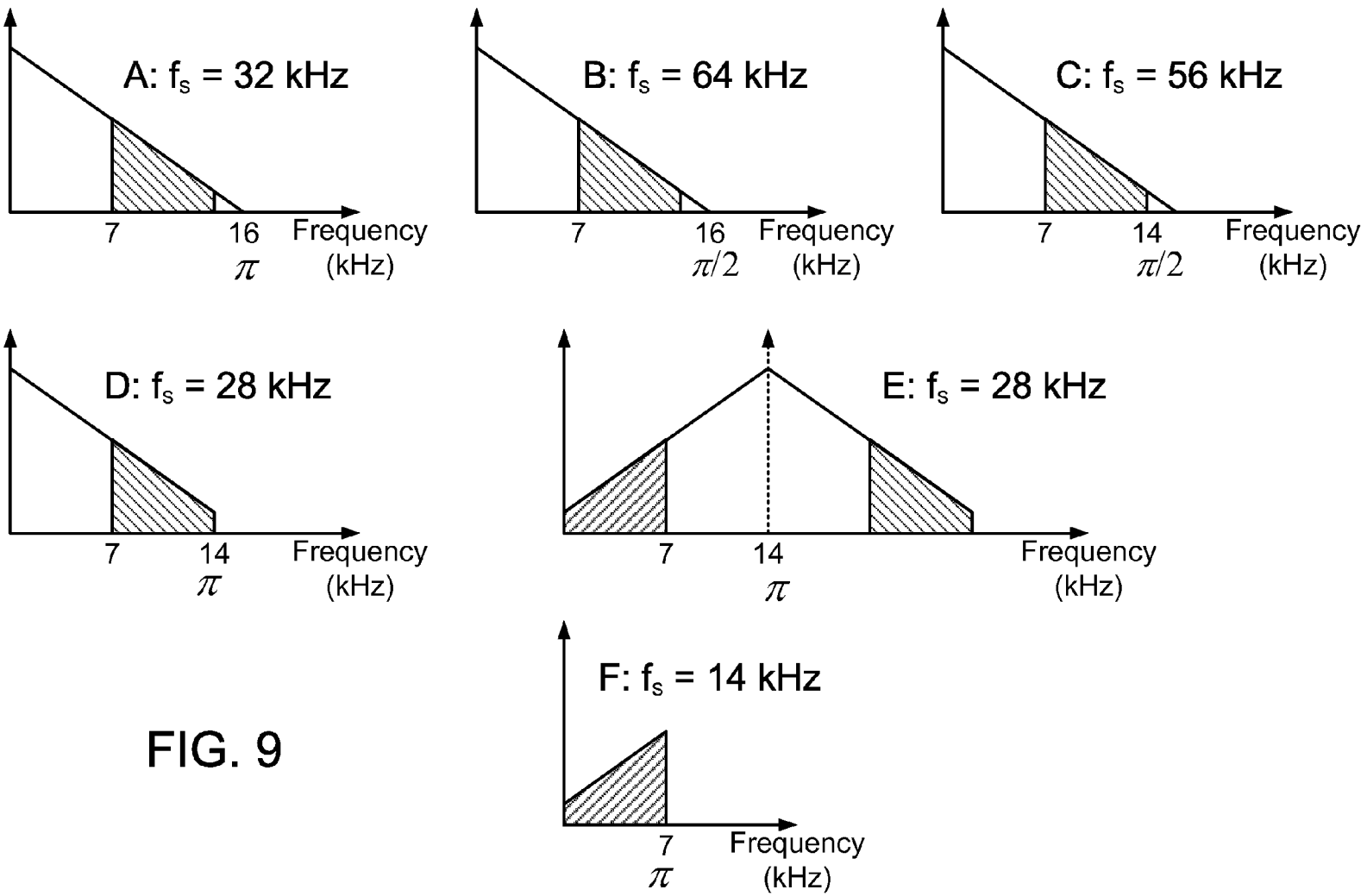
FIGS. 9A-F show step-by-step examples of the spectrum of the signal being processed in an application of path PAS20.

It may be desirable to apply superhighband analysis processing path PAS20 to extract a superhighband signal SIS10, having a sampling rate of 14 kHz and the frequency content of a 7-14-kHz high-frequency subband, from an input superwideband signal SISW10 that has a sampling rate of 32 kHz. FIGS. 9A-F show step-by-step examples of the spectrum of the signal being processed, at each of the corresponding points labeled A-F in FIG. 8C, in such an application of path PAS20. In FIGS. 9A-F, the shaded region indicates the frequency content of the 7-14-kHz high-frequency subband and the vertical axis indicates magnitude. FIG. 9A shows a representative spectrum of the 32-kHz superwideband signal SISW10. FIG. 9B shows the spectrum after upsampling signal SISW10 to a sampling rate of 64 kHz. FIG. 9C shows the spectrum after resampling the upsampled signal by a factor of 7/8 to a sampling rate of 56 kHz. FIG. 9D shows the spectrum after decimating the resampled signal to a sampling rate of 28 kHz. FIG. 9E shows the spectrum after reversing the spectrum of the decimated signal. FIG. 9F shows the spectrum after decimating the spectrally reversed signal to produce a superhighband signal SIS10 having a sampling rate of 14 kHz.

The interpolation block IAS10 and decimation block DS30 of path PAS20 may be implemented according to any of the examples of such operations as described herein (e.g., the multi-section polyphase examples described herein). The resample-by-7/8 block of path PAS20 may be implemented to use a polyphase implementation to resample an input signal $s_{in}$ having a sampling rate of 64 kHz to produce an output signal $s_{out}$ having a sampling rate of 56 kHz. Such a resampling may be implemented, for example, according to an expression such as $$s_{out}(7n+j) = \sum_{k=0}^{9} h_{64to56}(j,k)s_{in}(8n+j) \text{ for}$$

$$n = 0, 1, 2, \ldots, (640/8) - 1 \text{ and } j = 0, 1, 2, \ldots, 6,$$

where $h_{64to56}$ is a 7×10 matrix. Values for the left half of a particular implementation of matrix $h_{64to56}$ are shown in the following table:

| | | | | |
|---|---|---|---|---|
| 1.558697e−2 | −4.797365e−2 | 1.008248e−1 | −1.765467e−1 | 1.129741 |
| 7.848700e−3 | −3.597768e−2 | 9.765124e−2 | −2.200534e−1 | 1.029719 |
| 3.876050e−4 | −1.788927e−2 | 7.155779e−2 | −2.013905e−1 | 8.462753e−1 |
| −4.873989e−3 | 3.745309e−4 | 3.355743e−2 | −1.398403e−1 | 6.092098e−1 |
| −7.154279e−3 | 1.415676e−2 | −4.655999e−3 | −5.917076e−2 | 3.554986e−1 |
| −6.747768e−3 | 2.101616e−2 | −3.368756e−2 | 1.788288e−2 | 1.220295e−1 |
| −4.654879e−3 | 2.089194e−2 | −4.831460e−2 | 7.417446e−2 | −6.128632e−2 |

This half-matrix is flipped horizontally and vertically to obtain the values for the right half of this particular implementation of matrix $h_{64to56}$ (i.e., the element at row r and column c has the same value as the element at row (8-r) and column (11-c)).

FIG. 7C shows a further example in which the mid-frequency subband extends from 3.5 to 7.5 kHz, such that the region of 3.5 to 4 kHz is described by both of narrowband signal SIL10 and highband signal SIH10 and the region of 7 to 7.5 kHz is described by both of highband signal SIH10 and superhighband signal SIS10.

In some implementations, providing an overlap between subbands as in the examples of FIGS. 7B and 7C allows for the use of processing paths having a smooth rolloff over the overlapped region. Such filters are typically easier to design, less computationally complex, and/or introduce less delay than filters with sharper or "brick-wall" responses. Filters having sharp transition regions tend to have higher sidelobes (which may cause aliasing) than filters of similar order that have smooth rolloffs. Filters having sharp transition regions may also have long impulse responses which may cause ringing artifacts. For filter bank implementations having one or more IIR filters, allowing for a smooth rolloff over the overlapped region may enable the use of a filter or filters whose poles are further away from the unit circle, which may be important to ensure a stable fixed-point implementation.

Overlapping of subbands allows a smooth blending of subbands that may lead to fewer audible artifacts, reduced aliasing, and/or a less noticeable transition from one subband to the other. One or more such features may be especially desirable for an implementation in which two or more among narrowband encoder EN100, highband encoder EH100, and superhighband encoder ES100 operate according to different coding methodologies. For example, different coding techniques may produce signals that sound quite different. A coder that encodes a spectral envelope in the form of codebook indices may produce a signal having a different sound than a coder that encodes the amplitude spectrum instead. A time-domain coder (e.g., a pulse-code-modulation or PCM coder) may produce a signal having a different sound than a frequency-domain coder. A coder that encodes a signal with a representation of the spectral envelope and the corresponding residual signal may produce a signal having a different sound than a coder that encodes a signal with only a representation of the spectral envelope (e.g., a transform-based coder). A coder that encodes a signal as a representation of its waveform may produce an output having a different sound than that from a sinusoidal coder. In such cases, using filters having sharp transition regions to define nonoverlapping subbands may lead to an abrupt and perceptually noticeable transition between the subbands in the synthesized superwideband signal.

Moreover, the coding efficiency of an encoder (for example, a waveform coder) may drop with increasing frequency. Coding quality may be reduced at low bit rates, especially in the presence of background noise. In such cases, providing an overlap of the subbands may increase the quality of reproduced frequency components in the overlapped region.

We define the overlap of two subbands (e.g., the overlap of a low-frequency subband and a mid-frequency subband, or the overlap of a mid-frequency subband and a high-frequency subband) as the distance from the point at which the frequency response of the path that produces the higher-frequency subband drops to −20 dB up to the point at which the frequency response of the path that produces the lower-frequency subband drops to −20 dB. In various examples of filter bank FB100 and/or FB200, such an overlap ranges from around 200 Hz to around 1 kHz. The range of about 400 to about 600 Hz may represent a desirable tradeoff between coding efficiency and perceptual smoothness. In the particular examples shown in FIGS. 7B and 7C, each overlap is around 500 Hz.

It is noted that as a consequence of the spectral reversal operations in processing paths PAH12 and PAS12, the spectra of the frequency contents in highband signal SIH10 and in superhighband signal SIS10 are reversed. Subsequent operations in the encoder and corresponding decoder may be configured accordingly. For example, highband excitation generator GXH100 as described herein may be configured to produce a highband excitation signal SXH10 that also has a spectrally reversed form.

FIG. 10 shows a block diagram of an implementation FB220 of filter bank FB212 that may be used for an application as shown in FIG. 7B. Filter bank FB220 includes an implementation PSN20 of narrowband synthesis processing path PSN10 that is configured to receive a narrowband signal SDL10 having a sampling rate of $f_{SN}$ (e.g., 8 kHz) and to perform an interpolation by two to produce a narrowband output signal SOL10 having a sampling rate of $f_{SW}$ (e.g., 16 kHz). In this example, path PSN20 includes an implementation IN20 of interpolator IN10 (e.g., an FIR polyphase implementation as described herein) and an optional shaping filter FSL10 (e.g., a first-order pole-zero filter). In a particular example, shaping filter FSL10 is implemented as a second-order IIR filter having the transfer function $$H_{shaping}(z) = 0.477\frac{1 + 1.9z^{-1} + z^{-2}}{1 - 0.6z^{-1} - 0.26z^{-2}}.$$

Filter bank FB220 also includes an implementation PSH20 of highband synthesis processing path PSH12 that is configured to interpolate a highband signal SDH10 having a sampling rate of $f_{SH}$ (e.g., 7 kHz) by a non-integer factor $f_{SW}/f_{SH}$. Path PSH20 includes an implementation IH20 of interpolator IH10 that is configured to interpolate signal SDH10 by a factor of two to a sampling rate of $f_{SH}\times 2$ (e.g., to 14 kHz), a spectral reversal block which may be implemented as described above with reference to module RHS10 of path PSH12, an interpolation block IH30 configured to interpolate the spectrally reversed signal by a factor of two to a sampling rate of $f_{SH}\times 4$ (e.g., to 28 kHz), and a resampling block configured to resample the interpolated signal to a sampling rate of $f_{SW}$ (e.g., by a factor of 4/7). In this particular example, path PSH20 also includes an optional spectral shaping filter FSW10, which may be implemented as a lowpass filter configured to shape the signal to obtain a desired overall filter response and/or as a notch filter configured to attenuate a component of the signal at 7100 Hz. In a particular example, shaping filter FSW10 is implemented as a notch filter having the transfer function $$H_{shaping}(z) = \left(\frac{0.9 + 1.68548204358251z^{-1} + 0.9z^{-2}}{1 - 1.84755462947281z^{-1} - 0.97110052295510z^{-2}}\right)\times \left(\frac{1 + 1.89908877043819z^{-1} + z^{-2}}{1 - 1.74219434405041z^{-1} - 0.85804273005855z^{-2}}\right)$$

or the transfer function $$H_{shaping}(z) = \left(\frac{0.92482579255755 + 1.75415354377535z^{-1} + 0.92482579255755z^{-2}}{1 - 1.74835555397183z^{-1} - 0.85544957491863z^{-2}}\right).$$

Interpolation block IH30 of path PSH20 may be implemented according to any of the examples of such an operation as described herein (e.g., the three-section polyphase example described herein). The resample-by-4/7 block of path PSH20 may be implemented to use a polyphase implementation to resample an input signal $s_{in}$ having a sampling rate of 28 kHz to produce an output signal $s_{out}$ having a sampling rate of 16 kHz. Such a resampling may be implemented, for example, according to an expression such as $$s_{out}(4n + j) = \sum_{k=0}^{9} h_{28to16}(j, k)s_{in}(7n + j) \text{ for } n = 0, 1, 2, \ldots, \text{ and } j = 0, 1, 2, 3,$$

where $h_{28to16}$ is a 4×10 matrix. Values for the left half of a particular implementation of matrix $h_{28to16}$ are shown in the following table:

| | | | | |
|---|---|---|---|---|
| 1.20318669e−3 | −7.63051281e−3 | 2.72917685e−2 | −7.50806010e−2 | 2.17114817e−1 |
| 1.99103625e−3 | −1.31460240e−2 | 4.92989146e−2 | −1.46294949e−1 | 5.37321710e−1 |
| 1.67326973e−3 | −1.14565524e−2 | 4.49962065e−2 | −1.45555950e−1 | 8.19434767e−1 |
| 2.78957903e−4 | −2.26822102e−3 | 1.02912159e−2 | −3.99823584e−2 | 9.80668152e−1 |

Values for the right half of this particular implementation of matrix $h_{28to16}$ are shown in the following table:

| | | | | |
|---|---|---|---|---|
| 9.19427451e−1 | −1.06860103e−1 | 3.11334638e−2 | −7.66063210e−3 | 1.08509157e−3 |
| 6.88738481e−1 | −1.57550510e−1 | 5.10128599e−2 | −1.33122905e−2 | 1.98270018e−3 |
| 3.76310623e−1 | −1.16791891e−1 | 4.08360252e−2 | −1.11251931e−2 | 1.71435282e−3 |
| 7.05611352e−2 | −2.76674071e−2 | 1.07928329e−2 | −3.20123678e−3 | 5.35218462e−4 |

Filter bank FB220 also includes an implementation PSW20 of wideband synthesis processing path PSW12 that is configured to receive a wideband signal SDW10 having a sampling rate of $f_{SW}$ (e.g., 16 kHz) and to perform an interpolation by two to produce a wideband output signal SOW10 having a sampling rate of $f_s$ (e.g., 32 kHz). In this example, path PSW20 includes an implementation IW20 of interpolator IW10 (e.g., an FIR polyphase implementation as described herein) and an optional shaping filter (e.g., a second-order pole-zero filter).

Filter bank FB220 also includes an implementation PSS20 of superhighband synthesis processing path PSS12 that is configured to interpolate a superhighband signal SDS10 having a sampling rate of $f_{SS}$ (e.g., 14 kHz) by a non-integer factor $f_S/f_{SS}$, where $f_S$ is the sampling rate of superwideband signal SOSW10 (e.g., 32 kHz). Filter bank FB220 includes an implementation IS20 of interpolator IS10 that is configured to interpolate signal SDS10 by a factor of two to a sampling rate of $f_{SS}\times 2$ (e.g., to 28 kHz), a spectral reversal block which may be implemented as described above with reference to module RHD10 of path PSS12, an interpolation block IS30 configured to interpolate the spectrally reversed signal by a factor of two to a sampling rate of $f_{SS}\times 4$ (e.g., to 56 kHz), a resampling block configured to resample the interpolated signal to a sampling rate of $f_S\times 2$ (e.g., by a factor of 8/7), and a decimation block DSS10 that is configured to decimate the resampled signal by a factor of two to a sampling rate of $f_s$ (e.g., to 32 kHz). In this particular example, path PSS20 also includes an optional spectral shaping block, which may be implemented as a filter configured to shape the signal to obtain a desired overall filter response (e.g., a $30^{th}$ order FIR filter).

Figure 11:
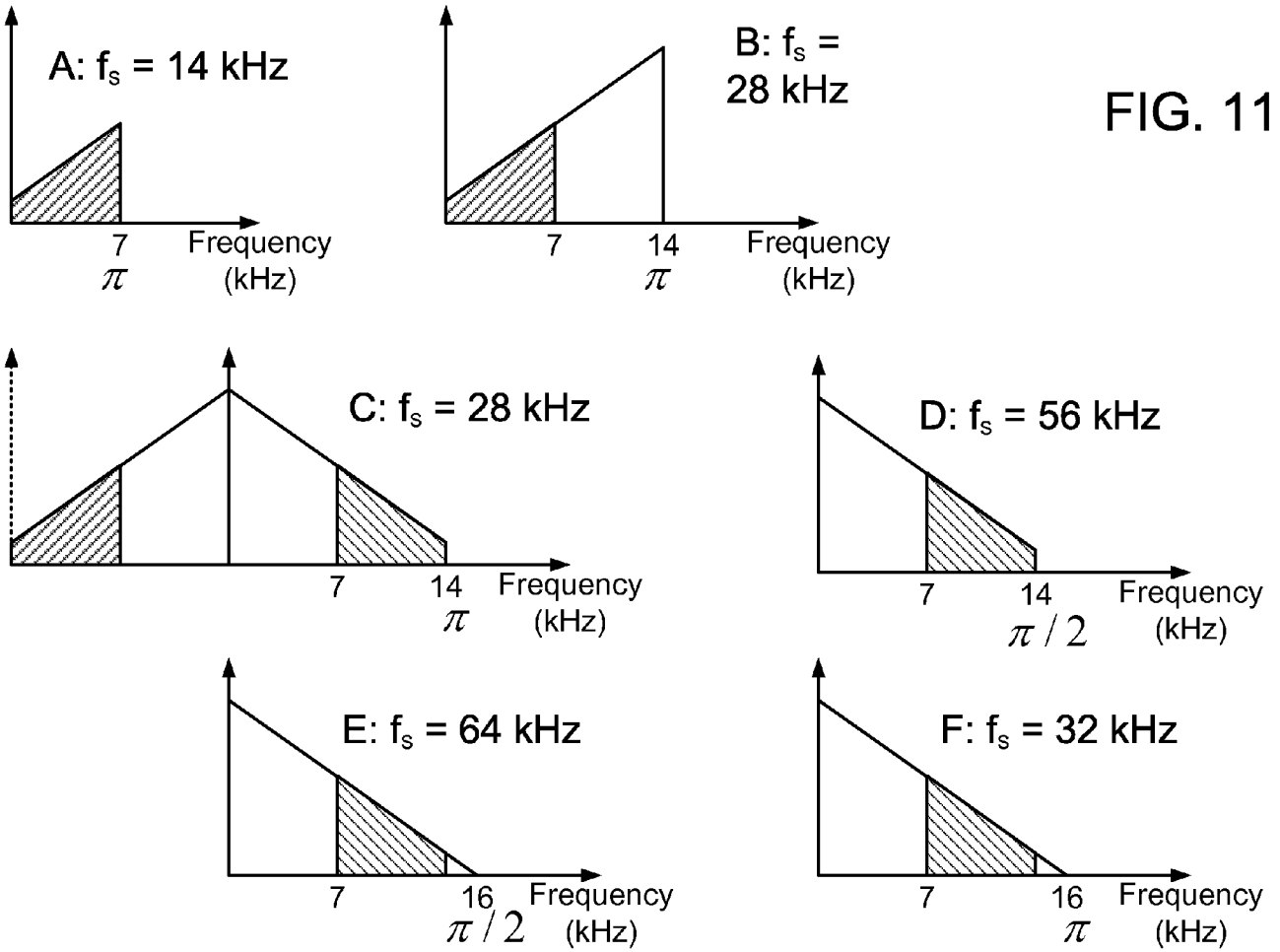
FIGS. 11A-F show step-by-step examples of the spectrum of the signal being processed in an application of path PSS20.

It may be desirable to apply superhighband synthesis processing path PSS20 to produce a superhighband signal SOS10, having a sampling rate of 32 kHz and the frequency content of a 7-14-kHz high-frequency subband, from an input decoded superhighband signal SDS10 that has a sampling rate of 14 kHz. FIGS. 11A-F show step-by-step examples of the spectrum of the signal being processed, at each of the corresponding points labeled A-F in FIG. 10, in such an application of path PSS20. In FIGS. 11A-F, the shaded region indicates the frequency content of the 7-14-kHz high-frequency subband and the vertical axis indicates magnitude. FIG. 11A shows a representative spectrum of the 14-kHz superhighband signal SDS10, which contains the spectrally reversed frequency content of the 7-14-kHz high-frequency subband. FIG. 11B shows the spectrum after interpolating signal SDS10 to a sampling rate of 28 kHz. FIG. 11C shows the spectrum after reversing the spectrum of the interpolated signal. FIG. 11D shows the spectrum after interpolating the spectrally reversed signal to a sampling rate of 56 kHz. FIG. 11E shows the spectrum after resampling the interpolated signal by a factor of 8/7 to a sampling rate of 64 kHz. FIG. 11F shows the spectrum after decimating the resampled signal to produce a superhighband signal SOS10 having a sampling rate of 32 kHz.

Decimation block DSS10 of path PSS20 may be implemented according to any of the examples of such an operation as described herein (e.g., the three-section polyphase example described herein). Interpolators IH20, IH30, IS20, and IS30 of paths PSH20 and PSS20 may be implemented according to any of the examples of such an operation as described herein. In a particular example, each of interpolators IH20, IH30, IS20, and IS30 is implemented according to the three-section polyphase example described herein.

The resample-by-8/7 block of path PSS20 may be implemented to use a polyphase interpolation to resample an input signal $s_{in}$ having a sampling rate of 56 kHz to produce an output signal $s_{out}$ having a sampling rate of 64 kHz. In one example, this resampling is performed using a polyphase interpolation according to $$s_{64}(8n+j)=\sum_{k=0}^{4} h_{56to64}(j,k)s_{56}(7n+j) \text{ for}$$

$$n=0,1,2,\ldots,(640/8)-1 \text{ and } j=0,1,2,\ldots,6,$$

where $h_{56to64}$ is a 8×5 matrix. Values for a particular implementation of matrix $h_{56to64}$ are shown in the following table:

| | | | | |
|---|---|---|---|---|
| 8.822681e−3 | 4.042414e−1 | 6.891184e−1 | −6.491004e−2 | −1.584783e−2 |
| −1.584783e−2 | −6.491004e−2 | 6.891184e−1 | 4.042414e−1 | 8.822681e−3 |
| 1.844283e−3 | −1.448563e−1 | 9.572939e−1 | 1.446467e−1 | 6.037494e−2 |
| 2.842895e−2 | −2.077111e−1 | 1.165900 | −5.667803e−2 | 8.317225e−2 |
| 5.757226e−2 | −2.274063e−1 | 1.279996 | −1.813245e−1 | 7.944362e−2 |

-continued

| | | | | |
|---|---|---|---|---|
| 7.944362e−2 | −1.813245e−1 | 1.279996 | −2.274063e−1 | 5.757226e−2 |
| 8.317225e−2 | −5.667803e−2 | 1.165900 | −2.077111e−1 | 2.842895e−2 |
| 6.037494e−2 | 1.446467e−1 | 9.572939e−1 | −1.448563e−1 | 1.844283e−3 |

Figure 12A:
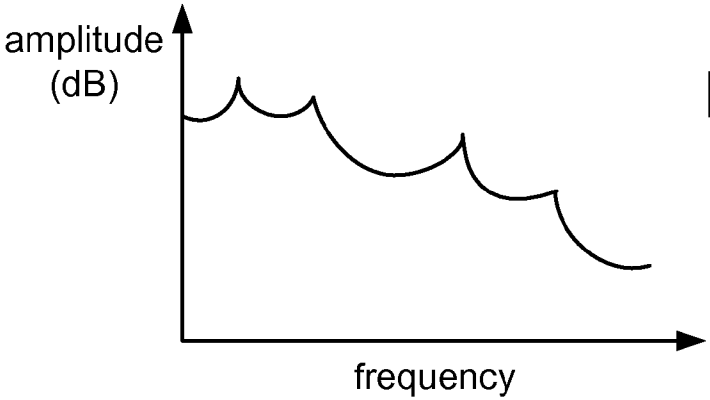
FIG. 12A shows an example of a plot of log amplitude vs. frequency for a speech signal.

Narrowband encoder EN100 is implemented according to a source-filter model that encodes the input speech signal as (A) a set of parameters that describe a filter and (B) an excitation signal that drives the described filter to produce a synthesized reproduction of the input speech signal. FIG. 12A shows an example of a spectral envelope of a speech signal. The peaks that characterize this spectral envelope represent resonances of the vocal tract and are called formants. Most speech coders encode at least this coarse spectral structure as a set of parameters such as filter coefficients.

Figure 12B:
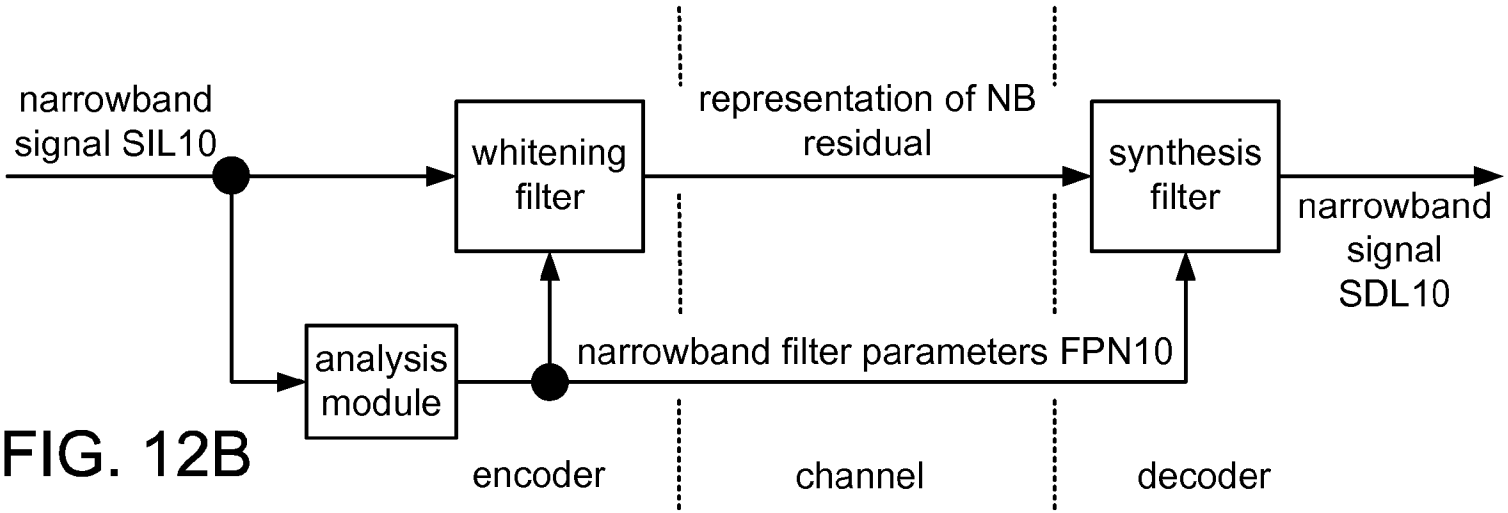
FIG. 12B shows a block diagram of a basic linear prediction coding system.

FIG. 12B shows an example of a basic source-filter arrangement as applied to coding of the spectral envelope of narrowband signal SIL10. An analysis module calculates a set of parameters that characterize a filter corresponding to the speech sound over a period of time (typically ten or twenty milliseconds). A whitening filter (also called an analysis or prediction error filter) configured according to those filter parameters removes the spectral envelope to spectrally flatten the signal. The resulting whitened signal (also called a residual) has less energy and thus less variance and is easier to encode than the original speech signal. Errors resulting from coding of the residual signal may also be spread more evenly over the spectrum. The filter parameters and residual are typically quantized for efficient transmission over the channel. At the decoder, a synthesis filter configured according to the filter parameters is excited by a signal based on the residual to produce a synthesized version of the original speech sound. The synthesis filter is typically configured to have a transfer function that is the inverse of the transfer function of the whitening filter.

Figure 13:
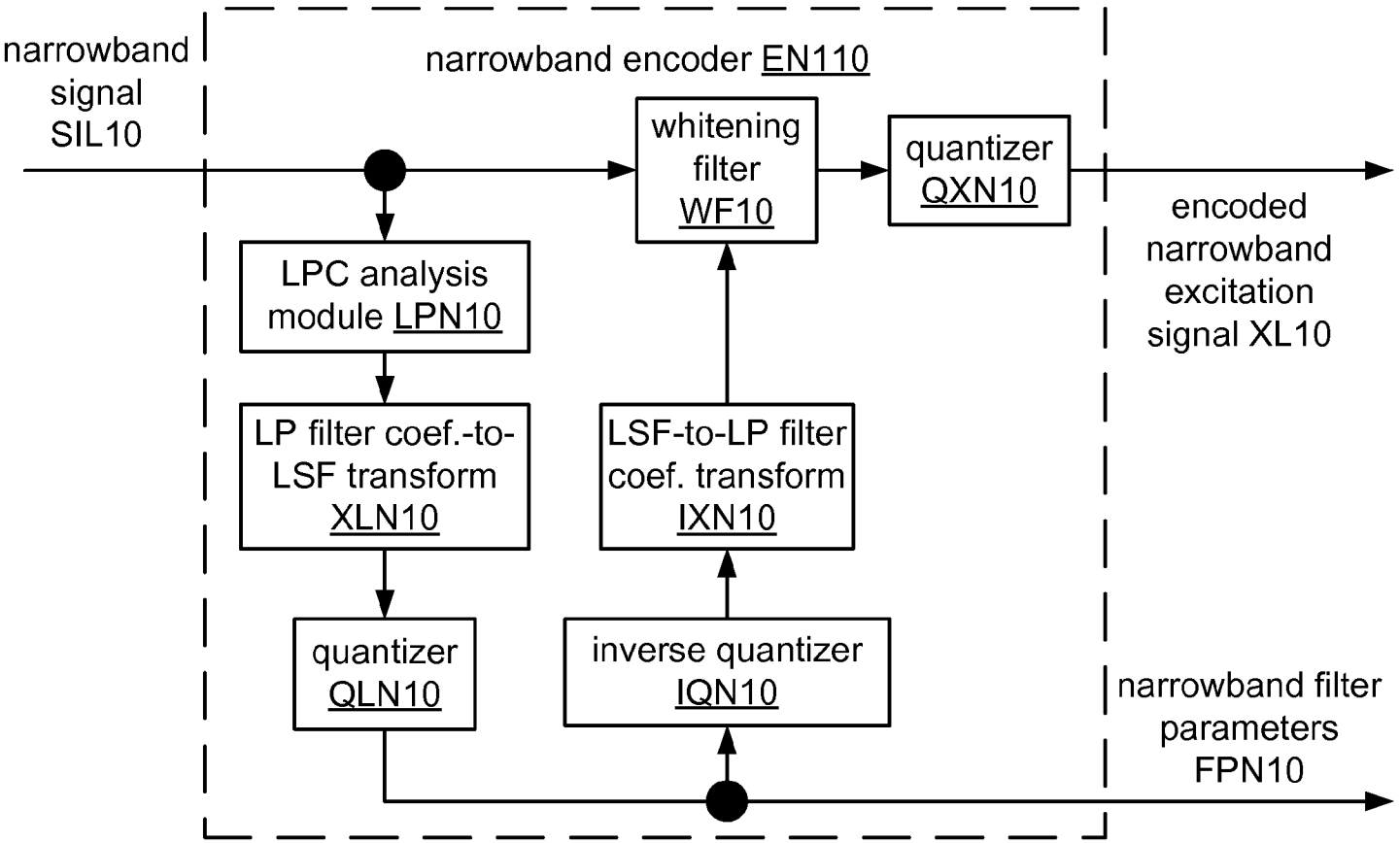
FIG. 13 shows a block diagram of an implementation EN110 of narrowband encoder EN100.

FIG. 13 shows a block diagram of a basic implementation EN110 of narrowband encoder EN100. In this example, a linear prediction coding (LPC) analysis module LPN10 encodes the spectral envelope of narrowband signal SIL10 as a set of linear prediction (LP) coefficients (e.g., coefficients of an all-pole filter 1/A(z)). The analysis module typically processes the input signal as a series of nonoverlapping frames, with a new set of coefficients being calculated for each frame. The frame period is generally a period over which the signal may be expected to be locally stationary; one common example is twenty milliseconds (equivalent to 160 samples at a sampling rate of 8 kHz). In one example, LPC analysis module LPN10 is configured to calculate a set of ten LP filter coefficients to characterize the formant structure of each twenty-millisecond frame. It is also possible to implement the analysis module to process the input signal as a series of overlapping frames.

The analysis module may be configured to analyze the samples of each frame directly, or the samples may be weighted first according to a windowing function (for example, a Hamming window). The analysis for the frame may also be performed over a window that is larger than the frame, such as a 30-msec window. This window may be symmetric (e.g. 5-20-5, such that it includes the five milliseconds immediately before and after the twenty-millisecond frame) or asymmetric (e.g. 10-20, such that it includes the last ten milliseconds of the preceding frame). An LPC analysis module is typically configured to calculate the LP filter coefficients using a Levinson-Durbin recursion or the Leroux-Gueguen algorithm. In another implementation, the analysis module may be configured to calculate a set of cepstral coefficients for each frame instead of a set of LP filter coefficients.

The output rate of encoder EN110 may be reduced significantly, with relatively little effect on reproduction quality, by quantizing the filter parameters. Linear prediction filter coefficients are difficult to quantize efficiently and are usually mapped into another representation, such as line spectral pairs (LSPs) or line spectral frequencies (LSFs), for quantization and/or entropy encoding. In the example of FIG. 13, LP filter coefficient-to-LSF transform XLN10 transforms the set of LP filter coefficients into a corresponding set of LSFs. Other one-to-one representations of LP filter coefficients include parcor coefficients; log-area-ratio values; immittance spectral pairs (ISPs); and immittance spectral frequencies (ISFs), which are used in the GSM (Global System for Mobile Communications) AMR-WB (Adaptive Multirate-Wideband) codec. Typically a transform between a set of LP filter coefficients and a corresponding set of LSFs is reversible, but embodiments also include implementations of encoder EN110 in which the transform is not reversible without error.

Quantizer QLN10 is configured to quantize the set of narrowband LSFs (or other coefficient representation), and narrowband encoder EN110 is configured to output the result of this quantization as the narrowband filter parameters FPN10. Such a quantizer typically includes a vector quantizer that encodes the input vector as an index to a corresponding vector entry in a table or codebook.

Figure 14:
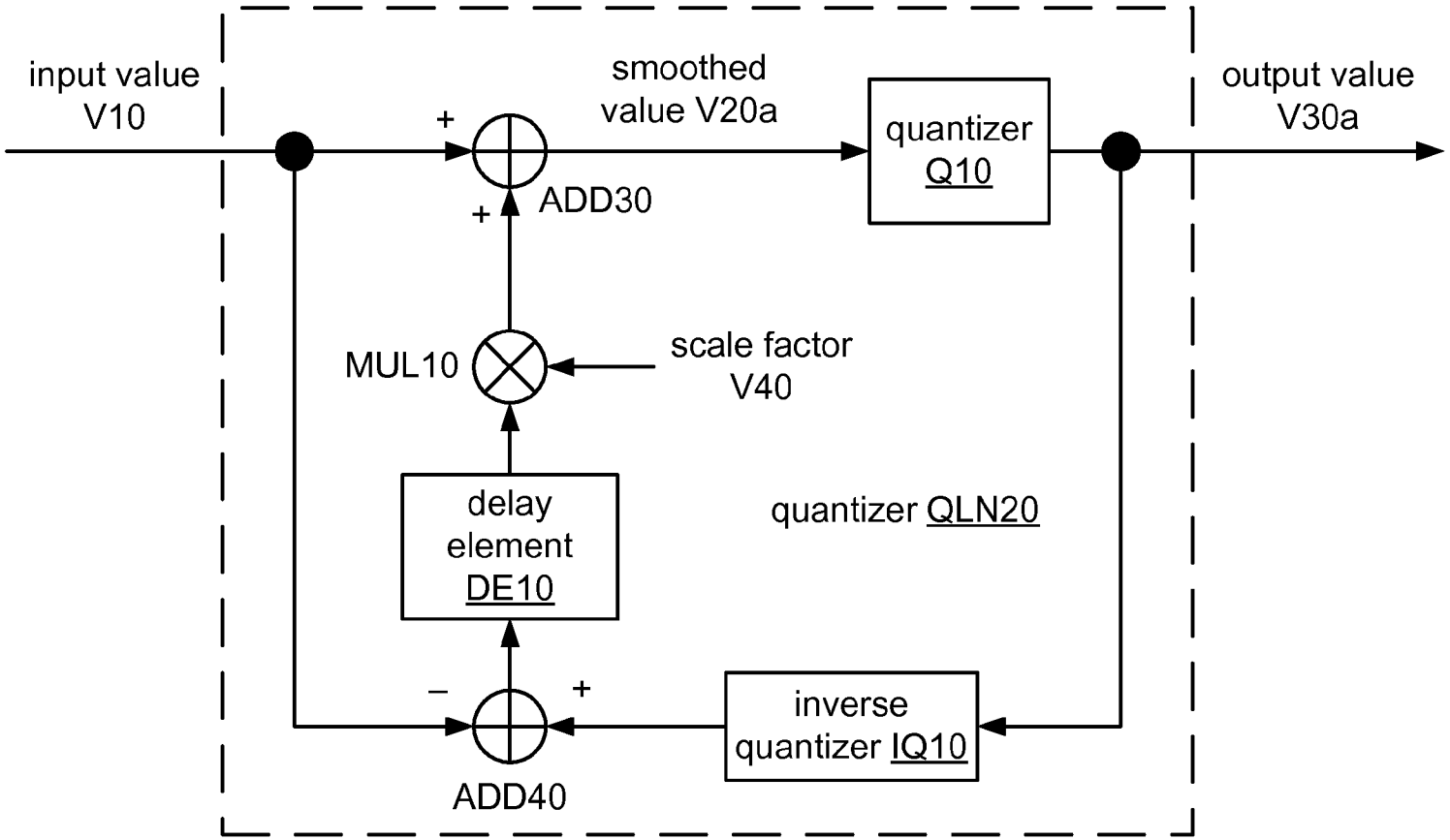
FIG. 14 shows a block diagram of an implementation QLN20 of quantizer QLN10.

It may be desirable for quantizer QLN10 to incorporate temporal noise shaping. FIG. 14 shows a block diagram of such an implementation QLN20 of quantizer QLN10. For each frame, the LSF quantization error vector is computed and multiplied by a scale factor V40 whose value is less than unity. In the following frame, this scaled quantization error is added to the LSF vector before quantization. The value of scale factor V40 may be adjusted dynamically depending on the amount of fluctuations already present in the unquantized LSF vectors. For example, when the difference between the current and previous LSF vectors is large, the value of scale factor V40 is close to zero, such that almost no noise shaping is performed. When the current LSF vector differs little from the previous one, the value of scale factor V40 is close to unity. The resulting LSF quantization may be expected to minimize spectral distortion when the speech signal is changing, and to minimize spectral fluctuations when the speech signal is relatively constant from one frame to the next.

Figure 15:
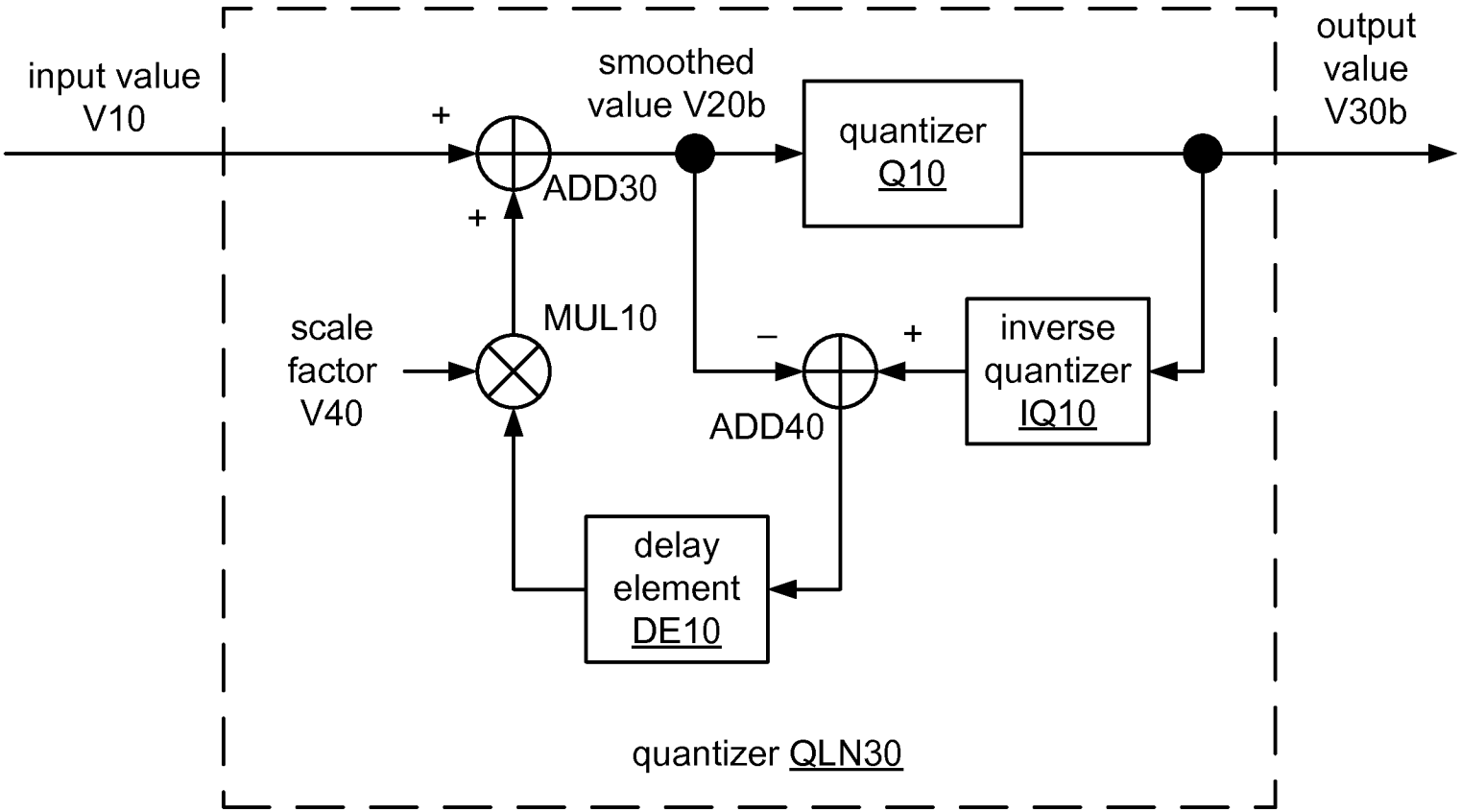
FIG. 15 shows a block diagram of an implementation QLN30 of quantizer QLN10.

FIG. 15 shows a block diagram of another noise-shaping implementation QLN30 of quantizer QLN10. Additional description of temporal noise shaping in vector quantization may be found in US Publ. Pat. Appl. No. 2006/0271356 (Vos et al.), published Nov. 30, 2006.

As shown in FIG. 13, narrowband encoder EN110 may be configured to generate a residual signal by passing narrowband signal SIL10 through a whitening filter WF10 (also called an analysis or prediction error filter) that is configured according to the set of filter coefficients. In this particular example, whitening filter WF10 is implemented as a FIR filter, although IIR implementations may also be used. This residual signal will typically contain perceptually important information of the speech frame, such as long-term structure relating to pitch, that is not represented in narrowband filter parameters FPN10. Quantizer QXN10 is configured to calculate a quantized representation of this residual signal for output as encoded narrowband excitation signal XL10. Such a quantizer typically includes a vector quantizer that encodes the input vector as an index to a corresponding vector entry in a table or codebook. Alternatively, such a quantizer may be configured to send one or more parameters from which the vector may be generated dynamically at the decoder, rather than retrieved from storage, as in a sparse codebook method. Such a method is used in coding schemes such as algebraic CELP (codebook excitation linear prediction) and codecs such as 3GPP2 (Third Generation Partnership 2) EVRC (Enhanced Variable Rate Codec).

It may be desirable for narrowband encoder EN110 to generate the encoded narrowband excitation signal according to the same filter parameter values that will be available to the corresponding narrowband decoder. In this manner, the resulting encoded narrowband excitation signal may already account to some extent for nonidealities in those parameter values, such as quantization error. Accordingly, it may be desirable to configure the whitening filter using the same coefficient values that will be available at the decoder. In the basic example of encoder EN110 as shown in FIG. 13, inverse quantizer IQN10 dequantizes narrowband coding parameters FPN10, LSF-to-LP filter coefficient transform IXN10 maps the resulting values back to a corresponding set of LP filter coefficients, and this set of coefficients is used to configure whitening filter WF10 to generate the residual signal that is quantized by quantizer QXN10.

Some implementations of narrowband encoder EN100 are configured to calculate encoded narrowband excitation signal XL10 by identifying one among a set of codebook vectors that best matches the residual signal. It is noted, however, that narrowband encoder EN100 may also be implemented to calculate a quantized representation of the residual signal without actually generating the residual signal. For example, narrowband encoder EN100 may be configured to use a number of codebook vectors to generate corresponding synthesized signals (e.g., according to a current set of filter parameters), and to select the codebook vector associated with the generated signal that best matches the original narrowband signal SIL10 in a perceptually weighted domain.

Figure 16:
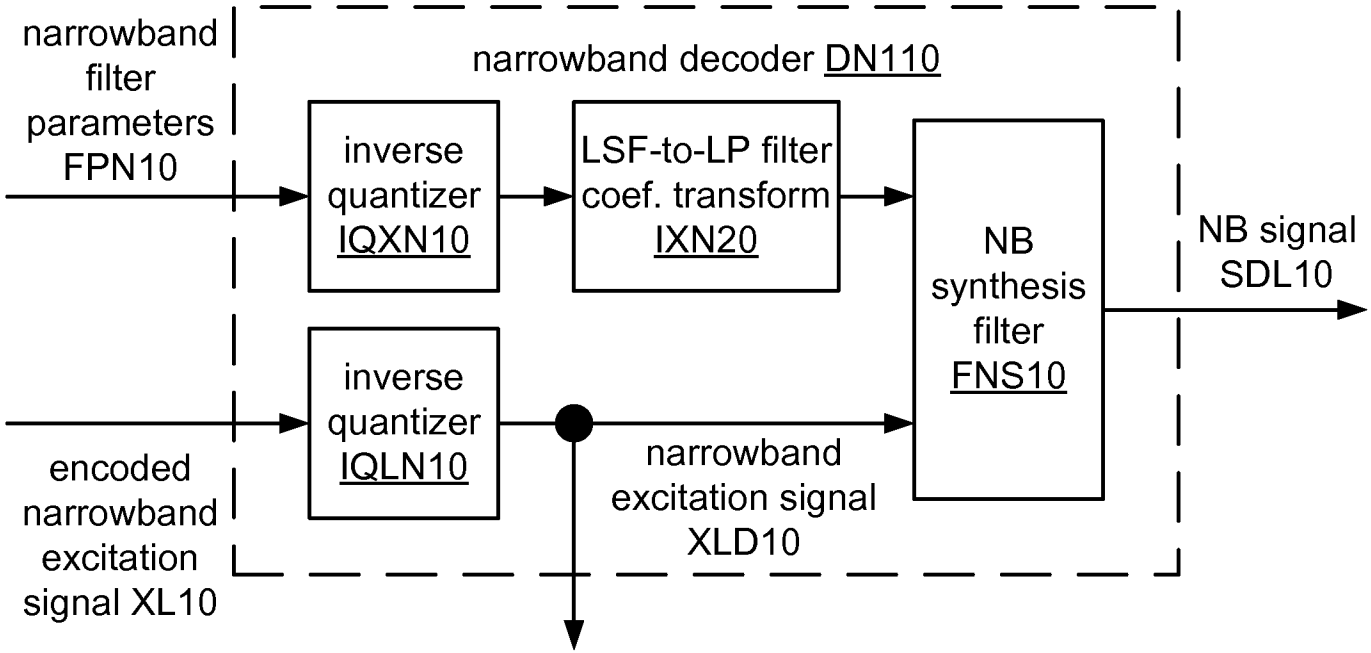
FIG. 16 shows a block diagram of an implementation DN110 of narrowband decoder DN100.

FIG. 16 shows a block diagram of an implementation DN110 of narrowband decoder DN100. Inverse quantizer IQXN10 dequantizes narrowband filter parameters FPN10 (in this case, to a set of LSFs), and LSF-to-LP filter coefficient transform IXN20 transforms the LSFs into a set of filter coefficients (for example, as described above with reference to inverse quantizer IQN10 and transform IXN10 of narrowband encoder EN110). Inverse quantizer IQLN10 dequantizes encoded narrowband excitation signal XL10 to produce a decoded narrowband excitation signal XLD10. Based on the filter coefficients and narrowband excitation signal XLD10, narrowband synthesis filter FNS10 synthesizes narrowband signal SDL10. In other words, narrowband synthesis filter FNS10 is configured to spectrally shape narrowband excitation signal XLD10 according to the dequantized filter coefficients to produce narrowband signal SDL10. Narrowband decoder DN110 also provides narrowband excitation signal XL10*a* to highband encoder DH100, which uses it to derive the highband excitation signal XHD10 as described herein, and narrowband excitation signal XL10*b* to SHB encoder DS100, which uses it to derive the SHB excitation signal XSD10 as described herein. In some implementations as described below, narrowband decoder DN110 may be configured to provide additional information that relates to the narrowband signal, such as spectral tilt, pitch gain and lag, and/or speech mode, to highband decoder DH100 and/or to SHB decoder DS100.

The system of narrowband encoder EN110 and narrowband decoder DN110 is a basic example of an analysis-by-synthesis speech codec. Codebook excitation linear prediction (CELP) coding is one popular family of analysis-by-synthesis coding, and implementations of such coders may perform waveform encoding of the residual, including such operations as selection of entries from fixed and adaptive codebooks, error minimization operations, and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse CELP (MPE), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10), which uses residual excited linear prediction (RELP); the GSM enhanced full rate codec (ETSI-GSM 06.60); the ITU (International Telecommunication Union) standard 11.8 kb/s G.729 Annex E coder; the IS (Interim Standard)-641 codecs for IS-136 (a time-division multiple access scheme); the GSM adaptive multirate (GSM-AMR) codecs; and the 4GV™ (Fourth-Generation Vocoder™) codec (QUALCOMM Incorporated, San Diego, Calif.). Narrowband encoder EN110 and corresponding decoder DN110 may be implemented according to any of these technologies, or any other speech coding technology (whether known or to be developed) that represents a speech signal as (A) a set of parameters that describe a filter and (B) an excitation signal used to drive the described filter to reproduce the speech signal.

Figure 17B:
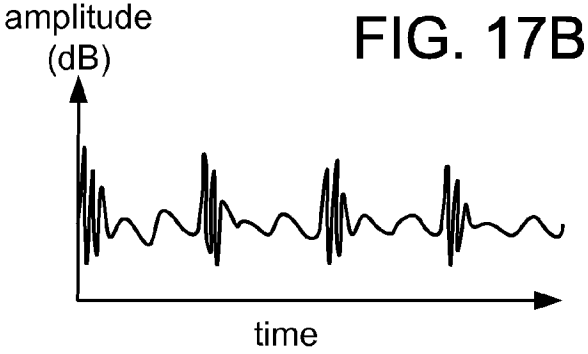
FIG. 17B shows an example of a plot of log amplitude vs. time for a residual signal for voiced speech.
Figure 17A:
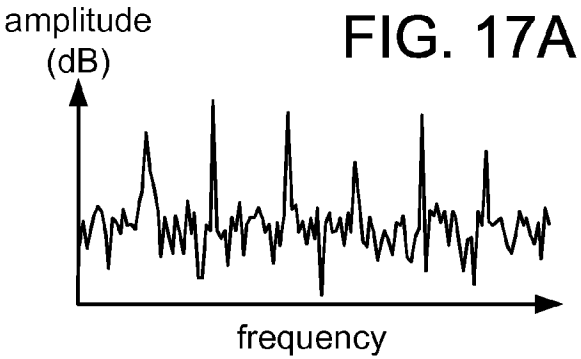
FIG. 17A shows an example of a plot of log amplitude vs. frequency for a residual signal for voiced speech.

Even after the whitening filter has removed the coarse spectral envelope from narrowband signal SIL10, a considerable amount of fine harmonic structure may remain, especially for voiced speech. FIG. 17A shows a spectral plot of one example of a residual signal, as may be produced by a whitening filter, for a voiced signal such as a vowel. The periodic structure visible in this example is related to pitch, and different voiced sounds spoken by the same speaker may have different formant structures but similar pitch structures. FIG. 17B shows a time-domain plot of an example of such a residual signal that shows a sequence of pitch pulses in time.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 Hz. This characteristic is typically encoded as the inverse of the fundamental frequency, also called the pitch lag. The pitch lag indicates the number of samples in one pitch period and may be encoded as an offset to a minimum or maximum pitch lag value and/or as one or more codebook indices. Speech signals from male speakers tend to have larger pitch lags than speech signals from female speakers.

Another signal characteristic relating to the pitch structure is periodicity, which indicates the strength of the harmonic structure or, in other words, the degree to which the signal is harmonic or nonharmonic. Two typical indicators of periodicity are zero crossings and normalized autocorrelation functions (NACFs). Periodicity may also be indicated by the pitch gain, which is commonly encoded as a codebook gain (e.g., a quantized adaptive codebook gain).

Figure 17C:
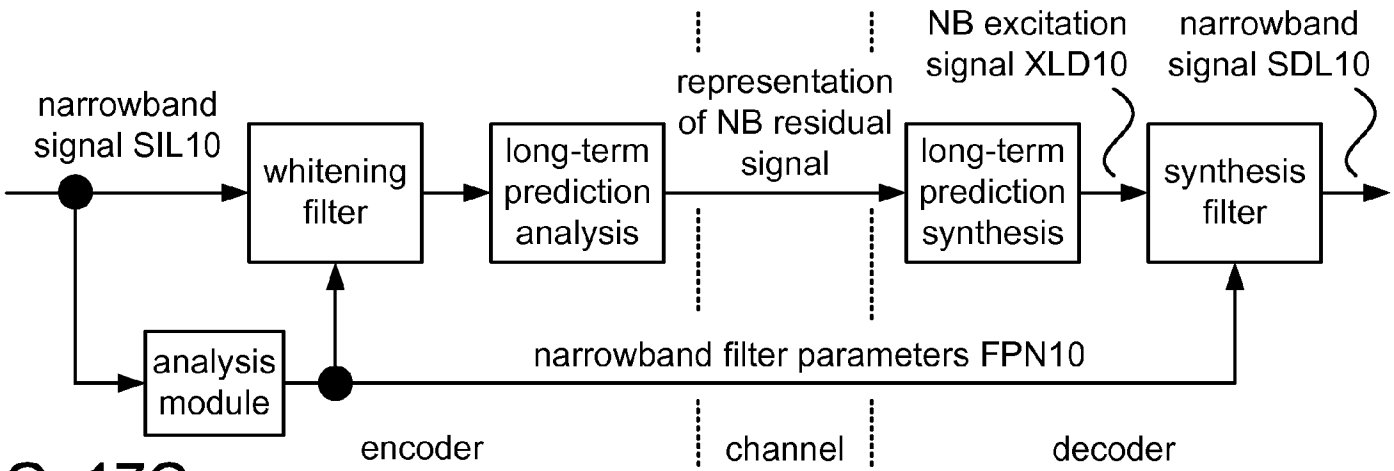
FIG. 17C shows a block diagram of a basic linear prediction coding system that also performs long-term prediction.

Narrowband encoder EN100 may include one or more modules configured to encode the long-term harmonic structure of narrowband signal SIL10. As shown in FIG. 17C, one typical CELP paradigm that may be used includes an open-loop LPC analysis module, which encodes the short-term characteristics or coarse spectral envelope, followed by a closed-loop long-term prediction analysis stage, which encodes the fine pitch or harmonic structure. The short-term characteristics are encoded as filter coefficients, and the long-term characteristics are encoded as values for parameters such as pitch lag and pitch gain.

An LPC residual as encoded by a CELP coding technique typically includes a fixed codebook portion and an adaptive codebook portion. For example, narrowband encoder EN100 may be configured to output encoded narrowband excitation signal XL10 in a form that includes one or more fixed codebook indices and corresponding gain values and one or more adaptive codebook gain values. Calculation of this quantized representation of the narrowband residual signal (e.g., by quantizer QXN10) may include selecting such indices and calculating such gain values.

The structure remaining after long-term-prediction analysis of the residual may be encoded as one or more indices into a fixed codebook and one or more corresponding fixed codebook gains. Quantization of a fixed codebook may be performed using a pulse coding technique, such as factorial or combinatorial pulse coding. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured. Alternatively, a modified discrete cosine transform (MDCT) technique or other transform-based technique may be used to encode the LPC residual, especially for generalized audio or non-speech applications (e.g., music).

An implementation of narrowband decoder DN110 according to a paradigm as shown in FIG. 17C may be configured to output narrowband excitation signal XL10*a* to highband decoder DH100, and/or to output narrowband excitation signal XL10*b* to SHB decoder DS100, after the long-term structure (pitch or harmonic structure) has been restored. For example, such a decoder may be configured to output narrowband excitation signal XL10*a* and/or XL10*b* as a dequantized version of encoded narrowband excitation signal XL10. Of course, it is also possible to implement narrowband decoder DN100 such that highband decoder DH100 performs dequantization of encoded narrowband excitation signal XL10 to obtain narrowband excitation signal XL10*a* and/or such that SHB decoder DS100 performs dequantization of encoded narrowband excitation signal XL10 to obtain narrowband excitation signal XL10*b*.

In an implementation of superwideband speech encoder SWE100 according to a paradigm as shown in FIG. 17, highband encoder EH100 and/or SHB encoder ES100 may be configured to receive the narrowband excitation signal as produced by the short-term analysis or whitening filter. In other words, narrowband encoder EN100 may be configured to output the narrowband excitation signal XL10*a* to highband encoder EH100, and/or to output the narrowband excitation signal XL10*b* to SHB encoder ES100, before encoding the long-term structure. It may be desirable, however, for highband encoder EH100 to receive from the narrowband channel the same coding information that will be received by highband decoder DH100, such that the coding parameters produced by highband encoder EH100 may already account to some extent for nonidealities in that information. Thus it may be preferable for highband encoder EH100 to reconstruct highband excitation signal XH10 from the same parameterized and/or quantized encoded narrowband excitation signal XL10 to be output by SWB encoder SWE100. For example, narrowband encoder EN100 may be configured to output narrowband excitation signal XL10*a* as a dequantized version of encoded narrowband excitation signal XL10. One potential advantage of this approach is more accurate calculation of the highband gain factors CPH10*b* described below.

Likewise, it may be desirable for SHB encoder ES100 to receive from the narrowband channel the same coding information that will be received by SHB decoder DS100, such that the coding parameters produced by SHB encoder ES100 may already account to some extent for nonidealities in that information. Thus it may be preferable for SHB encoder ES100 to reconstruct SHB excitation signal XS10 from the same parameterized and/or quantized encoded narrowband excitation signal XL10 to be output by SWB encoder SWE100. For example, narrowband encoder EN100 may be configured to output narrowband excitation signal XL10*b* as a dequantized version of encoded narrowband excitation signal XL10. One potential advantage of this approach is more accurate calculation of the SHB gain factors CPS10*b* described below In addition to parameters that characterize the short-term and/or long-term structure of narrowband signal SIL10, narrowband encoder EN100 may produce parameter values that relate to other characteristics of narrowband signal SIL10. These values, which may be suitably quantized for output by SWB speech encoder SWE100, may be included among the narrowband filter parameters FPN10 or outputted separately. Highband encoder EH100 may also be configured to calculate highband coding parameters CPH10 according to one or more of these additional parameters (e.g., after dequantization). At SWB decoder SWD100, highband decoder DH100 may be configured to receive the parameter values via narrowband decoder DN100 (e.g., after dequantization). Alternatively, highband decoder DH100 may be configured to receive (and possibly to dequantize) the parameter values directly. Likewise, SHB encoder ES100 may be configured to calculate SHB coding parameters CPS10 according to one or more of these additional parameters (e.g., after dequantization). At SWB decoder SWD100, SHB decoder DS100 may be configured to receive the parameter values via narrowband decoder DN100 (e.g., after dequantization). Alternatively, SHB decoder DS100 may be configured to receive (and possibly to dequantize) the parameter values directly In one example of additional narrowband coding parameters, narrowband encoder EN100 produces values for spectral tilt and speech mode parameters for each frame. Spectral tilt relates to the shape of the spectral envelope over the passband and is typically represented by the quantized first reflection coefficient. For most voiced sounds, the spectral energy decreases with increasing frequency, such that the first reflection coefficient is negative and may approach −1. Most unvoiced sounds have a spectrum that is either flat, such that the first reflection coefficient is close to zero, or has more energy at high frequencies, such that the first reflection coefficient is positive and may approach +1.

Speech mode (also called voicing mode) indicates whether the current frame represents voiced or unvoiced speech. This parameter may have a binary value based on one or more measures of periodicity (e.g., zero crossings, NACFs, pitch gain) and/or voice activity for the frame, such as a relation between such a measure and a threshold value. In other implementations, the speech mode parameter has one or more other states to indicate modes such as silence or background noise, or a transition between silence and voiced speech.

To determine the order of the LPC analysis for SHB signal SIS10 is not a trivial task. In general, because SHB signal SIS10 has a large bandwidth (e.g., 7 kHz), a relatively high order of LPC coefficients may be desirable in order to support reconstruction of SWB signal SISW10 with a satisfactory perceptual result. One example of such an implementation uses a traditional linear prediction coding (LPC) analysis to obtain eight spectral parameters to describe the spectral envelope of SHB signal SIS10, and a similar analysis to obtain six spectral parameters to describe the spectral envelope of highband signal SIH10. For efficient coding, these prediction coefficients are converted to line spectral frequencies (LSFs) and then quantized using a vector quantizer as described herein (e.g., using a temporal noise-shaping vector quantizer).

Figure 18:
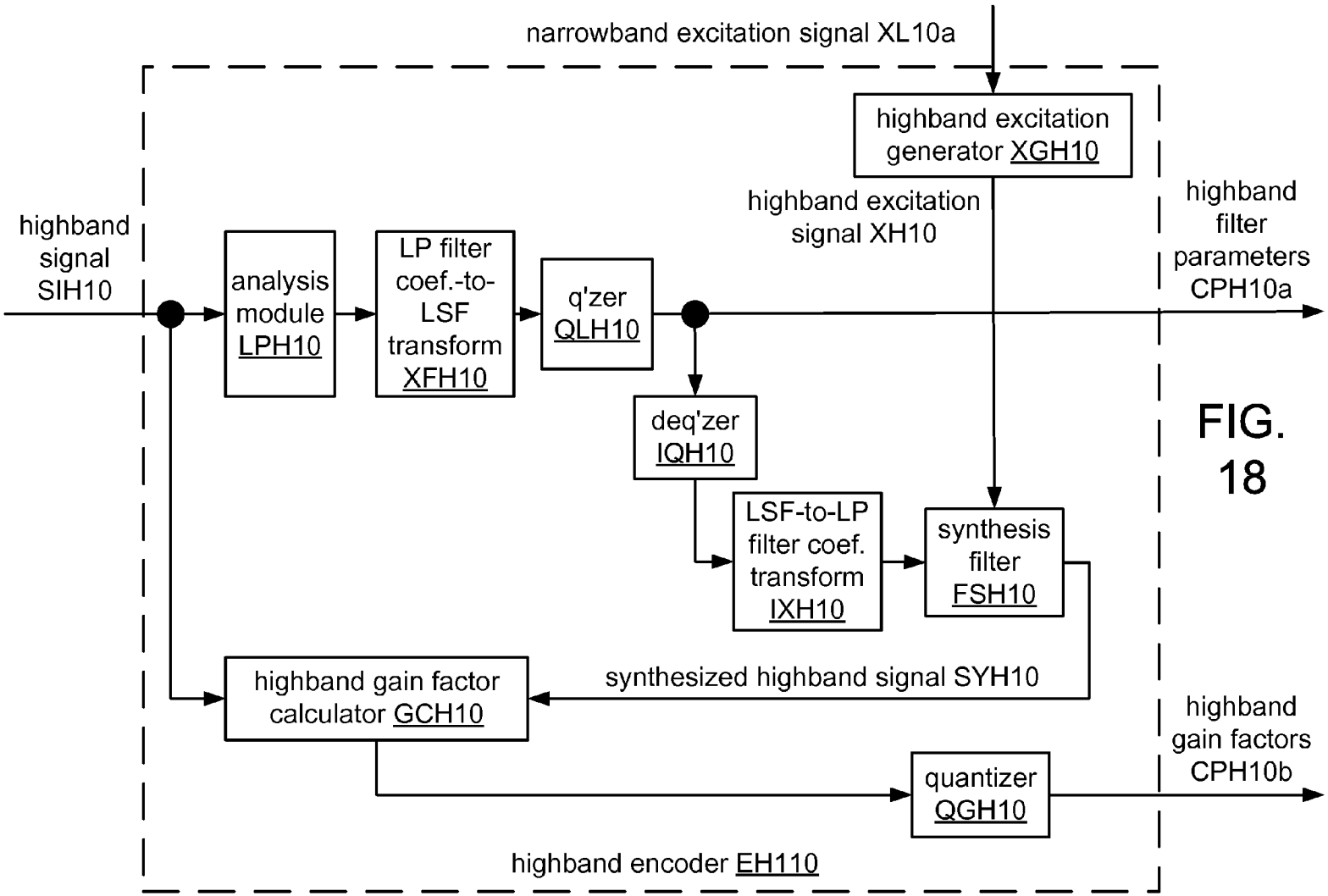
FIG. 18 shows a block diagram of an implementation EH110 of highband encoder EH100.
Figure 19:
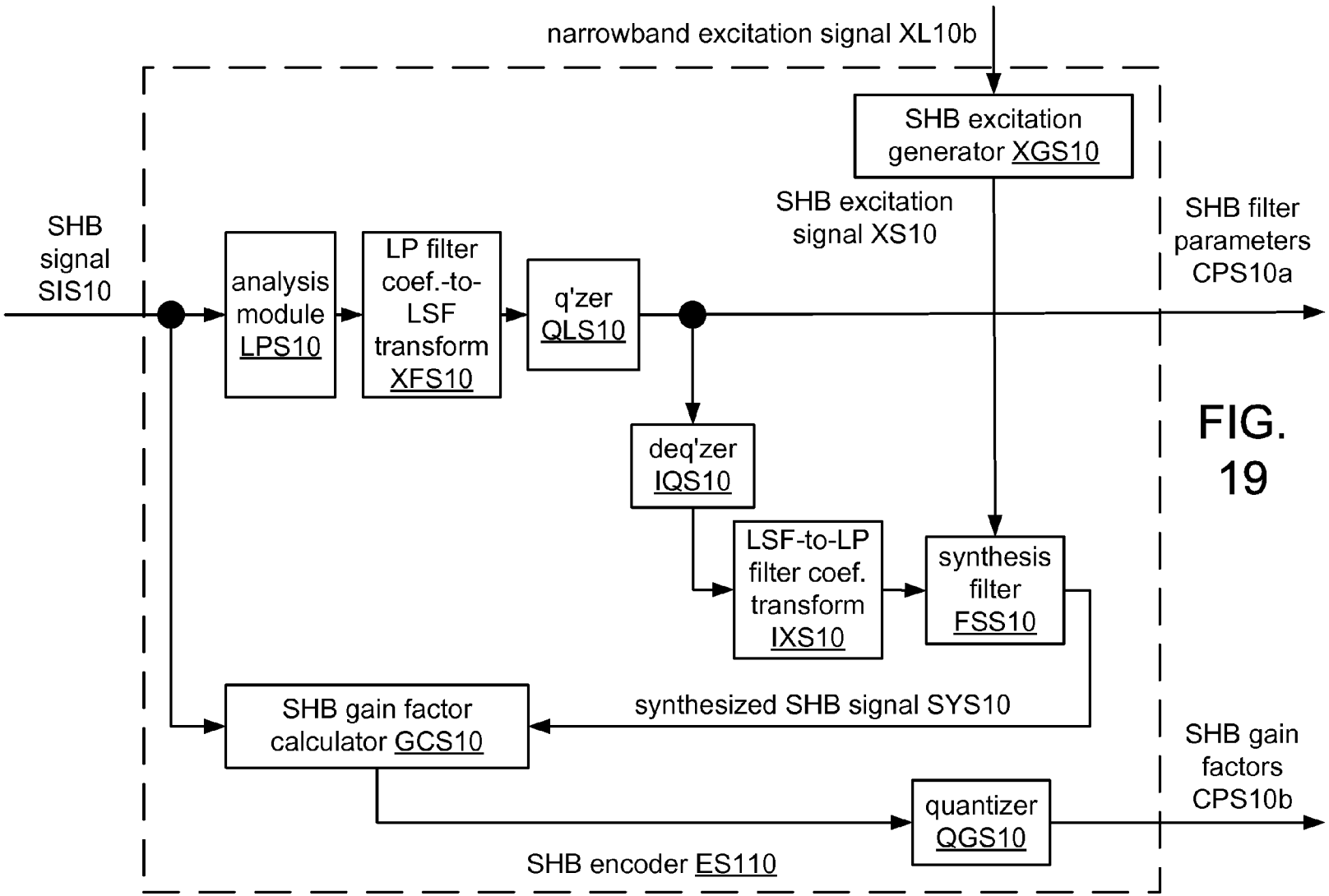
FIG. 19 shows a block diagram of an implementation ES110 of superhighband encoder ES100.

FIG. 18 shows a block diagram of an implementation EH110 of highband encoder EH100, and FIG. 19 shows a block diagram of an implementation ES110 of SHB encoder ES100. Highband encoder EH100 and SHB encoder ES100 may be configured to have LPC analysis paths that are similar to the LPC analysis path in narrowband encoder EN110. For example, narrowband encoder EN110 includes the LPC analysis path (including quantization and dequantization) LPN10-XLN10-QLN10-IQN10-IXN10, while highband encoder EH110 includes the analogous path LPH10-XFH10-QLH10-IQH10-IXH10 and SHB encoder EH110 includes the analogous path LPS10-XFS10-QLS10-IQS10-IXS10. Consequently, two or more of encoders EN100, EH100, and ES100 may be configured to use the same LPC analysis processing path (possibly including quantization, and possibly also including dequantization), with different respective configurations, at different times. Highband encoder EH110 includes a synthesis filter FSH10 configured to produce synthesized highband signal SYH10 according to highband excitation signal XH10 and the LPC parameters produced by transform IXH10, and SHB encoder ES110 includes a synthesis filter FSS10 configured to produce synthesized SHB signal SYS10 according to SHB excitation signal XS10 and the LPC parameters produced by transform IXS10.

For different type of speech frames, different numbers of bits can be allocated in the highband and SHB quantization processes. Since a silence period does not usually contain much highband or SHB content, sending no highband or SHB information in the silence period can save the overall bit-rate requirement. Voiced and unvoiced frames can also be treated differently during the VQ training and coding process. Generally speaking, when there is not much constraint in the codebook size and codeword searching complexity, a single-stage large codebook VQ can be used by highband encoder EH100 and/or by SHB encoder ES100. On the other hand, if there is a tight constraint on the memory and complexity of the quantization process, a multi-stage and/or split VQ can be adopted by highband encoder EH100 and/or by SHB encoder ES100.

Figure 22A:
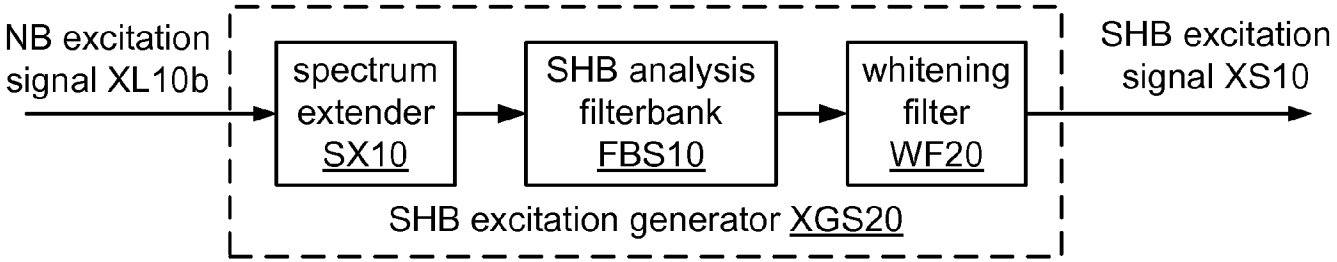
FIG. 22A shows a block diagram of an implementation XGS20 of superhighband excitation generator XGS10.

As shown in FIG. 19, SHB encoder ES110 includes a SHB excitation generator XGS10 that is configured to produce SHB excitation signal XS10 from narrowband excitation signal XL10*b*. As shown in FIG. 21, SHB decoder DS110 also includes an instance of SHB excitation generator XGS10 that is configured to produce SHB excitation signal XS10 from narrowband excitation signal XL10*b*. FIG. 22A shows a block diagram of an implementation XGS20 of SHB excitation generator XGS10 that is configured to generate SHB excitation signal XS10 from narrowband excitation signal XL10*b*. Generator XGS20 includes a spectrum extender SX10, a SHB analysis filter bank FBS10, and an adaptive whitening filter AW10.

Spectrum extender SX10 is configured to extend the spectrum of narrowband excitation signal XL10*b* into the frequency range occupied by SHB signal SIS10. Spectrum extender SX10 may be configured to apply a memoryless nonlinear function to narrowband excitation signal XL10*b*, such as the absolute value function (also called fullwave rectification), halfwave rectification, squaring, cubing, or clipping. Spectrum extender SX10 may be configured to upsample narrowband excitation signal XL10*b* (e.g., to a 32-kHz sampling rate, or to a sampling rate equal to or closer to that of SHB signal SIS10) before applying the nonlinear function. An analysis filterbank FBS10, which may be the same highband analysis filterbank that was used to generate the highband excitation signal (e.g., HB analysis processing path PAH10, PAH12, or PAH20), is then applied to the spectrally extended signal to produce a signal having a desired sampling rate (e.g., $f_{SS}$, or 14 kHz).

The spectrally extended signal is likely to have a pronounced dropoff in amplitude as frequency increases. A whitening filter WF20 (e.g., an adaptive sixth-order linear prediction filter) may be used to spectrally flatten the harmonically extended result to produce SHB excitation signal XS10. Further implementations of SHB excitation generator XGS20 may be configured to mix the harmonically extended signal with a noise signal, which may be temporally modulated according to a time-domain envelope of narrowband signal SIL10 or narrowband excitation signal XL10*b*.

Note that the SHB excitation is generated both at the encoder and at the decoder. In order for the decoding process to be consistent with the encoding process, it may be desirable for the encoder and decoder to generate identical SHB excitations. Such a result may be achieved by using information from the encoded narrowband excitation signal XL10, which is available to both the encoder and the decoder, to generate the SHB excitation both at the encoder and at the decoder. For example, the dequantized narrowband excitation signal may be used as the input XL10*b* to SHB excitation generator XGS10 at the encoder and at the decoder.

Artifacts may occur in a synthesized speech signal when a sparse codebook (one whose entries are mostly zero values) has been used to calculate the quantized representation of the residual. Codebook sparseness may occur especially when the narrowband excitation signal has been encoded at a low bit rate. Artifacts caused by codebook sparseness are typically quasi-periodic in time and occur mostly above 3 kHz. Because the human ear has better time resolution at higher frequencies, these artifacts may be more noticeable in the highband and/or superhighband.

Figure 22B:
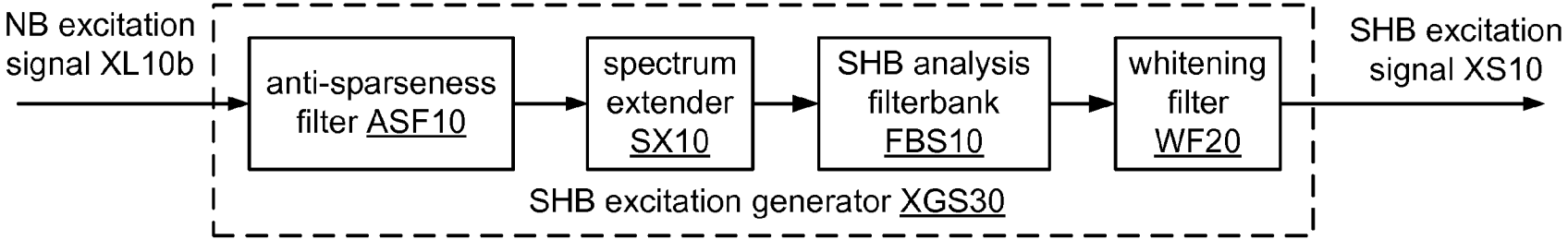
FIG. 22B shows a block diagram of an implementation XGS30 of superhighband excitation generator XGS20.

Embodiments include implementations of highband excitation generator XGS10 that are configured to perform anti-sparseness filtering. FIG. 22B shows a block diagram of an implementation XGS30 of SHB excitation generator XGS20 that includes an anti-sparseness filter ASF10 arranged to filter narrowband excitation signal XL10*b*. In one example, anti-sparseness filter ASF10 is implemented as an all-pass filter of the form $$H(z) = \frac{-0.7 + z^{-4}}{1 - 0.7z^{-4}} \cdot \frac{0.6 + z^{-6}}{1 + 0.6z^{-6}}.$$

Anti-sparseness filter ASF10 may be configured to alter the phase of its input signal. For example, it may be desirable for anti-sparseness filter ASF10 to be configured and arranged such that the phase of SHB excitation signal XS10 is randomized, or otherwise more evenly distributed, over time. It may also be desirable for the response of anti-sparseness filter ASF10 to be spectrally flat, such that the magnitude spectrum of the filtered signal is not appreciably changed. In one example, anti-sparseness filter ASF10 is implemented as an all-pass filter having a transfer function according to the following expression:

$$H(z) = \frac{-0.7 + z^{-4}}{1 - 0.7z^{-4}} \times \frac{0.6 + z^{-6}}{1 + 0.6z^{-6}} \times \frac{0.5 + z^{-8}}{1 + 0.5z^{-8}}.$$

One effect of such a filter may be to spread out the energy of the input signal so that it is no longer concentrated in only a few samples.

Artifacts caused by codebook sparseness are usually more noticeable for noise-like signals, where the residual includes less pitch information, and also for speech in background noise. Sparseness typically causes fewer artifacts in cases where the excitation has long-term structure, and indeed phase modification may cause noisiness in voiced signals. Thus it may be desirable to configure anti-sparseness filter ASF10 to filter unvoiced signals and to pass at least some voiced signals without alteration. Use of ASF filter ASF10 may be selected based on factors such as voicing, periodicity, and/or spectral tilt. Unvoiced signals are characterized by a low pitch gain (e.g. quantized narrowband adaptive codebook gain) and a spectral tilt (e.g. quantized first reflection coefficient) that is close to zero or positive, indicating a spectral envelope that is flat or tilted upward with increasing frequency. Typical implementations of anti-sparseness filter ASF10 are configured to filter unvoiced sounds (e.g., as indicated by the value of the spectral tilt), to filter voiced sounds when the pitch gain is below a threshold value (alternatively, not greater than the threshold value), and otherwise to pass the signal without alteration.

Further implementations of anti-sparseness filter ASF10 include two or more filters that are configured to have different maximum phase modification angles (e.g., up to 180 degrees). In such case, anti-sparseness filter ASF10 may be configured to select among these component filters according to a value of the pitch gain (e.g., the quantized adaptive codebook or LTP gain), such that a greater maximum phase modification angle is used for frames having lower pitch gain values. An implementation of anti-sparseness filter ASF10 may also include different component filters that are configured to modify the phase over more or less of the frequency spectrum, such that a filter configured to modify the phase over a wider frequency range of the input signal is used for frames having lower pitch gain values.

Figure 20:
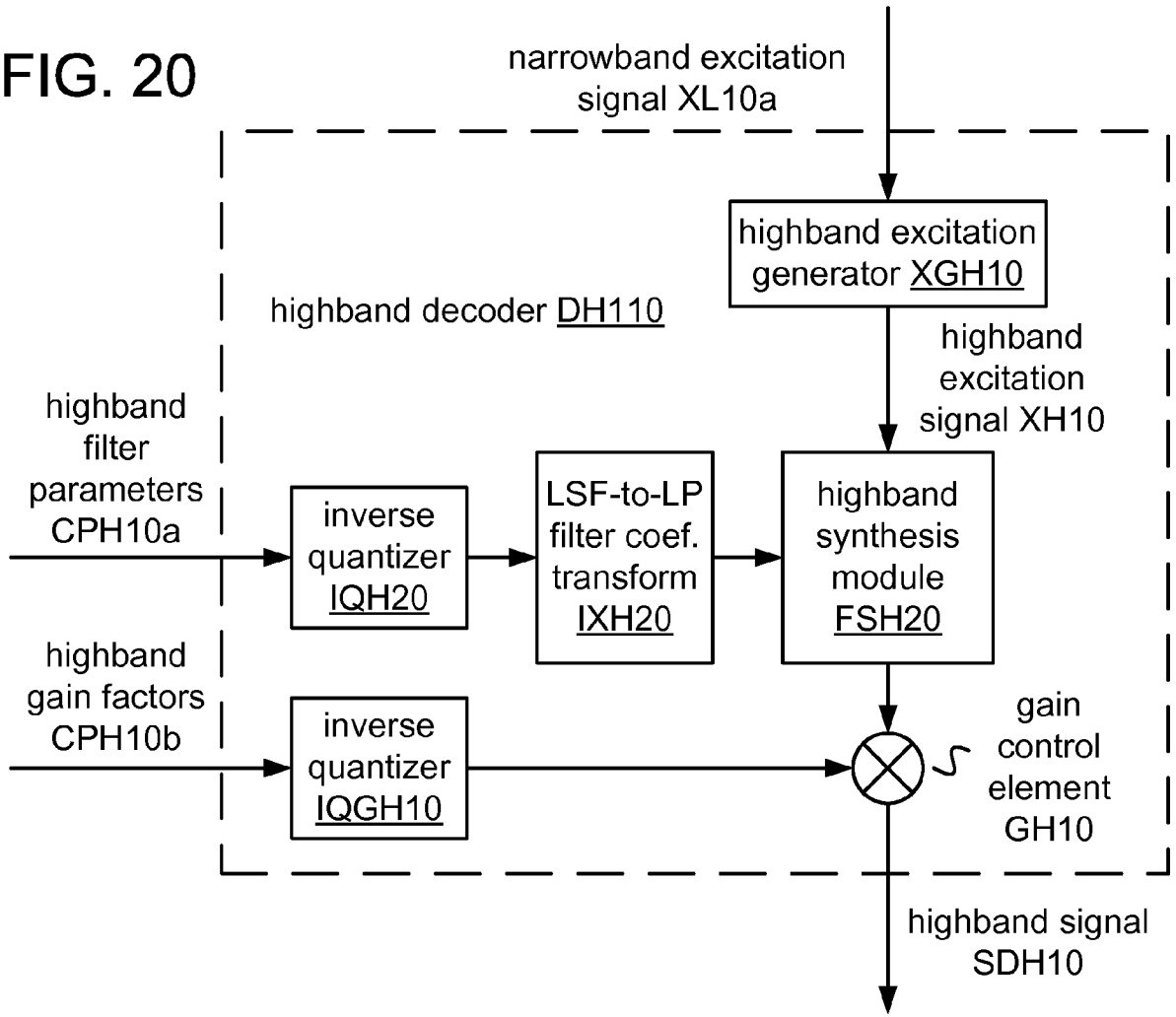
FIG. 20 shows a block diagram of an implementation DH110 of highband decoder DH100.

As shown in FIG. 18, highband encoder EH110 includes a highband excitation generator XGH10 that is configured to produce highband excitation signal XH10 from narrowband excitation signal XL10*a*. As shown in FIG. 20, highband decoder DH110 also includes an instance of highband excitation generator XGH10 that is configured to produce highband excitation signal XH10 from narrowband excitation signal XL10*a*. Highband excitation generator XGH10 may be implemented in the same manner as SHB excitation generator XGS20 or XGS30 as described herein, with spectrum extender SX10 being configured to upsample to 16 kHz rather than 32 kHz. Additional description of highband excitation generator XGH10 may be found, e.g., in section 4.3.3.3 (pp. 4.21-4.22) of the document 3GPP2 C.S0014-D, v3.0, October 2010, "Enhanced Variable Rate Codec, Speech Service Options 3, 68, 70, 73 for Wideband Spread Spectrum Digital Systems," available online at www-dot-3gpp2-dot-org.

For accurate reproduction of the encoded speech signal, it may be desirable for the ratio between the levels of the highband and narrowband portions of the synthesized SWB signal SOSW10 to be similar to that in the original SWB signal SISW10. In addition to a spectral envelope as represented by SHB coding parameters CPS10, SHB encoder ES100 may be configured to characterize SHB signal SIS10 by specifying a temporal or gain envelope. As shown in FIG. 19, SHB encoder ES110 includes a SHB gain factor calculator GCS10 that is configured and arranged to calculate one or more gain factors according to a relation between SHB signal SIS10 and synthesized SHB signal SYS10, such as a difference or ratio between the energies of the two signals over a frame or some portion thereof. In other implementations of SHB encoder ES110, SHB gain calculator GCS10 may be likewise configured but arranged instead to calculate the gain envelope according to such a time-varying relation between SHB signal SIS10 and narrowband excitation signal XL10*b* or SHB excitation signal XS10.

Figure 23B:
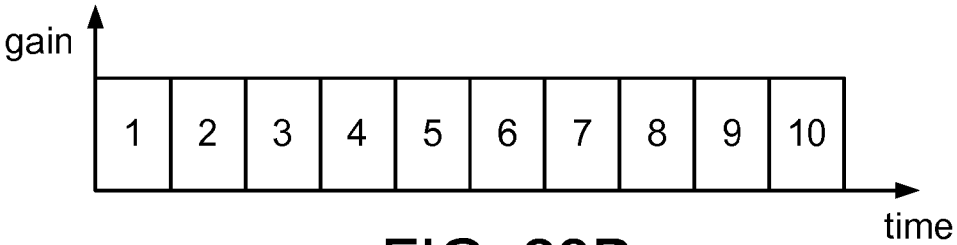
FIG. 23B shows an example of a division of a frame into ten subframes.

The temporal envelopes of narrowband excitation signal XL10*b* and SHB signal SIS10 are likely to be similar. Therefore, encoding a gain envelope that is based on a relation between SHB signal SIS10 and narrowband excitation signal XL10*b* (or a signal derived therefrom, such as SHB excitation signal XS10 or synthesized SHB signal SYS10) will generally be more efficient than encoding a gain envelope based only on SHB signal SIS10. In a typical implementation, quantizer QGS10 of SHB encoder ES110 is configured to output a quantized index (e.g., of 8, 10, 12, 14, 16, 18, or 20 bits) that specifies ten subframe gain factors (e.g., for each of ten subframes as shown in FIG. 23B) and a normalization factor as SHB gain factors CPS10*b* for each frame.

SHB gain factor calculator GCS10 may be configured to perform gain factor calculation by calculating a gain value for a corresponding subframe according to the relative energies of SHB signal SHB10 and synthesized SHB signal SYS10. Calculator GCS10 may be configured to calculate the energies of the corresponding subframes of the respective signals (for example, to calculate the energy as a sum of the squares of the samples of the respective subframe). Calculator GCS10 may be configured then to calculate a gain factor for the subframe as the square root of the ratio of those energies (e.g., to calculate the gain factor as the square root of the ratio of the energy of SHB signal SIS10 to the energy of synthesized SHB signal SYS10 over the subframe).

It may be desirable for SHB gain factor calculator GCS10 to be configured to calculate the subframe energies according to a windowing function. For example, calculator GCS10 may be configured to apply the same windowing function to SHB signal SIS10 and synthesized SHB signal SYS10, to calculate the energies of the respective windows, and to calculate a gain factor for the subframe as the square root of the ratio of the energies. Once the subframe gain factors for the frame have been calculated, it may be desirable for calculator GCS10 to calculate a normalization factor for the frame and to normalize the subframe gain factors according to the normalization factor.

It may be desirable to apply a windowing function that overlaps adjacent subframes. For example, a windowing function that produces gain factors which may be applied in an overlap-add fashion may help to reduce or avoid discontinuity between subframes. In one example, SHB gain factor calculator GCS10 is configured to apply a trapezoidal windowing function as shown in FIG. 23C, in which the window overlaps each of the two adjacent subframes by one millisecond. Other implementations of SHB gain factor calculator GCS10 may be configured to apply windowing functions having different overlap periods and/or different window shapes (e.g., rectangular, Hamming) that may be symmetrical or asymmetrical. It is also possible for an implementation of SHB gain factor calculator GCS10 to be configured to apply different windowing functions to different subframes within a frame and/or for a frame to include subframes of different lengths.

The SHB encoder may be configured to determine side information for the gain factors by comparing the synthesized SHB signal with the original SHB signal. The decoder then uses these gains to properly scale the synthesized SHB signal.

While a higher order of the SHB LPC coefficients may be expected to model fine structure of the spectrum with sufficient detail, it may also be desirable to use a relatively high time-domain resolution to reproduce a good SWB signal. In one implementation as described above, ten temporal gain parameters, each representing a scale factor for a corresponding two-millisecond subframe, are computed for each twenty-millisecond frame of the input speech signal (e.g., as shown in FIG. 23B). The gain parameters may be calculated by comparing the energy in each subframe of the input SHB signal with the energy in the corresponding subframe of the unscaled, synthesized SHB excitation signal. Calculation of each subframe gain may be performed using a rectangular window in time that selects only the samples of the particular subframe or, alternatively, a windowing function that extends into the previous and/or subsequent subframe (e.g., as shown in FIG. 23C). It may also be desirable to compute a frame gain for each frame to adjust the overall speech energy level. In order to improve the subsequent quantization process, each subframe gain vector may be normalized by the corresponding frame gain value. The frame-gain value may also be adjusted to compensate the subframe gain normalization.

It may be desirable to configure SHB gain factor calculator GCS10 to perform attenuation of the gain factors in response to a large variation over time among the gain factors, which may indicate that the synthesized signal is very different from the original signal. Alternatively or additionally, it may be desirable to configure SHB gain factor calculator GCS10 to perform temporal smoothing of the gain factors (e.g., to reduce variations that may give rise to audible artifacts).

Likewise, the temporal envelopes of narrowband excitation signal XL10*a* and highband signal SIH10 are likely to be similar. As shown in FIG. 18, highband encoder EH100 may be implemented to include a highband gain factor calculator GCH10 that is configured and arranged to calculate one or more gain factors according to a relation between highband signal SIH10 and narrowband excitation signal XL10*a* (or a signal based thereon, such as synthesized highband signal SYH10 or highband excitation signal XH10). Calculator GCH10 may be implemented in the same manner as calculator GCS10, except that it may be desirable for calculator GCH10 to calculate gain factors for fewer subframes per frame than calculator GCS10. In a typical implementation, quantizer QGH10 of highband encoder EH110 is configured to output a quantized index (e.g., of eight to twelve bits) that specifies five subframe gain factors (e.g., for each of five subframes as shown in FIG. 23A) and a normalization factor as highband gain factors CPH10*b* for each frame.

FIG. 20 shows a block diagram of an implementation DH110 of highband decoder DH100. Highband decoder DH110 includes an instance of highband excitation generator XGH10 as described herein that is configured to produce highband excitation signal XH10 based on narrowband excitation signal XL10*a*. Decoder DH110 includes an inverse quantizer IQH20 configured to dequantize highband filter parameters CPH10*a* (in this example, to a set of LSFs), and LSF-to-LP filter coefficient transform IXH20 is configured to transform the LSFs into a set of filter coefficients (for example, as described above with reference to inverse quantizer IQXN10 and transform IXN20 of narrowband decoder DN110). In other implementations, as mentioned above, different coefficient sets (e.g., cepstral coefficients) and/or coefficient representations (e.g., ISPs) may be used. Highband synthesis module FSH20 is configured to produce a synthesized highband signal according to highband excitation signal XH10 and the set of filter coefficients. For a system in which the highband encoder includes a synthesis filter (e.g., as in the example of encoder EH110 described above), it may be desirable to implement highband synthesis module FSH20 to have the same response (e.g., the same transfer function) as that synthesis filter.

Highband decoder DH110 also includes an inverse quantizer IQGH10 configured to dequantize highband gain factors CPH10*b*, and a gain control element GH10 (e.g., a multiplier or amplifier) configured and arranged to apply the dequantized gain factors to the synthesized highband signal to produce highband signal SDH10. For a case in which the gain envelope of a frame is specified by more than one gain factor, gain control element GH10 may include logic configured to apply the gain factors to the respective subframes, possibly according to a windowing function that may be the same or a different windowing function as applied by a gain calculator (e.g., highband gain calculator GCH10) of the corresponding highband encoder. Similarly, gain control element GH10 may include logic configured to apply a normalization factor to the gain factors before they are applied to the signal. In other implementations of highband decoder DH110, gain control element GH10 is similarly configured but is arranged instead to apply the dequantized gain factors to narrowband excitation signal XL10*a* or to highband excitation signal XH10.

As mentioned above, it may be desirable to obtain the same state in the highband encoder and highband decoder (e.g., by using dequantized values during encoding). Thus it may be desirable in a coding system according to such an implementation to ensure the same state for corresponding noise generators in the highband excitation generators of the encoder and decoder. For example, the highband excitation generators of such an implementation may be configured such that the state of the noise generator is a deterministic function of information already coded within the same frame (e.g., narrowband filter parameters FPN10 or a portion thereof and/or encoded narrowband excitation signal XL10 or a portion thereof).

FIG. 21 shows a block diagram of an implementation DS110 of SHB decoder DS100. SHB decoder DS110 includes an instance of SHB excitation generator XGS10 as described herein that is configured to produce SHB excitation signal XS10 based on narrowband excitation signal XL10*b*. Decoder DS110 includes an inverse quantizer IQS20 configured to dequantize SHB filter parameters CPS10*a* (in this example, to a set of LSFs), and LSF-to-LP filter coefficient transform IXS20 is configured to transform the LSFs into a set of filter coefficients (for example, as described above with reference to inverse quantizer IQXN10 and transform IXN20 of narrowband decoder DN110). In other implementations, as mentioned above, different coefficient sets (e.g., cepstral coefficients) and/or coefficient representations (e.g., ISPs) may be used. SHB synthesis module FSS20 is configured to produce a synthesized SHB signal according to SHB excitation signal XS10 and the set of filter coefficients. For a system in which the SHB encoder includes a synthesis filter (e.g., as in the example of encoder ES110 described above), it may be desirable to implement SHB synthesis module FSS20 to have the same response (e.g., the same transfer function) as that synthesis filter.

SHB decoder DS110 also includes an inverse quantizer IQGS10 configured to dequantize SHB gain factors CPS10*b*, and a gain control element GS10 (e.g., a multiplier or amplifier) configured and arranged to apply the dequantized gain factors to the synthesized SHB signal to produce SHB signal SDS10. For a case in which the gain envelope of a frame is specified by more than one gain factor, gain control element GS10 may include logic configured to apply the gain factors to the respective subframes, possibly according to a windowing function that may be the same or a different windowing function as applied by a gain calculator (e.g., SHB gain calculator GCS10) of the corresponding SHB encoder. Similarly, gain control element GS10 may include logic configured to apply a normalization factor to the gain factors before they are applied to the signal. In other implementations of SHB decoder DS110, gain control element GS10 is similarly configured but is arranged instead to apply the dequantized gain factors to narrowband excitation signal XL10*b* or to SHB excitation signal XS10.

As mentioned above, it may be desirable to obtain the same state in the SHB encoder and SHB decoder (e.g., by using dequantized values during encoding). Thus it may be desirable in a coding system according to such an implementation to ensure the same state for corresponding noise generators in the SHB excitation generators of the encoder and decoder. For example, the SHB excitation generators of such an implementation may be configured such that the state of the noise generator is a deterministic function of information already coded within the same frame (e.g., narrowband filter parameters FPN10 or a portion thereof and/or encoded narrowband excitation signal XL10 or a portion thereof).

One or more of the quantizers of the elements described herein (e.g., quantizer QLN10, QLH10, QLS10, QGH10, or QGS10) may be configured to perform classified vector quantization. For example, such a quantizer may be configured to select one of a set of codebooks based on information that has already been coded within the same frame in the narrowband channel and/or in the highband channel. Such a technique typically provides increased coding efficiency at the expense of additional codebook storage.

Encoded narrowband excitation signal XL10 may describe a signal that is warped in time (e.g., by a relaxation CELP or other pitch-regularization technique). For example, it may be desirable to time-warp narrowband signal SIL10 or a signal based on the narrowband residual according to a model of the pitch structure of the low-frequency subband. In such case, it may be desirable to configure highband encoder EH100 to shift the highband signal SIH10 before gain factor calculation, based on the time warping described in the encoded narrowband excitation signal (e.g., as applied to the narrowband signal or to the residual) and also based on differences in sampling rates of the low-frequency subband and the highband signal SIH10. Likewise, it may be desirable to configure SHB encoder ES100 to shift the SHB signal SIS10 before gain factor calculation, based on the time warping described in the encoded narrowband excitation signal (e.g., as applied to the narrowband signal or to the residual) and also based on differences in sampling rates of the low-frequency subband and the SHB signal SIS10. Such time-warping may include different time shifts for each of at least two consecutive subframes of the time-warped signal and/or may include rounding a calculated time shift to an integer sample value. Time-warping of signal SIH10 or SIS10 may be performed upstream or downstream of the corresponding LPC analysis of the signal.

It is likely that the encoded signal will be carried on packet-switched networks. For circuit-switched operation, it may be desirable for the codec to implement discontinuous transmission (DTX) to reduce bandwidth during periods of silence.

A method according to a first general configuration includes calculating a first excitation signal (e.g., narrowband excitation signal XL10) based on information from a first frequency band of the speech signal. This method also includes calculating a second excitation signal for a second frequency band of the speech signal (e.g., SHB excitation signal XS10) based on information from the first excitation signal. In this method, the first and second frequency bands are separated by a distance of at least half the width of the first frequency band. In one example, the excitation signal includes a component having a frequency of at least 3000 Hz, and the second excitation signal includes a component having a frequency of not more than 8 kHz. In another example, the first and second frequency bands are separated by at least 2500 Hz. In an implementation as described herein, the first frequency band extends from 50 to 3500 Hz, and the second frequency band extends from 7 to 14 kHz.

A method according to a second general configuration includes calculating a first excitation signal (e.g., narrowband excitation signal XL10) based on information from a first frequency band of the speech signal. This method also includes calculating a second excitation signal for a second frequency band of the speech signal (e.g., SHB excitation signal XS10) based on information from the first excitation signal. In this method, the second excitation signal includes energy at each of a first and second frequency component, and these components are separated by a distance of at least fifty percent of the sampling rate of the first excitation signal. In another example, the second excitation signal includes energy in the ranges of 8000-8500 Hz and 13,000-13,500 Hz. In an implementation as described herein, the sampling rate of the first excitation signal is 8 kHz, and the second excitation signal includes energy at components ranging over a range of 7 kHz (e.g., from 7 to 14 kHz).

A method according to a third general configuration includes calculating a first excitation signal (e.g., narrowband excitation signal XL10) based on information from a first frequency band of the speech signal. This method also includes calculating a second excitation signal for a second frequency band of the speech signal (e.g., a highband excitation signal) based on information from the first excitation signal, and calculating a third excitation signal for a third frequency band of the speech signal (e.g., SHB excitation signal XS10) based on information from the first excitation signal. In this method, the second frequency band is different from (but may overlap) the first frequency band, the third frequency band is different from (but may overlap) the second frequency band, and the third frequency band is separate from the first frequency band. In one example, calculating the second excitation signal includes extending the spectrum of the first excitation signal into the second frequency band, and calculating the third excitation signal includes extending the spectrum of the first excitation signal into the third frequency band. In another example, the second frequency band includes frequencies between 5 kHz and 6 kHz, and the third frequency band includes frequencies between 10 kHz and 11 kHz. In an implementation as described herein, the second excitation signal extends from 3500 Hz to 7 kHz, and the third excitation signal extends from 7 to 14 kHz.

A method according to a fourth general configuration includes calculating a first excitation signal (e.g., narrowband excitation signal XL10) based on information from a first frequency band of the speech signal. This method also includes calculating a second excitation signal for a second frequency band of the speech signal (e.g., a highband excitation signal) based on information from the first excitation signal, and calculating a third excitation signal for a third frequency band of the speech signal (e.g., SHB excitation signal XS10) based on information from the first excitation signal. In this method, the second frequency band is different from (but may overlap) the first frequency band, the third frequency band is different from (but may overlap) the second frequency band, and the third frequency band is separate from the first frequency band.

This method includes calculating a first plurality m of gain factors that describe a relation between (A) a frame of a signal that is based on information from the first frequency band and (B) a corresponding frame of a signal that is based on information from the second excitation signal. This method also includes calculating a second plurality n of gain factors that describe a relation between (A) said frame of the signal that is based on information from the first frequency band and (B) a corresponding frame of a signal that is based on information from the third excitation signal, wherein n is greater than m.

In one example, each of the first plurality m of gain factors corresponds to one of m subframes, and each of the second plurality n of gain factors corresponds to one of n subframes. In another example, calculating the first plurality m of gain factors includes normalizing the first plurality m of gain factors according to a first gain frame value, and calculating the second plurality n of gain factors includes normalizing the second plurality n of gain factors according to a second gain frame value. In an implementation as described herein, m is equal to five and n is equal to ten.

Figure 24A:
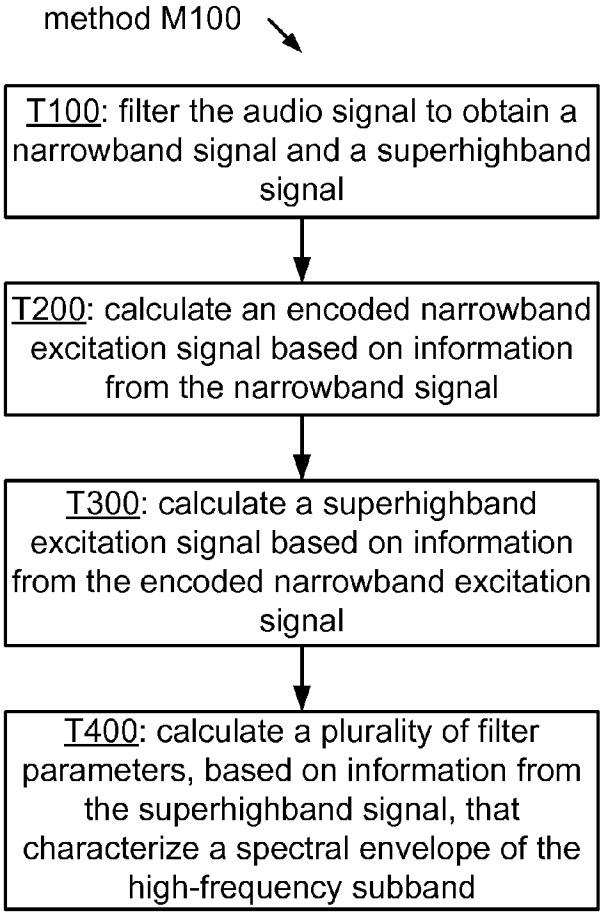
FIG. 24A shows a flowchart of a method M100 according to a general configuration.

FIG. 24A shows a flowchart of a method M100, according to a general configuration, of processing an audio signal having frequency content in a low-frequency subband and in a high-frequency subband that is separate from the low-frequency subband. Method M100 includes task T100 that filters the audio signal to obtain a narrowband signal and a superhighband signal (e.g., as described herein with reference to filter bank FB100), a task T200 that calculates an encoded narrowband excitation signal based on information from the narrowband signal (e.g., as described herein with reference to narrowband encoder EN100), and a task T300 that calculates a superhighband excitation signal based on information from the encoded narrowband excitation signal (e.g., as described herein with reference to SHB encoder ES100). Method M100 also includes a task T400 that calculates a plurality of filter parameters, based on information from the superhighband signal, that characterize a spectral envelope of the high-frequency subband (e.g., as described herein with reference to SHB gain factor calculator GCS100). In this method, the narrowband signal is based on the frequency content in the low-frequency subband, and the superhighband signal is based on the frequency content in the high-frequency subband. In this method, a width of the low-frequency subband is at least two kilohertz, and the low-frequency subband and the high-frequency subband are separated by a distance that is at least equal to half of the width of the low-frequency subband. Method M100 may also include a task that calculates a plurality of gain factors by evaluating a time-varying relation between a signal that is based on the superhighband signal and a signal that is based on the superhighband excitation signal.

Figure 24B:
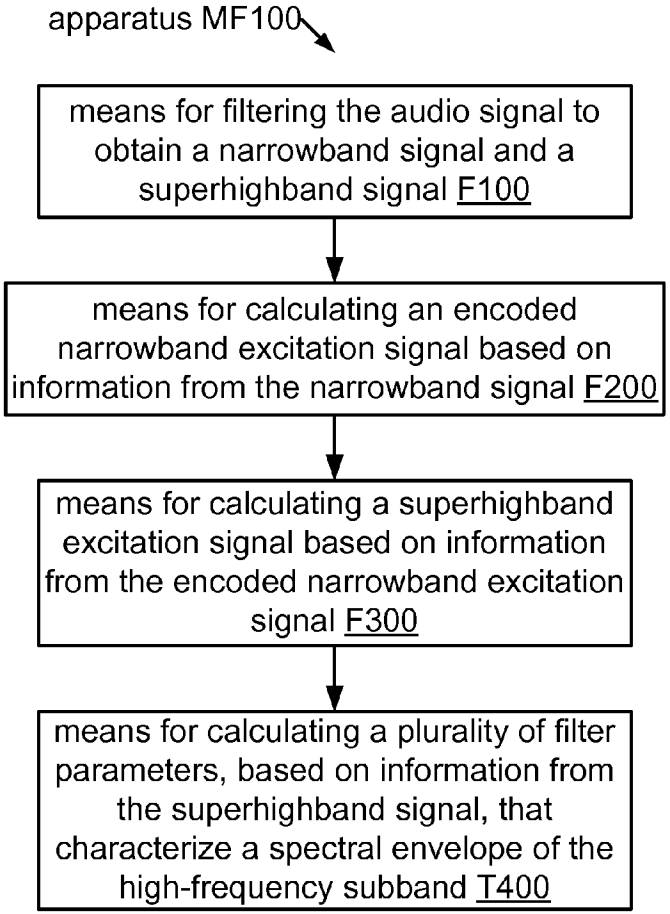
FIG. 24B shows a block diagram of an apparatus MF100 according to a general configuration.

FIG. 24B shows a block diagram of an apparatus MF100, according to a general configuration, for processing an audio signal having frequency content in a low-frequency subband and in a high-frequency subband that is separate from the low-frequency subband. Apparatus MF100 includes means F100 for filtering the audio signal to obtain a narrowband signal and a superhighband signal (e.g., as described herein with reference to filter bank FB100), means F200 for calculating an encoded narrowband excitation signal based on information from the narrowband signal (e.g., as described herein with reference to narrowband encoder EN100), and means F300 for calculating a superhighband excitation signal based on information from the encoded narrowband excitation signal (e.g., as described herein with reference to SHB encoder ES100). Apparatus MF100 also includes means F400 for calculating a plurality of filter parameters, based on information from the superhighband signal, that characterize a spectral envelope of the high-frequency subband (e.g., as described herein with reference to SHB gain factor calculator GCS100). In this apparatus, the narrowband signal is based on the frequency content in the low-frequency subband, and the superhighband signal is based on the frequency content in the high-frequency subband. In this apparatus, a width of the low-frequency subband is at least two kilohertz, and the low-frequency subband and the high-frequency subband are separated by a distance that is at least equal to half of the width of the low-frequency subband. Apparatus MF100 may also include means for calculating a plurality of gain factors by evaluating a time-varying relation between a signal that is based on the superhighband signal and a signal that is based on the superhighband excitation signal.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the configurations described herein is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system as described herein may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing (e.g., spectral masking and/or another spectral modification operation based on a noise estimate, such as spectral subtraction or Wiener filtering) for more aggressive noise reduction.

The various processing elements of an implementation of an apparatus as disclosed herein (e.g., encoder SWE100 and decoder SWD100 and elements thereof) may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., encoder SWE100 and decoder SWD100 and elements thereof) may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 (or another method as disclosed with reference to operation of an apparatus or device described herein), such as a task relating to another operation of a device or system in which the processor is embedded (e.g., a voice communications device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., method M100 and other methods disclosed with reference to operation of the various apparatus described herein) may be performed by an array of logic elements such as a processor, and that the various elements of an apparatus as described herein may be implemented in part as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of processing an audio signal having frequency content in a low-frequency subband and in a high-frequency subband that is separate from the low-frequency subband, said method comprising:

filtering the audio signal to obtain a narrowband signal and a superhighband signal;

based on information from the narrowband signal, calculating an encoded narrowband excitation signal;

based on information from the encoded narrowband excitation signal, calculating a superhighband excitation signal;

based on information from the superhighband signal, calculating a plurality of filter parameters that characterize a spectral envelope of the high-frequency subband; and calculating a plurality of gain factors by evaluating a time-varying relation between a signal that is based on the superhighband signal and a signal that is based on the superhighband excitation signal, wherein the narrowband signal is based on the frequency content in the low-frequency subband, and wherein the superhighband signal is based on the frequency content in the high-frequency subband, and wherein a width of the low-frequency subband is at least three kilohertz, and wherein the low-frequency subband and the high-frequency subband are separated by a distance that is at least equal to half of the width of the low-frequency subband.

2. The method according to claim 1, wherein the frequency content of the low-frequency subband includes a component having a frequency at least equal to three kilohertz, and wherein the frequency content of the high-frequency subband includes a component having a frequency not greater than eight kilohertz.

3. The method according to claim 1, wherein the low-frequency subband and the high-frequency subband are separated by at least twenty-five hundred Hertz.

4. The method according to claim 1, wherein said plurality of filter parameters includes a plurality FCH of filter coefficients that characterize a spectral envelope of a frame of the high-frequency subband, and wherein said method includes calculating a plurality FCL of filter coefficients that characterize a spectral envelope of a corresponding frame of the low-frequency subband, and wherein FCH is less than FCL.

5. The method according to claim 1, wherein said filtering the audio signal includes:

resampling a signal that is based on the frequency content in the high-frequency subband to obtain a resampled signal; and performing a spectral reversal operation on a signal that is based on the resampled signal to obtain a spectrally reversed signal, wherein the superhighband signal is based on the spectrally reversed signal.

6. The method according to claim 1, wherein said calculating the superhighband excitation signal includes:

upsampling a signal that is based on the information from the encoded narrowband excitation signal to produce an interpolated signal; and extending the spectrum of a signal that is based on the interpolated signal to produce a spectrally extended signal, and wherein the superhighband excitation signal is based on the spectrally extended signal.

7. The method according to claim 1, wherein said encoded narrowband excitation signal includes a fixed codebook index and an adaptive codebook index.

8. The method according to claim 1, wherein the narrowband signal has a first sampling rate, and wherein the width of the high-frequency subband is greater than fifty percent of the first sampling rate.

9. The method according to claim 8, wherein the width of the high-frequency subband is at least equal to seventy-five percent of the first sampling rate.

10. The method according to claim 1, wherein the width of the high-frequency subband is at least six kilohertz.

11. The method according to claim 1, wherein the high-frequency subband includes the frequency range of from eight kilohertz (8 kHz) to eighty-five hundred Hertz (8500 Hz), and wherein the high-frequency subband includes the frequency range of from thirteen kilohertz (13 kHz) to thirteen-and-one-half kilohertz (13,500 Hz).

12. The method according to claim 1, wherein the audio signal has frequency content in a mid-frequency subband that is different from the low-frequency subband, and wherein said filtering the audio signal includes obtaining a highband signal that is based on the frequency content in the mid-frequency subband, and wherein said method includes:

calculating a highband excitation signal based on information from the encoded narrowband excitation signal;

based on information from the highband signal, calculating a plurality of filter parameters that characterize a spectral envelope of the mid-frequency subband; and calculating a second plurality of gain factors by evaluating a time-varying relation between a signal that is based on the highband signal and a signal that is based on the highband excitation signal.

13. The method according to claim 12, wherein said calculated plurality of gain factors includes a plurality n of gain factors that describe a relation between (A) a frame of the signal that is based on the superhighband signal and (B) a corresponding frame of the signal that is based on the superhighband excitation signal, and wherein said second plurality of gain factors includes a plurality m of gain factors that describe a relation between (A) a frame of the signal that is based on the highband signal and (B) a corresponding frame of the signal that is based on the highband excitation signal, wherein n is greater than m.

14. The method according to claim 12, wherein said calculating the superhighband excitation signal includes extending the spectrum of the encoded narrowband excitation signal into a frequency range occupied by the high-frequency subband, and wherein said calculating the highband excitation signal includes extending the spectrum of the encoded narrowband excitation signal into a frequency range occupied by the mid-frequency band.

15. The method according to claim 12, wherein the mid-frequency subband includes frequencies between five kilohertz and six kilohertz, and wherein the high-frequency subband includes frequencies between ten kilohertz and eleven kilohertz.

16. The method according to claim 12, wherein the narrowband signal has a first sampling rate, and wherein the highband signal has a second sampling rate that is less than the first sampling rate.

17. The method according to claim 16, wherein the superhighband signal has a third sampling rate that is less than the sum of the first and second sampling rates.

18. The method according to claim 12, wherein said plurality of filter parameters that characterize a spectral envelope of the high-frequency subband includes a plurality FCH of filter coefficients that characterize a spectral envelope of a frame of the high-frequency subband, and wherein said plurality of filter parameters that characterize a spectral envelope of the mid-frequency subband includes a plurality FCM of filter coefficients that characterize a spectral envelope of a corresponding frame of the mid-frequency subband, and wherein FCM is less than FCH.

19. An apparatus for processing an audio signal having frequency content in a low-frequency subband and in a high-frequency subband that is separate from the low-frequency subband, said apparatus comprising:

means for filtering the audio signal to obtain a narrowband signal and a superhighband signal;

means for calculating an encoded narrowband excitation signal based on information from the narrowband signal;

means for calculating a superhighband excitation signal based on information from the encoded narrowband excitation signal;

means for calculating a plurality of filter parameters, based on information from the superhighband signal, that characterize a spectral envelope of the high-frequency subband; and means for calculating a plurality of gain factors by evaluating a time-varying relation between a signal that is based on the superhighband signal and a signal that is based on the superhighband excitation signal, wherein the narrowband signal is based on the frequency content in the low-frequency subband, and wherein the superhighband signal is based on the frequency content in the high-frequency subband, and wherein a width of the low-frequency subband is at least three kilohertz, and wherein the low-frequency subband and the high-frequency subband are separated by a distance that is at least equal to half of the width of the low-frequency subband.

20. The apparatus according to claim 19, wherein the frequency content of the low-frequency subband includes a component having a frequency at least equal to three kilohertz, and wherein the frequency content of the high-frequency subband includes a component having a frequency not greater than eight kilohertz.

21. The apparatus according to claim 19, wherein the low-frequency subband and the high-frequency subband are separated by at least twenty-five hundred Hertz.

22. The apparatus according to claim 19, wherein said plurality of filter parameters includes a plurality FCH of filter coefficients that characterize a spectral envelope of a frame of the high-frequency subband, and wherein said apparatus includes means for calculating a plurality FCL of filter coefficients that characterize a spectral envelope of a corresponding frame of the low-frequency subband, and wherein FCH is less than FCL.

23. The apparatus according to claim 19, wherein said means for filtering the audio signal includes:

means for resampling a signal that is based on the frequency content in the high-frequency subband to obtain a resampled signal; and means for performing a spectral reversal operation on a signal that is based on the resampled signal to obtain a spectrally reversed signal, wherein the superhighband signal is based on the spectrally reversed signal.

24. The apparatus according to claim 19, wherein said means for calculating the superhighband excitation signal includes:

means for upsampling a signal that is based on the information from the encoded narrowband excitation signal to produce an interpolated signal; and means for extending the spectrum of a signal that is based on the interpolated signal to produce a spectrally extended signal, and wherein the superhighband excitation signal is based on the spectrally extended signal.

25. The apparatus according to claim 19, wherein said encoded narrowband excitation signal includes a fixed codebook index and an adaptive codebook index.

26. The apparatus according to claim 19, wherein the narrowband signal has a first sampling rate, and wherein the width of the high-frequency subband is greater than fifty percent of the first sampling rate.

27. The apparatus according to claim 26, wherein the width of the high-frequency subband is at least equal to seventy-five percent of the first sampling rate.

28. The apparatus according to claim 19, wherein the width of the high-frequency subband is at least six kilohertz.

29. The apparatus according to claim 19, wherein the high-frequency subband includes the frequency range of from eight kilohertz (8 kHz) to eighty-five hundred Hertz (8500 Hz), and wherein the high-frequency subband includes the frequency range of from thirteen kilohertz (13 kHz) to thirteen-and-one-half kilohertz (13,500 Hz).

30. The apparatus according to claim 19, wherein the audio signal has frequency content in a mid-frequency subband that is different from the low-frequency subband, and wherein said means for filtering the audio signal includes means for obtaining a highband signal that is based on the frequency content in the mid-frequency subband, and wherein said apparatus includes:

means for calculating a highband excitation signal based on information from the encoded narrowband excitation signal;

means for calculating a plurality of filter parameters, based on information from the highband signal, that characterize a spectral envelope of the mid-frequency subband; and means for calculating a second plurality of gain factors by evaluating a time-varying relation between a signal that is based on the highband signal and a signal that is based on the highband excitation signal.

31. The apparatus according to claim 30, wherein said calculated plurality of gain factors includes a plurality n of gain factors that describe a relation between (A) a frame of the signal that is based on the superhighband signal and (B) a corresponding frame of the signal that is based on the superhighband excitation signal, and wherein said second plurality of gain factors includes a plurality m of gain factors that describe a relation between (A) a frame of the signal that is based on the highband signal and (B) a corresponding frame of the signal that is based on the highband excitation signal, wherein n is greater than m.

32. The apparatus according to claim 30, wherein said means for calculating the superhighband excitation signal includes extending the spectrum of the encoded narrowband excitation signal into a frequency range occupied by the high-frequency subband, and wherein said means for calculating the highband excitation signal includes extending the spectrum of the encoded narrowband excitation signal into a frequency range occupied by the mid-frequency band.

33. The apparatus according to claim 30, wherein the mid-frequency subband includes frequencies between five kilohertz and six kilohertz, and wherein the high-frequency subband includes frequencies between ten kilohertz and eleven kilohertz.

34. The apparatus according to claim 30, wherein the narrowband signal has a first sampling rate, and wherein the highband signal has a second sampling rate that is less than the first sampling rate.

35. The apparatus according to claim 34, wherein the superhighband signal has a third sampling rate that is less than the sum of the first and second sampling rates.

36. The apparatus according to claim 30, wherein said plurality of filter parameters that characterize a spectral envelope of the high-frequency subband includes a plurality FCH of filter coefficients that characterize a spectral envelope of a frame of the high-frequency subband, and wherein said plurality of filter parameters that characterize a spectral envelope of the mid-frequency subband includes a plurality FCM of filter coefficients that characterize a spectral envelope of a corresponding frame of the mid-frequency subband, and wherein FCM is less than FCH.

37. An apparatus for processing an audio signal having frequency content in a low-frequency subband and in a high-frequency subband that is separate from the low-frequency subband, said apparatus comprising:

a memory; a processor;

a filter bank configured to filter the audio signal to obtain a narrowband signal and a superhighband signal;

a narrowband encoder configured to calculate an encoded narrowband excitation signal based on information from the narrowband signal; and a superhighband encoder configured (A) to calculate a superhighband excitation signal based on information from the encoded narrowband excitation signal, (B) to calculate a plurality of filter parameters, based on information from the superhighband signal, that characterize a spectral envelope of the high-frequency subband, and (C) to calculate a plurality of gain factors by evaluating a time-varying relation between a signal that is based on the superhighband signal and a signal that is based on the superhighband excitation signal, wherein the narrowband signal is based on the frequency content in the low-frequency subband, and wherein the superhighband signal is based on the frequency content in the high-frequency subband, and wherein a width of the low-frequency subband is at least three kilohertz, and wherein the low-frequency subband and the high-frequency subband are separated by a distance that is at least equal to half of the width of the low-frequency subband.

38. The apparatus according to claim 37, wherein the frequency content of the low-frequency subband includes a component having a frequency at least equal to three kilohertz, and wherein the frequency content of the high-frequency subband includes a component having a frequency not greater than eight kilohertz.

39. The apparatus according to claim 37, wherein the low-frequency subband and the high-frequency subband are separated by at least twenty-five hundred Hertz.

40. The apparatus according to claim 37, wherein said plurality of filter parameters includes a plurality FCH of filter coefficients that characterize a spectral envelope of a frame of the high-frequency subband, and wherein said narrowband encoder is configured to calculate a plurality FCL of filter coefficients that characterize a spectral envelope of a corresponding frame of the low-frequency subband, and herein FCH is less than FCL.

41. The apparatus according to claim 37, wherein said filter bank includes:

a resampler configured to resample a signal that is based on the frequency content in the high-frequency subband to obtain a resampled signal; and a spectral reversal module configured to perform a spectral reversal operation on a signal that is based on the resampled signal to obtain a spectrally reversed signal, wherein the superhighband signal is based on the spectrally reversed signal.

42. The apparatus according to claim 37, wherein said superhighband encoder includes:

an upsampler configured to upsample a signal that is based on the information from the encoded narrowband excitation signal to produce an interpolated signal; and a spectrum extender configured to extend the spectrum of a signal that is based on the interpolated signal to produce a spectrally extended signal, and wherein the superhighband excitation signal is based on the spectrally extended signal.

43. The apparatus according to claim 37, wherein the narrowband signal has a first sampling rate, and wherein the width of the high-frequency subband is greater than fifty percent of the first sampling rate.

44. The apparatus according to claim 43, wherein the width of the high-frequency subband is at least equal to seventy-five percent of the first sampling rate.

45. The apparatus according to claim 37, wherein the width of the high-frequency subband is at least six kilohertz.

46. The apparatus according to claim 37, wherein the high-frequency subband includes the frequency range of from eight kilohertz (8 kHz) to eighty-five hundred Hertz (8500 Hz), and wherein the high-frequency subband includes the frequency range of from thirteen kilohertz (13 kHz) to thirteen-and-one-half kilohertz (13,500 Hz).

47. The apparatus according to claim 37, wherein the audio signal has frequency content in a mid-frequency subband that is different from the low-frequency subband, and wherein said filter bank is configured to obtain a highband signal that is based on the frequency content in the mid-frequency subband, and wherein said apparatus includes:

a highband encoder configured (A) to calculate a highband excitation signal based on information from the encoded narrowband excitation signal, (B) to calculate a plurality of filter parameters, based on information from the highband signal, that characterize a spectral envelope of the mid-frequency subband, and (C) to calculate a second plurality of gain factors by evaluating a time-varying relation between a signal that is based on the highband signal and a signal that is based on the highband excitation signal.

48. The apparatus according to claim 47, wherein said calculated plurality of gain factors includes a plurality n of gain factors that describe a relation between (A) a frame of the signal that is based on the superhighband signal and (B) a corresponding frame of the signal that is based on the superhighband excitation signal, and wherein said second plurality of gain factors includes a plurality m of gain factors that describe a relation between (A) a frame of the signal that is based on the highband signal and (B) a corresponding frame of the signal that is based on the highband excitation signal, wherein n is greater than m.

49. A non-transitory computer-readable storage medium having tangible features that cause a machine reading the features to perform the following acts to process an audio signal having frequency content in a low-frequency subband and in a high-frequency subband that is separate from the low-frequency subband:

filter the audio signal to obtain a narrowband signal and a superhighband signal;

based on information from the narrowband signal, calculate an encoded narrowband excitation signal;

based on information from the encoded narrowband excitation signal, calculate a superhighband excitation signal;

based on information from the superhighband signal, calculate a plurality of filter parameters that characterize a spectral envelope of the high-frequency subband; and calculate a plurality of gain factors by evaluating a time-varying relation between a signal that is based on the superhighband signal and a signal that is based on the superhighband excitation signal, wherein the narrowband signal is based on the frequency content in the low-frequency subband, and wherein the superhighband signal is based on the frequency content in the high-frequency subband, and wherein a width of the low-frequency subband is at least three kilohertz, and wherein the low-frequency subband and the high-frequency subband are separated by a distance that is at least equal to half of the width of the low-frequency subband.

* * * * *